US006676462B2

(12) United States Patent
Yanagihara

(10) Patent No.: US 6,676,462 B2
(45) Date of Patent: Jan. 13, 2004

(54) REVERSE THRUST ARRANGEMENT FOR SMALL WATERCRAFT

(75) Inventor: Tsuide Yanagihara, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/281,874

(22) Filed: Oct. 24, 2002

(65) Prior Publication Data

US 2003/0100231 A1 May 29, 2003

(30) Foreign Application Priority Data

| | | |
|---|---|---|
| Oct. 24, 2001 | (JP) | 2001-325819 |
| Nov. 5, 2001 | (JP) | 2001-339848 |
| Nov. 5, 2001 | (JP) | 2001-339849 |
| Nov. 9, 2001 | (JP) | 2001-344174 |

(51) Int. Cl.[7] ..... B63H 23/10
(52) U.S. Cl. ..... 440/4; 440/41
(58) Field of Search ..... 440/4, 40, 41, 440/42

(56) References Cited

U.S. PATENT DOCUMENTS

| | | | | |
|---|---|---|---|---|
| 5,271,351 A | | 12/1993 | Horiuchi et al. | |
| 5,370,562 A | * | 12/1994 | Nanami | 440/42 |
| 5,988,091 A | | 11/1999 | Willis | |
| 6,171,159 B1 | | 1/2001 | Shen et al. | |
| 6,174,210 B1 | | 1/2001 | Spade et al. | |
| 6,227,919 B1 | | 5/2001 | Blanchard | |
| 6,428,370 B1 | * | 8/2002 | Jones | 440/38 |
| 6,530,812 B2 | * | 3/2003 | Koyano et al. | 440/38 |
| 2002/0077008 A1 | | 6/2002 | Koyano et al. | |

* cited by examiner

*Primary Examiner*—Jesus D. Sotelo
(74) *Attorney, Agent, or Firm*—Knobbe, Martens, Olson & Bear LLP

(57) ABSTRACT

A jet propulsion unit for a small watercraft including a reverse thrust arrangement. The reverse thrust arrangement includes a water diverter bucket assembly moveable between an open position and a closed position with respect to a steering nozzle of the jet propulsion unit. The reverse thrust arrangement is configured to reduce an amount of operator force necessary to actuate movement of the water diverter bucket assembly between its opened and closed position. In some arrangements, the reverse thrust arrangement permits movement of the water diverter bucket assembly from its open to its closed position and control of an operating speed of the engine once the bucket assembly has reached its closed position by a single operator control.

43 Claims, 35 Drawing Sheets

REVERSE THRUST ARRANGEMENT FOR SMALL WATERCRAFT

PRIORITY INFORMATION

The present application is based upon, and claims priority to, Japanese Patent Application Nos. 2001-325819, filed Oct. 24, 2001, 2001-344174, filed Nov. 9, 2001, 2001-339848, filed Nov. 5, 2001, and 2001-339849, filed Nov. 5, 2001, the entire contents of all of which are hereby incorporated by reference.

BACKGROUND OF THE INVENTION

1. Field of the Invention

The present invention relates to a jet propulsion unit for a watercraft, and more particularly, to a reverse thrust arrangement for a small watercraft.

2. Description of the Related Art

Personal watercraft have become very popular in recent years. This type of watercraft is quite sporting in nature and carries a rider and possibly one or more passengers. A relatively small hull of the watercraft commonly defines a rider's area above an engine compartment. An internal combustion engine is commonly used to power a jet propulsion unit which propels the watercraft. The engine lies within the engine compartment in front of a tunnel formed on the underside of the watercraft hull. The jet propulsion unit is located within the tunnel and is driven by an output shaft of the engine. An impeller shaft of the jet propulsion unit extends forward, through a wall of the hull tunnel, and is coupled to the engine output shaft. In this manner, the engine drives the jet propulsion unit.

The jet propulsion unit conventionally includes an impeller housing in which an impeller is contained. The impeller, which is driven by the engine through the impeller shaft, draws water through a water inlet and forces it through a discharge nozzle to propel the watercraft. A steering nozzle usually is mounted on the discharge nozzle for pivotal movement about a vertical axis. Pivotal movement of the steering nozzle about the vertical steering axis alters a discharge direction of the water jet to steer the watercraft.

Many personal watercraft also include a water reverse thrust deflector or "reverse bucket" for redirecting the jet forwardly, thereby producing a reverse thrust. The reverse thrust deflector is usually supported about the end of the jet propulsion unit to move pivotally between a raised position, in which the deflector does not affect the water jet issuing from the steering nozzle, and a fully lowered position, in which the deflector cooperates with the steering nozzle and redirects water issuing from the jet propulsion unit forwardly to achieve the reverse thrust.

The position of the reverse thrust deflector is usually controlled through an actuator accessible to the operator of the watercraft. A control arrangement couples the reverse thrust deflector for movement with the actuator. Common control arrangements include a mechanical cable, or bowden-wire, or an electronic arrangement. A mechanical arrangement typically requires a large amount of force to move the actuator and thus move the reverse thrust deflector between the raised and the fully lowered position. Because the operator must also control the throttle at the same time, such an arrangement makes the operation of the reverse mechanism more difficult. An electronic arrangement reduces the effort required by the operator, but increases the manufacturing cost and reduces reliability of the watercraft.

SUMMARY OF THE INVENTION

A need therefore exists for a watercraft reverse thrust arrangement that provides for precise steering movements during reversal of the watercraft. Preferably, such an arrangement reduces the effort required by the operator to move the reverse thrust deflector between the raised position and the fully lowered position and is relatively inexpensive to manufacture.

In accordance with one aspect of one embodiment of an invention disclosed herein, a watercraft comprises a hull, the hull defining an engine compartment, and an engine disposed within the engine compartment. A jet propulsion unit is driven by the engine, the jet propulsion unit comprising a discharge nozzle configured to direct a water jet in a generally rearward direction. A water diverter bucket assembly is mounted near the discharge nozzle and movable between an opened position and a closed position wherein the bucket assembly at least partially redirects the water jet. A control assembly is provided for moving the bucket assembly between the opened and closed position. The control assembly comprises an electric motor, an actuator configured to operate the electric motor, and a cable clutch mechanism. The cable clutch mechanism comprises at least one spool driven by the electric motor. At least one operation cable is wound around the at least one spool and includes a first end and a second end. The first end is coupled to the actuator and the second end is coupled to the bucket assembly. The movement of the actuator moves the first end of the operation cable and activates the electric motor. The at least one operation cable frictionally engages the spool to move the second end of the operation cable and thereby move the bucket assembly toward one of the open and closed positions.

In accordance with another aspect of an embodiment of an invention disclosed herein, a watercraft comprises a hull and an engine supported by the hull. A jet propulsion unit is driven by the engine. The jet propulsion unit comprises a discharge nozzle configured to direct a water jet in a generally rearward direction. A water diverter bucket assembly is mounted near the discharge nozzle and is movable between an open position and a closed position in which the bucket assembly at least partially redirects the water jet. A control assembly is configured to move the bucket assembly between the first and second positions. The control assembly comprises an electric motor, an actuator configured to operate the electric motor, and a cable clutch mechanism. The cable clutch mechanism comprises a first spool and a second spool driven by the electric motor. The first spool is driven in a first direction and the second spool is driven in a second direction opposite the first direction. A first operation cable is wound around the first spool and includes a first end and a second end. A second operation cable is wound around the second spool and includes a first end and a second end. An input arm is coupled to the actuator, and an output arm is coupled to the bucket assembly. The first ends of the first and second operation cables are connected to the input arm and the second ends of the first and second operation cables are connected to the output arm. Movement of the input arm in a first direction causes the first operation cable to frictionally engage the first spool and move the output arm in a first direction thereby moving the deflector assembly toward the open position. Movement of the input arm in a second direction causes the second operation cable to frictionally engage the second spool and move the output arm in a second direction thereby moving the deflector assembly toward the closed position.

In accordance with a further aspect of an embodiment of an invention disclosed herein, a watercraft comprises a hull, an engine supported by the hull, the engine comprising a power output control device configured to influence a power output of the engine, a jet propulsion unit driven by the engine. The jet propulsion unit comprises a discharge nozzle configured to direct a stream of pressurized water in a generally rearward direction. A water diverter bucket assembly is mounted near the discharge nozzle and movable between an open position and a closed position in which the water diverter bucket assembly at least partially redirects the stream of pressurized water. A reverse cable is configured to move the deflector assembly between the open position and the closed position. A secondary control actuator is coupled to the reverse cable and is connected to the power output control device. The secondary control actuator is configured to adjust the power output control device to increase the power output of the engine after the water diverter bucket assembly reaches the second position.

In accordance with yet another aspect of an embodiment of an invention disclosed herein, a watercraft comprises a hull and an engine is supported by the hull. A jet propulsion unit is driven by the engine. The jet propulsion unit comprises a discharge nozzle configured to direct a water jet in a generally rearward direction. The hull includes at least one inlet, at least one outlet, and at least one secondary flow passage connecting the at least one inlet to the at least one outlet. A water diverter bucket assembly is mounted near the discharge nozzle and is movable between a first position and a second position in which the bucket assembly redirects at least a portion of the water jet toward the at least one inlet. At least one lid member is associated with the at least one outlet and movable between an open position and a closed position.

In accordance with an additional aspect of an embodiment of an invention disclosed herein, a watercraft comprises a hull. An engine is supported by the hull. A jet propulsion unit is driven by the engine. The jet propulsion unit comprises a discharge nozzle configured to direct a water jet in a generally rearward direction. A steering nozzle is positioned rearwardly of the discharge nozzle and pivots about a generally vertical axis. A water diverter bucket assembly is mounted near the steering nozzle and is movable between an opened position and a closed position in which the bucket assembly at least partially redirects the water jet. The bucket assembly comprises a pair of bucket members positioned on opposing sides of the steering nozzle and being pivotal about a substantially vertical axis. Each bucket member comprises a main body portion and a flap member.

For purposes of summarizing the invention, certain aspects, advantages and novel features of the invention have been described herein above. Of course, it is to be understood that not necessarily all advantages disclosed or taught herein may be achieved in accordance with any particular embodiment of the invention. Thus, the invention may be embodied or carried out in a manner that achieves or optimizes one advantage or group of advantages as disclosed or taught herein without necessarily achieving other advantages as may be disclosed, taught or suggested herein.

All of these aspects are intended to be within the scope of the invention herein disclosed. These aspects of the invention, as well as others, will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

The above-mentioned and other features of the invention will now be described with reference to the drawings of the preferred embodiments of the present reverse thrust arrangement in the context of a personal watercraft. The illustrated embodiments of the reverse thrust arrangement are intended to illustrate, but not to limit, the invention. The drawings contain the following figures:

FIG. 19 also shows the control arrangement when the bucket assembly is in the open position.

FIG. 25 also illustrates a pair of secondary discharge assemblies, each of the secondary discharge assemblies being disposed on one side of the hull of the watercraft.

In FIG. 44, upper wall portions of the deflector members are partially removed to show a redirection of a portion of a water jet issued from the steering nozzle by the reverse thrust deflector assembly.

DETAILED DESCRIPTION OF THE PREFERRED EMBODIMENT

Figure 1:
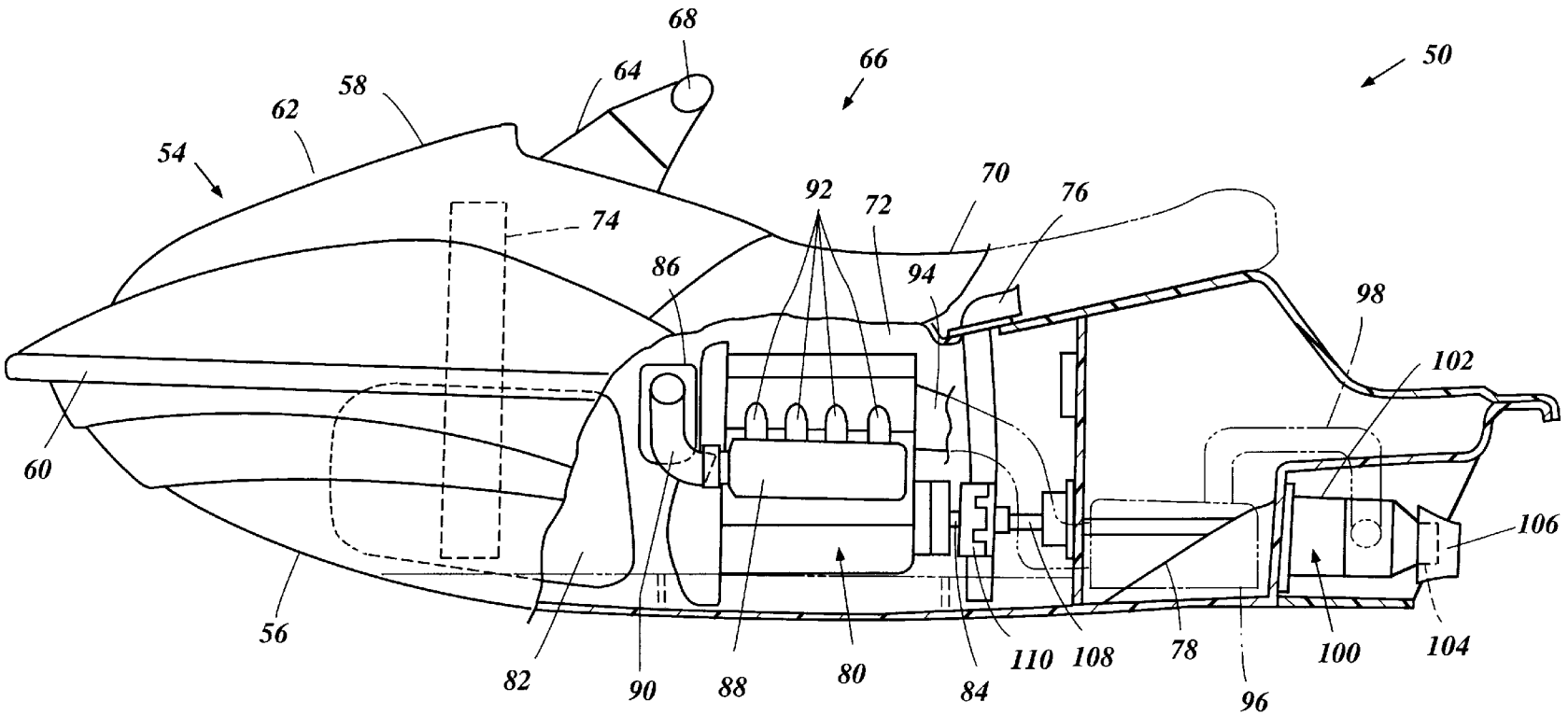
FIG. 1 is a side elevational and partial cut-away view of a small watercraft, having a jet propulsion unit including a reverse thrust arrangement configured in accordance with a preferred embodiment of the present invention, with several internal components of the watercraft, including a jet propulsion unit and engine, shown.

FIG. 1 illustrates a personal watercraft 50 which includes a reverse thrust arrangement 52 (FIG. 2) configured in accordance with a preferred embodiment of the present invention. Although the present reverse thrust arrangement 52 is illustrated in connection with a personal watercraft, the reverse thrust arrangement 52 can be used with other types of watercraft as well, such as, for example, but without limitation, small jet boats and the like. Initially, an exemplary personal watercraft 50 is described below in general detail to assist the reader's understanding of the environment of use in the operation of the reverse thrust arrangement 52.

With reference to FIG. 1, the small watercraft 50 includes a hull 54 formed by a lower hull section 56 in an upper deck section 58. The hull sections 56, 58 are formed from a suitable material such as, for example, a molded fiberglass reinforced resin. The lower hull section 56 and the upper deck section 58 are affixed to each other around the peripheral edges 60 in any suitable manner.

As viewed in the direction from the bow to the stern of the watercraft 50, the upper deck section 58 includes a bow portion 62, a control mast 64, and a rider's area 66. The control mast 64 extends upward from the bow portion 62 and supports a handlebar assembly 68. The handlebar 68 controls the steering of the watercraft 50. The handlebar assembly 68 also carries a variety of controls of the watercraft 50, such as, for example, a throttle control, a start switch, and additional controls described in more detail below.

The rider's area 66 lies behind the control mast 64 and includes a seat assembly 70. In the illustrated embodiment, the seat assembly 70 has a longitudinally extending straddle-type shape that may be straddled by an operator and by at least one or more passengers. Preferably, a pair of foot areas (not shown) extend generally longitudinally and parallel to the sides of the seat assembly 70. The lower hull portion 56 cooperates with the upper deck portion 58 to define the engine compartment 72 of the watercraft 50. Preferably, at least a forward air duct 74 and a rearward air duct 76 communicate with the engine compartment 72 to permit air to move into, and exit from, the engine compartment 72. Optionally, the watercraft 50 can include additional air ducts. Except for all of the included air ducts (74, 76 in the illustrated embodiment) the engine compartment 72 is normally substantially sealed so as to enclose an engine of the watercraft 50 from the body of water in which in the watercraft is operated.

The lower hull 56 is designed such that the watercraft 50 planes or rides on a minimum surface area at the aft end of the lower hull 56 in order to optimize the speed and handling of the watercraft 50 when up on plane. For this purpose, the lower hull section 56 generally has a V-shaped configuration formed by a pair of inclined sections that extend outwardly from a keel line of the hull to the hull's side walls at dead-rise angle.

The inclined sections also extend longitudinally from the bow toward the transom of the lower hull 56. The side walls are generally flat and straight near the stern of the lower hull 56 and smoothly blend toward the longitudinal center of the watercraft 50 at the bow 62. The lines of intersection between each inclined section and the corresponding sidewall form the outer chines of the lower hull 56.

Near the transom of the watercraft 50, the inclined sections of the lower hull 56 extend outwardly from a recessed channel, or tunnel 78, that extends upward toward the upper deck portion 58. The tunnel 78 has a generally parallelpiped shape and opens through the rear of the transom of the watercraft 50.

An internal combustion engine 80 powers the watercraft 50. The engine 80 is positioned within the engine compartment 72 and is mounted primarily beneath the seat assembly 70. Preferably, vibration absorbing engine mounts secure the engine 80 to the lower hull portion 56 in a known manner. Optionally, the engine mounts can be supported by a liner (not shown) disposed in the engine compartment 72. The engine 80 is mounted in approximately a central position of the watercraft 50.

A fuel tank 82 is disposed within the engine compartment 72 and stores fuel for the engine 80. Preferably, the fuel tank 82 is positioned on a forward side of the engine 80.

A cylinder block and cylinder head assembly desirably form the cylinders of the engine 80. A piston reciprocates within each cylinder of the engine 80 and together the pistons drive an output shaft 84. A connecting rod links the corresponding piston to a crankshaft of the engine, which in time is drivingly connected to the output shaft by a coupling. The corresponding cylinder bore, piston and cylinder head of each cylinder forms a variable volume chamber, which at a minimum volume defines a combustion chamber.

The crankshaft desirably is journaled within a crankcase that, in one variation, is formed between a crankcase member and a lower end of the cylinder block. Where the engine 80 is a two-stroke engine, individual crankcase chambers of the engine 80 are formed within the crankcase by dividing walls and sealing disks, and are sealed from one another with each crankcase chamber communicating with a dedicated variable volume chamber.

The engine 80 includes an air induction system to provide air to the combustion chambers of the engine 80. An intake silencer 86 is connected to a plenum chamber 88 through a conduit 90. The plenum chamber 88 communicates with the combustion chambers through a plurality of intake passages 92. Desirably, each combustion chamber of the engine communicates with the plenum chamber 88 through a dedicated intake passage 92.

The engine 80 also includes a power request system for allowing an operator to input a power request. The power request system receives the request and controls the engine to provide a power output based on the request. For example, the induction system can include a system for controlling an amount of air flowing into the engine 80.

Many known systems exist for controlling the amount of induction sir flowing into an engine. For example, the induction system can include a throttle body assembly having a throttle valve configured to control or "meter" an amount of air flowing through the induction system into the engine 80. Optionally, where the engine 80 operates on a four-stroke principle, the engine 80 can include variable intake valve timing and/or duration. Such valves can work in cooperation with a throttle body assembly to control an amount of air flowing into the engine. Alternatively, such a valve system can be configured to control the air amount without a throttle body. Such systems can receive a power request input from the operator through direct mechanical connection, or through electronic communication.

The engine 80 also includes an exhaust system to transfer exhaust gases from the combustion chambers to a location outside of the engine compartment 72. Preferably, the exhaust gases are released into the body of water in which the watercraft 50 is operating. An exhaust passage 94 communicates with each combustion chamber and extends toward a rearward end of the watercraft 50 and terminates in a water trap 96. An exhaust pipe 98 extends from the water trap 96 and, preferably, opens into the jet propulsion unit of the watercraft 50. The water trap 96 inhibits water from moving upstream from the exhaust pipe 98 to the exhaust passage 94 and, thus, inhibits water from entering the combustion chambers of the engine.

Those skilled in the art will readily appreciate that the present reverse thrust arrangement can be used with any of a variety of engine types, such as those that operate on two-cycle, four-cycle, diesel or rotary combustion principles, as well as electric motors, etc. Additionally, the engines may have varying number of cylinders and varying cylinder arrangements, such as an inline, V-type or W-type arrangement.

A charge former (e.g., a carburetor or fuel injector) of the induction system communicates with an inlet end of the intake passage 92. The charge former receives fuel from the fuel tank 82 and produces the fuel charge which is delivered to the cylinders in a known manner. Because additional internal details of the engine 80 and the induction and exhaust systems desirably are conventional, a further description of the engine construction is not believed necessary to understand and practice the invention.

A jet propulsion unit 100 propels the watercraft 50. The jet propulsion unit 100 is mounted within the tunnel 78 formed on the underside of the lower hull section 56. An intake duct of the jet propulsion unit 100 defines an inlet opening that permits water to enter the jet propulsion unit 100. The inlet opening opens into a gullet which leads to an impeller housing assembly 102 in which the impeller of the jet propulsion unit 100 rotates.

The impeller housing assembly 102 also acts a pressurization chamber and delivers a water flow from the impeller housing to a discharge nozzle 104. A steering nozzle 106 is supported at the downstream end of the discharge nozzle 104 for rotation about a vertical axis.

In an exemplary embodiment, the steering nozzle 106 is coupled to the handlebar assembly 68, through, for example, a bowden-wire actuator, as is known in the art. In this manner, the operator of the watercraft 50 can move the steering nozzle 106 to effect directional changes of the watercraft 50.

An impeller shaft 108 supports the impeller within the impeller housing assembly 102 of the jet propulsion unit 100. The impeller shaft 108 extends in a forward direction through a front wall of the tunnel 78. The front end of the impeller shaft 108 is coupled to the output shaft 84 of the engine 80 through a coupling 110. In this manner, the engine 80 drives the propulsion unit 100. It is to be noted that the impeller shaft 108 can be formed with a single shaft, or from a plurality of shafts rotatably connected together.

Figure 2:
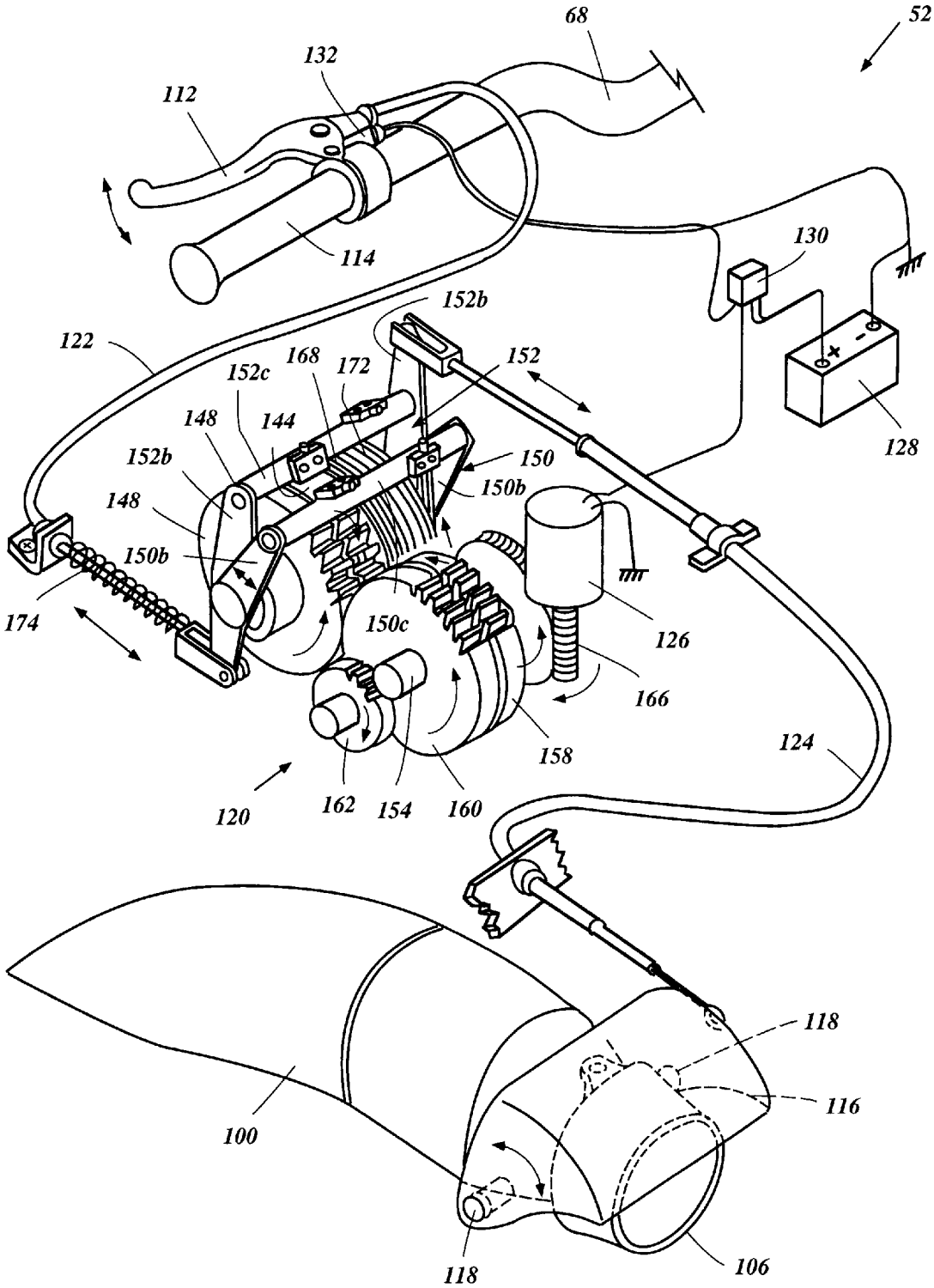
FIG. 2 is a partial schematic view of a control arrangement of the reverse thrust arrangement, which is operable to move a water diverter bucket assembly between an opened position and a closed position. The control assembly includes a cable clutch mechanism.

As illustrated in FIG. 2, a secondary control lever 112 is disposed on the left-hand side of the handlebar assembly 68 adjacent a handgrip 114 and is configured to be actuated by the left-hand of an operator of the watercraft 50. A water diverter bucket assembly, or thrust bucket 116, is pivotally supported on a pair of pins 118 adjacent the steering nozzle 106 of the jet propulsion unit 100. In the illustrated embodiment, the bucket assembly is movable between an open position, wherein the thrust bucket 116 does not substantially interfere with a water jet issuing from the steering nozzle 106, to a fully closed position, wherein the thrust bucket 116 redirects at least a portion of the water jet issuing from the steering nozzle 106, preferably in a forward direction to produce a reverse thrust.

In the illustrated embodiment, the thrust bucket 116 comprises a single member which is pivotal about a horizontal axis to move from a raised position to a lowered position. However, other reverse thrust bucket arrangement are also possible, such as a pair of thrust bucket members supported on each side of the steering nozzle 106 mounted to pivot about a vertical axis from an open position to a closed position, as is described in greater detail below.

A secondary control actuator, such as a lever 112, is configured to move the reverse thrust bucket 116 between the open and closed position through a cable clutch mechanism 120. However, other suitable actuators are also possible, such as a foot pedal, for example.

In the illustrated embodiment, an input actuator cable 122 extends between the secondary control lever 112 and the cable clutch mechanism 120. An output cable 124 extends between the cable clutch mechanism 120 and the reverse thrust bucket 116. Although the illustrated input and output cables 122, 124 comprise bowden-wire type cables having an inner cable movable within an outer housing, other suitable connections can also be used.

Figure 3:
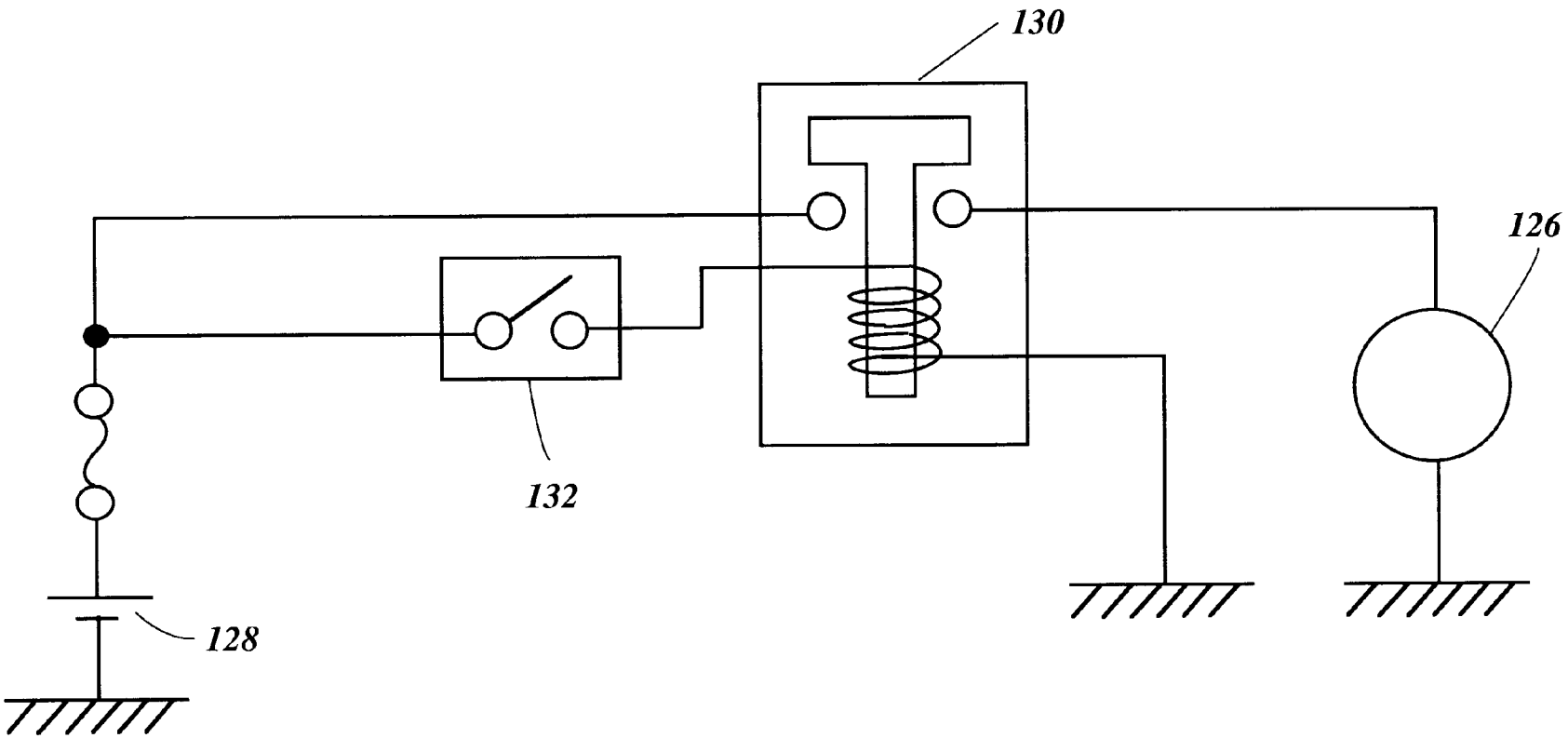
FIG. 3 is a schematic illustration of a portion of the control arrangement of FIG. 2, including a relay interposed between a power source and an electric motor.

With additional reference to FIG. 3, the reverse thrust arrangement 52 additionally comprises an electric motor 126 drivingly coupled to the cable clutch mechanism 120. A power source, such as a battery 128, is connected to the motor 126 through a relay 130. A switch 132 is configured to actuate the relay 130 and, thereby, provide power to the motor 126. The switch 132 is configured to be actuated by the secondary control lever 112. Thus, squeezing motion of the secondary control lever 112 operates to apply a pulling force to the input cable 122 and also closes the switch 132 to activate the motor 126.

With additional reference to FIGS. 4–8, the cable clutch mechanism 120 is described in greater detail. The cable clutch mechanism 120 includes a body portion, or gear box 134, which generally provides support for the various components of the cable clutch mechanism 120.

A hollow, main shaft 136 is rotatably supported by the gear box 134 through a pair of bearing assemblies 138. A first, or normal spool member 140, is rotatably supported on the main shaft 136. One or more wear members, such as bushings 142, are interposed between the normal spool 140 and the main shaft 136.

The normal spool 140 includes a gear portion 144 having gear teeth formed on its outer periphery. Although the normal spool 140 and the normal spool gear 144 are illustrated as a unitary piece, they may be formed of separate pieces coupled together.

A second, or reverse spool 146, is fixed for rotation with the main shaft 136. In addition, a reverse spool gear 148 is also affixed for rotation with the main shaft 136.

The cable clutch mechanism 120 also includes an input member 150 and an output member 152 rotatably supported by the gear box 134. The input member 150 includes a shaft portion 150*a* (FIG. 4), a pair of arm portions 150*b* at each end of the shaft portion 150*a*. An inner connecting portion 150*c* (FIGS. 2 and 6) extends between the outer ends of the arm portions 150*b*.

The output arm 152 includes a shaft portion 152*a*, a pair of arm portions 152*b*, and a connecting portion 152*c* extending between the outer ends of the arm portions 152*b*. The shaft portions 150*a*, 152*a* of the input and output members 150, 152 are coaxially arranged within the hollow main shaft 136. The shaft portion 152*a* of the output member 152 is hollow and the shaft portion 150*a* of the input member 150 is arranged coaxially within the shaft portion 152*a* of the output member 152. Preferably, wear members, such as bushings 142, are interposed between the main shaft 136 and the output member 152 and the output member 152 and the input member 150.

A driveshaft 154 is rotatably supported by the gear box 134 through a pair of bearing assemblies 156, adjacent to the shafts 136, 150, 152. A normal drive gear 158 and a reverse drive gear 160 are fixedly mounted on the driveshaft 154 for rotation therewith. Gear teeth of the normal drive gear 158 intermesh with gear teeth of the normal spool gear 144 to drive the normal spool 140 in a first direction. The reverse drive gear 160 drives the reverse spool gear 148 through an idler gear 162 (FIG. 2) to drive the reverse spool 146 in a direction opposite of the normal spool 140.

An input gear 164 is supported on an end of the drive shaft 154 and external of the gear box 134. The input gear 164 is configured to be driven by a worm gear 166 of the motor 126. Accordingly, when the motor 126 is activated, the worm gear 166 drives the input gear 164 which, in turn drives the normal drive gear 158 and the reverse drive gear 160. The normal drive gear 158 drives the normal spool gear 144, and the normal spool 140, in a first direction. The reverse drive gear 160 drives the reverse spool gear 148 through the idler gear 162 to drive the reverse spool 146 in a direction opposite of the normal spool 140.

Figure 6:
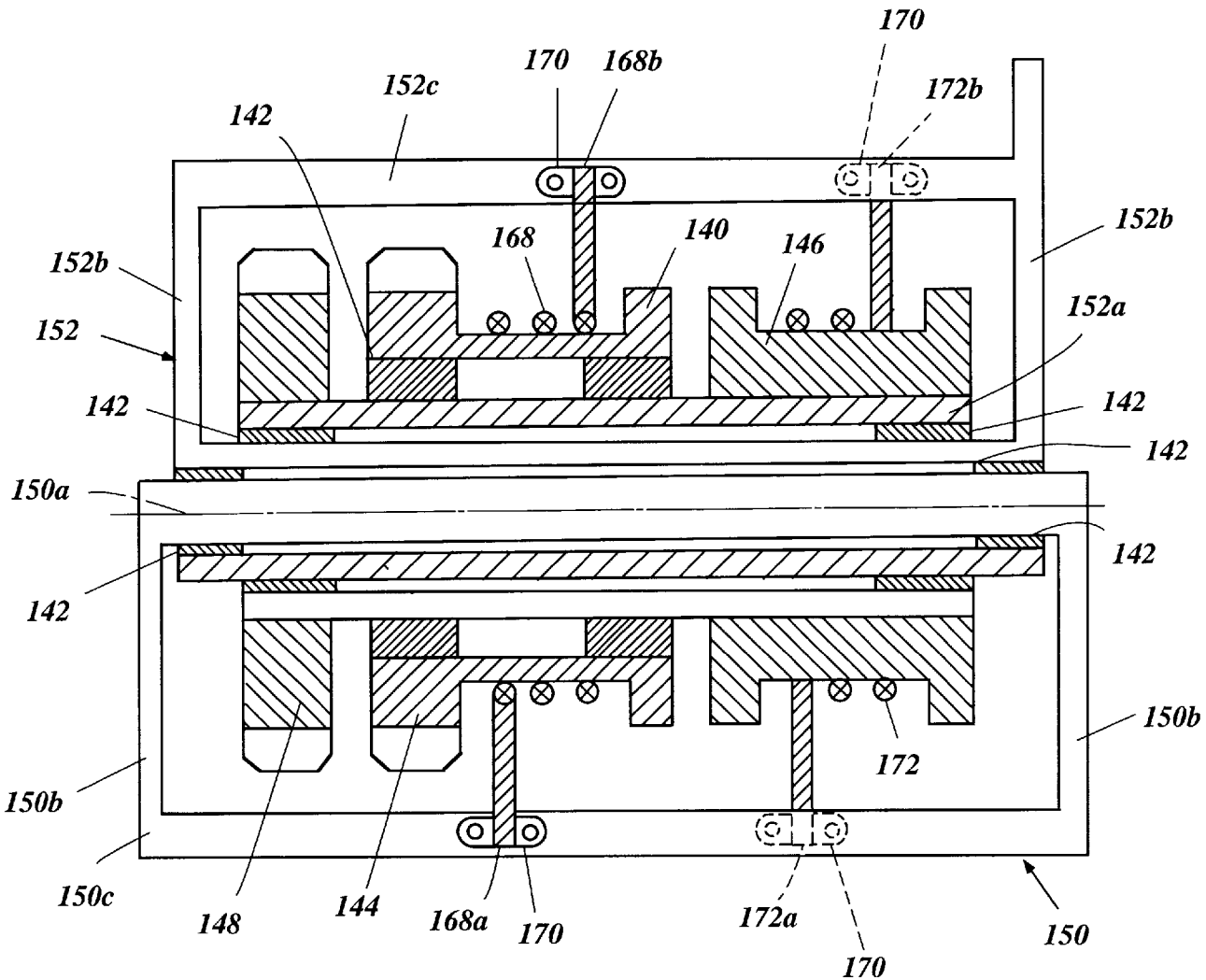
FIG. 6 is a schematic and partial cross-sectional view of the cable clutch mechanism illustrating a connection of a normal spool cable and a reverse spool cable of the clutch mechanism to the input and output members.
Figure 7:
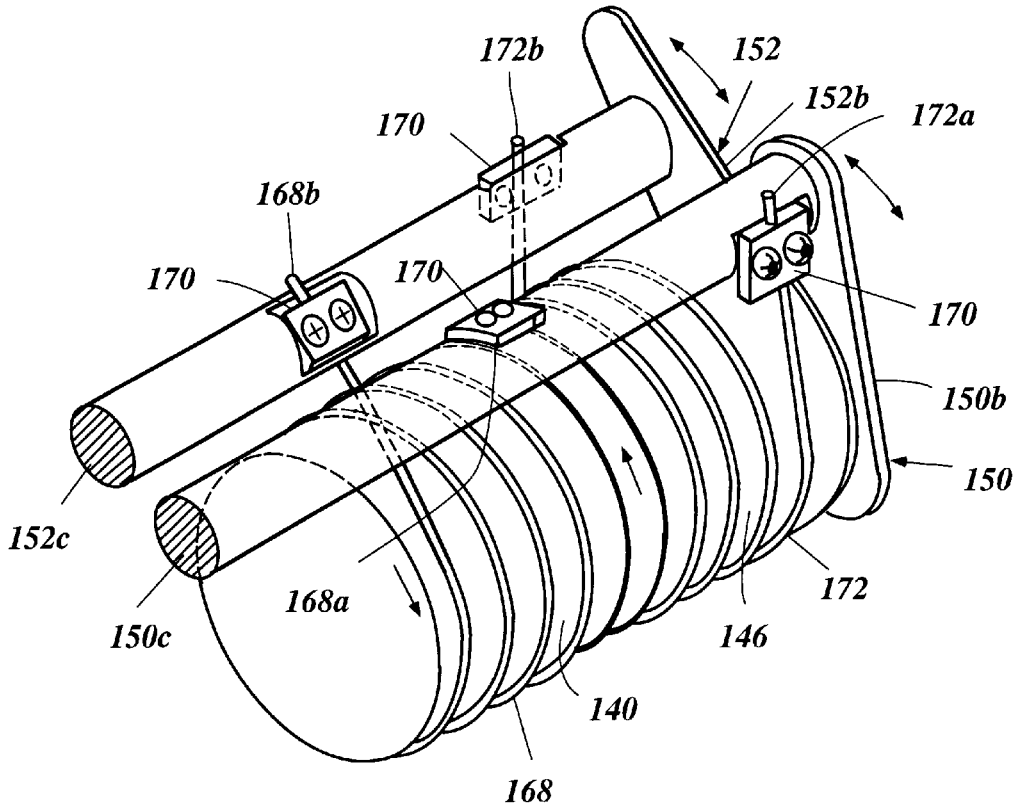
FIG. 7 is a perspective view of the cable clutch mechanism illustrating relative rotation of the normal and reverse spools and the connection of normal and reverse cables to the input and output members.
Figure 8A:
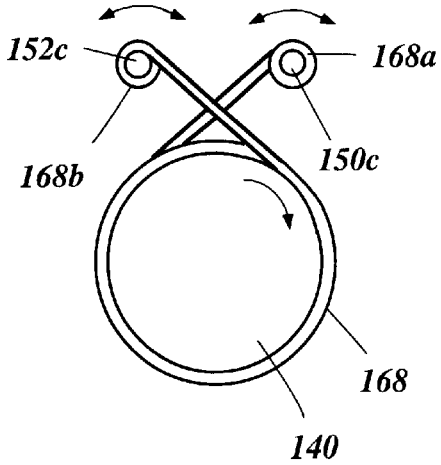
FIG. 8*a* is a schematic illustration showing the configuration of the normal cable of the cable clutch mechanism.

A first or normal, spool cable 168, is wound around the normal spool 140. A first end 168*a* of the normal spool cable 168 is fixed to the input member 150 through a connector 170 (FIGS. 6 and 7). A second end 168*b* of the normal spool cable 168 is fixed to the output member 152 by another connector 170. With reference to FIG. 8*a*, the normal spool cable 168 is arranged such that the first and second ends 168*a*, 168*b* cross one another between the spool 140 and the respective one of the input and output members 150, 152.

Figure 8B:
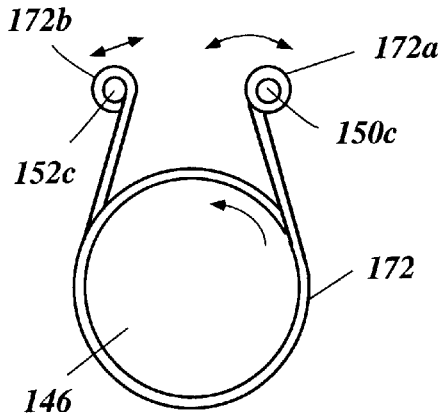
FIG. 8*b* is a schematic illustration showing the configuration of the reverse cable of the cable clutch mechanism.

In a similar manner, a reverse spool cable 172 is wound around the reverse spool and has a first end 172*a* fixed to the input member 150 and a second end 172*b* fixed to the output member 152. With reference to FIG. 8*b*, the ends 172*a*, 172*b* of the reverse spool cable 170 are substantially parallel to one another from the spool 146 to the respective one of the input and output members 150, 152. With such an arrangement, when the input member 150 and the output member move away from one another, the normal spool cable 168 is tightened such that it frictionally engages the normal spool 140. When the input member 150 and the output member 152 move away from each other, the reverse spool cable 172 is loosened from the reverse spool 146.

Conversely, when the input member 150 is moved toward the output member 152, the reverse spool cable 172 is tightened to frictionally engage the reverse spool 146. In this position, the normal spool cable 168 is loosened from the normal spool 140.

Figure 4:
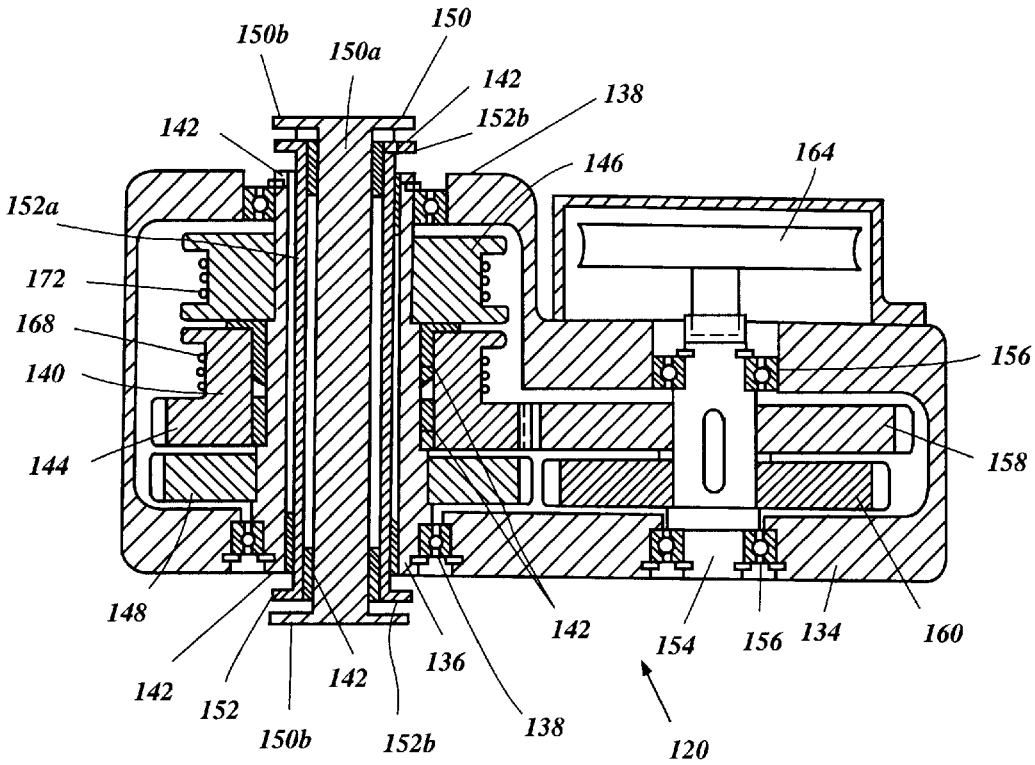
FIG. 4 is a cross-sectional view of the cable clutch mechanism of FIG. 2.

With reference primarily to FIGS. 2 and 4, the input actuation cable 122 is connected to a lower end of the arm portion 150*b* of the input member 150. Thus, squeezing motion of the secondary control lever 112 rotates the input member 150 in a clockwise direction, i.e., away from the output member 152. A return spring 174 biases the input member 150 in a counterclockwise direction, i.e., toward the output member 152. The output cable 124 is connected between an upper end of the arm portion 152*b* of the output member and the reverse thrust bucket 116.

In operation, an operator of the watercraft 50 exerts a squeezing force on the secondary control lever 112 to move the control lever toward the handgrip 114. The control lever activates the switch 132 which activates the relay 130 to deliver power to the motor 126. At the same time, a pulling force is exerted on the input cable 122 to move the input member 150 in a clockwise direction about its pivot axis 176. As a result, the normal spool cable 168 is tightened to the normal spool 140 and, thus, the output member 152 is rotated by the spool 140 due to the frictional force acting on the normal spool cable 168. Accordingly, the output member 152 moves the output cable 124 to move the thrust bucket 116 toward its closed, or lowered position. Thus, the cable clutch mechanism 120 operates as a force increasing mechanism such that the bucket assembly 116 may be moved by the secondary control lever 112 with a relatively small amount of force.

Conversely, when an operator of the watercraft 50 releases the secondary control lever 112, allowing it to move away from the handgrip 114, the return spring 174 urges the input member 150 in a counterclockwise direction about its pivot axis 176 and thereby tightens the reverse spool cable 172 about the reverse spool 146. As a result, the output member 152 moves in a counterclockwise direction due to the frictional force developed between the reverse spool 146 and the reverse spool cable 172. Thus, the reverse thrust bucket 116 is moved toward the open position, simultaneously as the lever 112 moves away from the handgrip 114.

Figure 5:
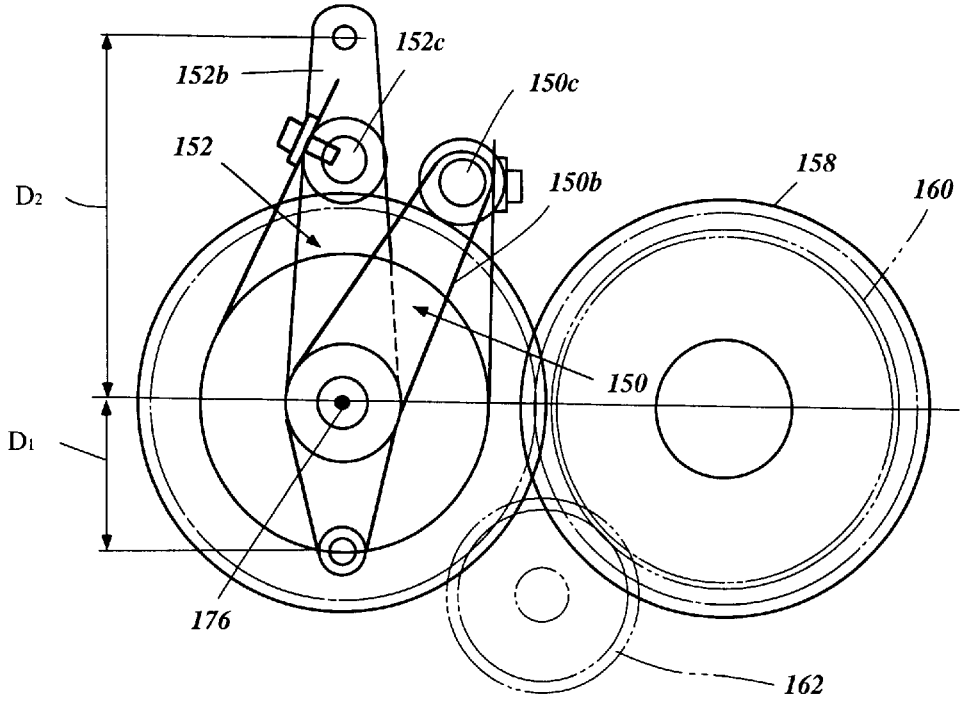
FIG. 5 is a schematic, elevational view of the cable clutch mechanism of FIG. 2 illustrating a normal spool, a reverse spool, an input member, and an output member of the cable clutch mechanism.

As illustrated in FIG. 5, desirably, the input cable 122 is fixed to the input member at a first distance D1 from the pivot axis 176 and the output cable 124 is fixed to the output member 152 at a second distance D2. Desirably, the distance D2 is greater than the distance D1 and, therefore, the cable clutch mechanism 120 also acts as a stroke increasing mechanism. The distances D1 and D2 may be configured relative to one another such that the movement necessary to move the bucket assembly 116 between the open and closed position may be accomplished with the movement available to the lever 112, or other operator actuation arrangement.

Figure 9:
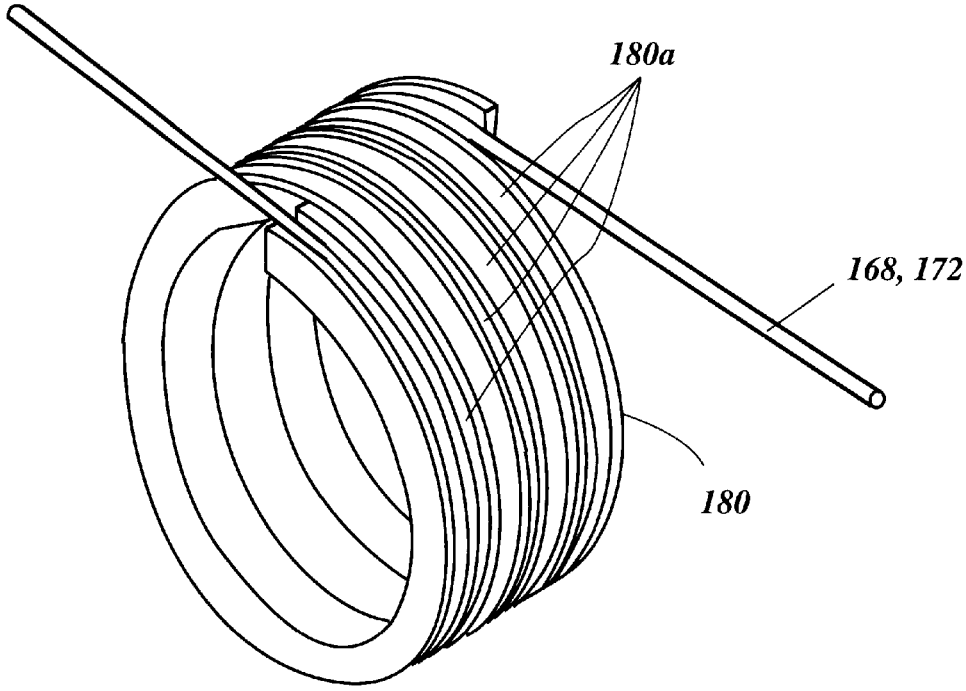
FIG. 9 is a perspective view of a wear resistant arrangement of the cable clutch mechanism including a slip member, which may be positioned between the cables and the spools of the cable clutch mechanism of FIG. 2.
Figure 10:
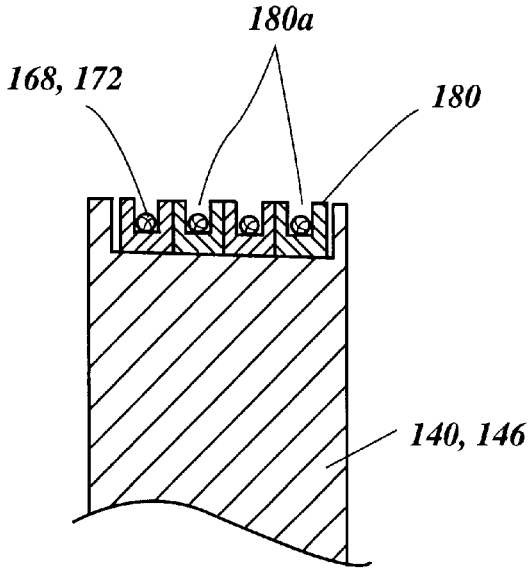
FIG. 10 is a cross-sectional view of the slip member arrangement of FIG. 9.

FIGS. 9 and 10 illustrate a preferred arrangement for reducing wear of the spools 140, 146 and/or the spool cables 168, 172. Preferably, a slip member 180 is interposed between the cables 168, 172 and the spools 140, 146. The slip member 180 is substantially helical in shape and includes a channel 180*a* which receives the spool cable 168, 172.

Preferably, the slip member 180 is constructed from a plastic material, such as nylon or polyacetal resin. Thus, when the cables 168, 172 are loosely retained about the spool 140, 146, the slip member 180 inhibits wear of the spool 140, 146. However, when the cables 168, 172 are tightened, the slip member 180 frictionally engages the spool 140, 146 to rotate the cable 168, 172 along with the spool 140, 146.

Figure 11:
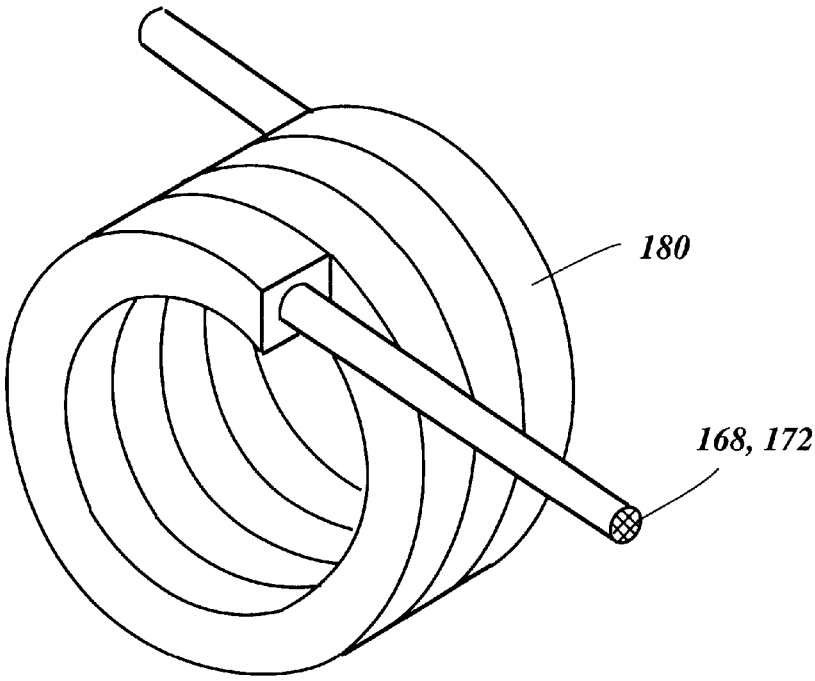
FIG. 11 is a perspective view of an alternative wear resistant arrangement wherein a wear resistant material is disposed on the cables of the cable clutch arrangement.
Figure 12:
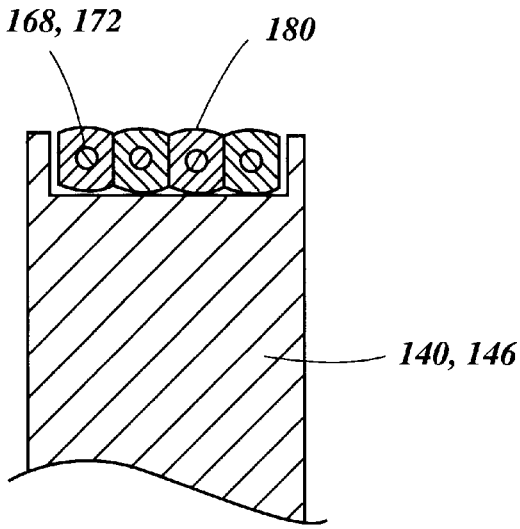
FIG. 12 is a cross-sectional view of the wear resistant arrangement of FIG. 11.

FIGS. 11 and 12 illustrate a modification of the arrangement of FIGS. 9 and 10. In FIGS. 11 and 12, the slip member 180 is integrally formed with the cables 168, 172. In this arrangement, the plastic material comprising the slip member 180 may be molded around the cables 168, 172.

Figure 13:
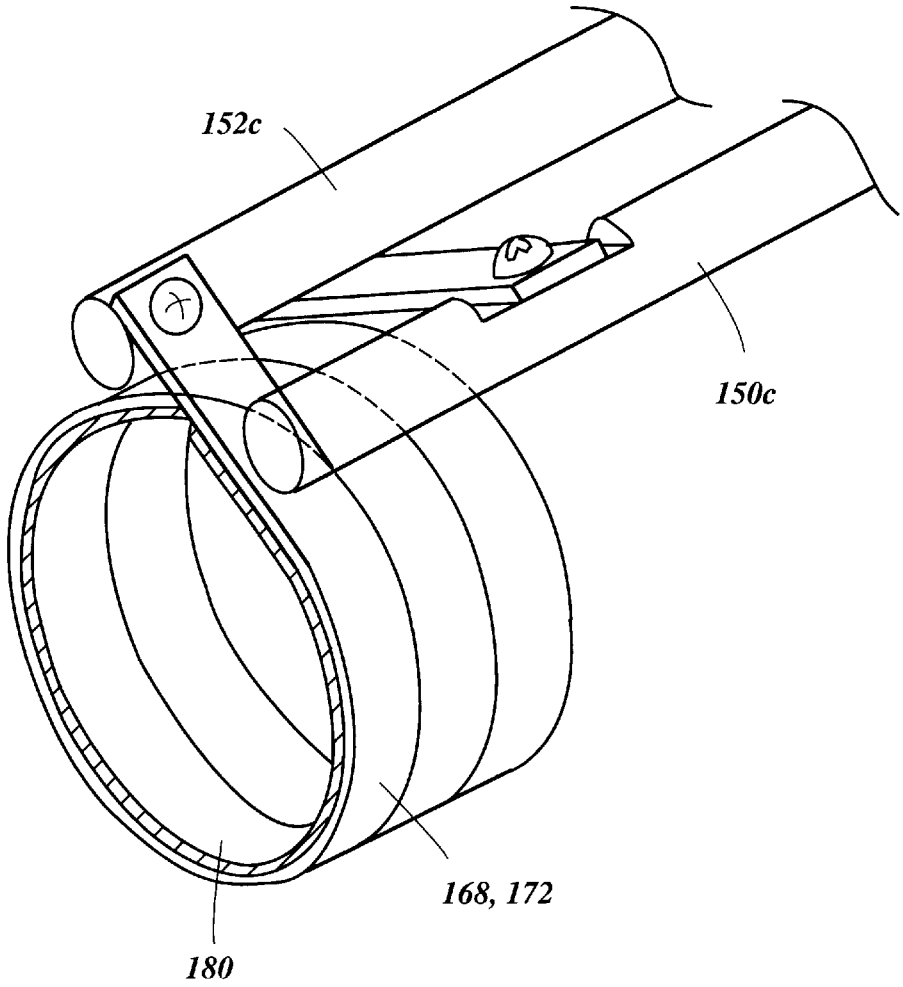
FIG. 13 is a perspective view of yet another alternative wear resistant arrangement wherein the cable comprises an elongated, flat ribbon of material and the wear resistant material is coated on the side of the ribbon facing the spool.
Figure 14:
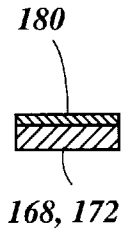
FIG. 14 is a cross-sectional view of the wear resistant elongated ribbon and wear resistant material of FIG. 13.

FIGS. 13 and 14 illustrate yet another modification of the spool cables 168, 172. In this arrangement, the spool cables 168, 172 are comprised of an elongated piece of material, which is substantially rectangular in cross-section. Preferably, the cables 168, 172 are a metallic, helical ribbon-type configuration arranged such that the wide surface of the rectangular cross-section is facing the spool 140, 146. In this embodiment, the slip member 180 is molded to the inner surface of the helical spool cable 168, 172. Alternatively, the slip member 180 may comprise a friction material, such as those commonly used on brake shoes, or brake pads, for vehicle brakes, such as automotive brakes, for example.

Figure 15:
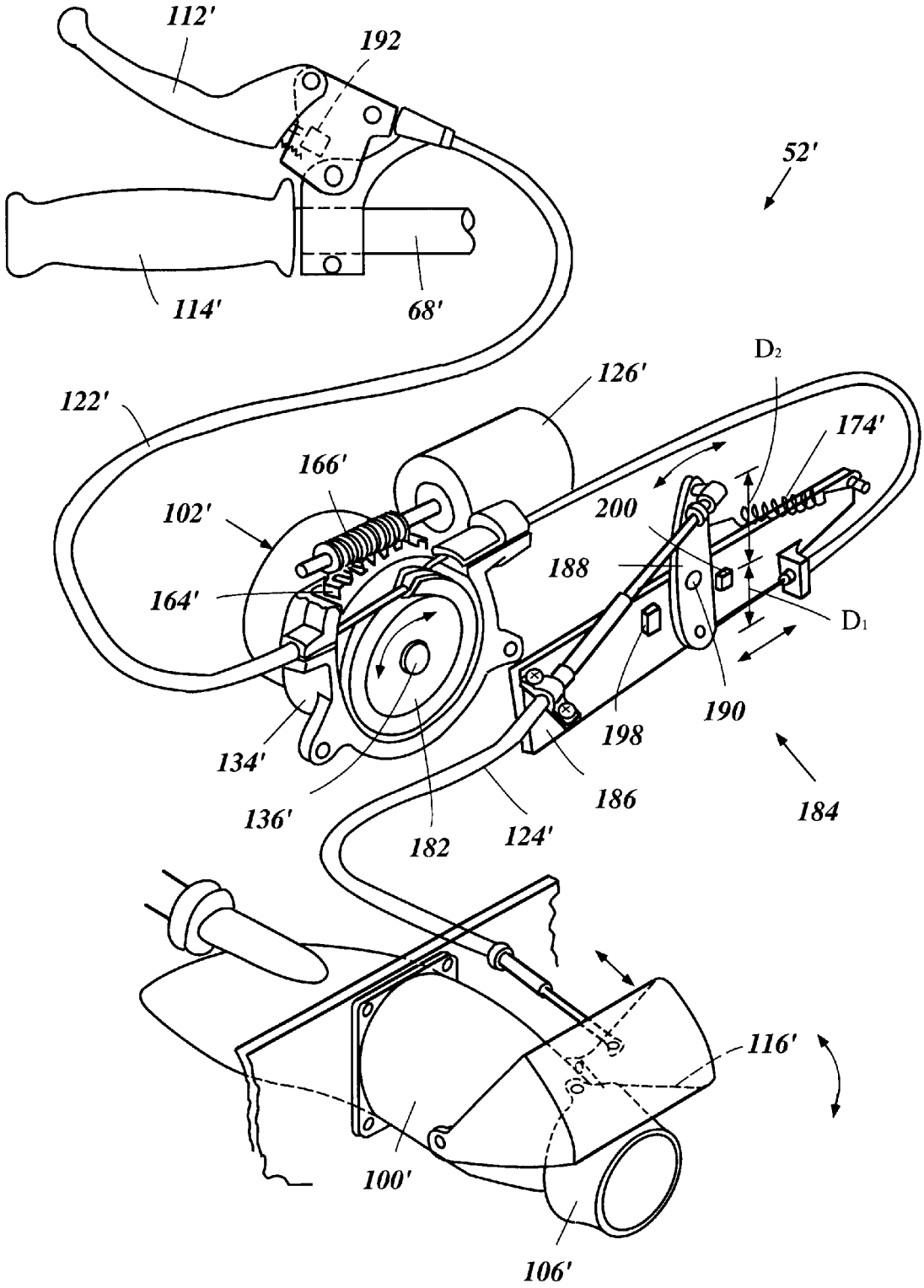
FIG. 15 is a schematic view of a modification of the control arrangement of FIG. 2, including a cable clutch mechanism that utilizes a single spool.

FIGS. 15 and 16 illustrate a modification of the reverse thrust arrangement 52 of FIGS. 1–8 and is indicated generally by the reference numeral 52'. The reverse thrust arrangement 52' is substantially similar to the reverse thrust arrangement 52 of FIGS. 1–8 and, therefore, like reference numerals will be used to describe like components, except that a prime (') will be added.

The reverse thrust arrangement 52' utilizes a cable clutch mechanism 102' having a single spool 182 in place of the normal spool 140 and the reverse spool 146 of the reverse thrust arrangement 52, described above. The present spool 182 is fixed for rotation with the support shaft 136'. The worm gear 166' of the motor 126' directly drives the spool 182. The motor 126' is capable of operation in both a clockwise and a counterclockwise direction.

The reverse thrust arrangement 52' also includes a separate stroke increasing arrangement 184. The stroke increasing arrangement 184 includes a bracket 186 which is mounted to the hull of the watercraft. The bracket 186 supports a lever 188 for rotation about a pivot axis 190. The input cable 122' is connected to a lower end of the lever 188 and the output cable 124' is connected to an upper end of the lever 188. The input cable 122' is connected to the lever 188 at a first distance D1 from the pivot axis 190 and the output cable 124' is connected to the lever 188 at a second distance D2 from the pivot axis 190. Desirably, the distance D2 is greater than the distance D1 and, therefore, each incremental movement of the input cable 122' moves the output cable 124' to a greater extent. Thus, it is possible to move the reverse bucket 116' from its raised position to its fully lowered position through a relatively small amount of movement of the secondary operation lever 112'.

The return spring 174' is connected to the lever 188 at a first end and to the bracket 186 at a second end. Thus, the return spring 174' tends to rotate the lever 188 in a clockwise direction about its pivot axis 190.

The input cable 122' is wound around the spool 182 and, thus, acts as the spool cable of the cable clutch mechanism 102' in a manner similar to the cables 168, 172 and the cable clutch mechanism 102 of FIGS. 1–8.

Figure 16A:
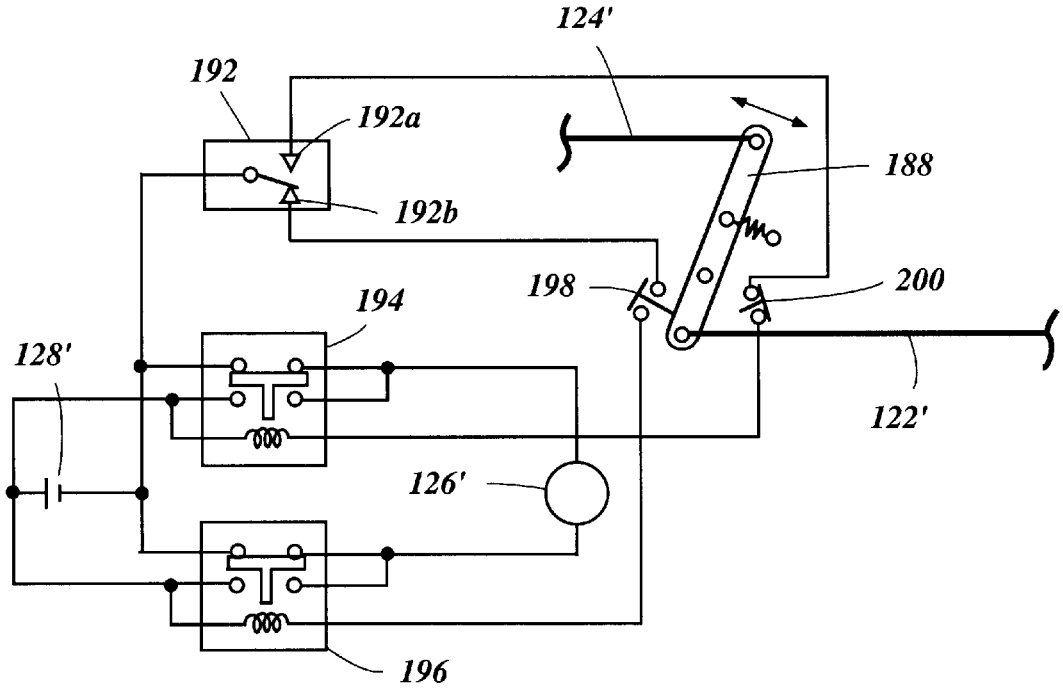
FIG. 16*a* is a schematic illustration of the control assembly shown in FIG. 15, when the water diverter bucket assembly is in the open position.
Figure 16B:
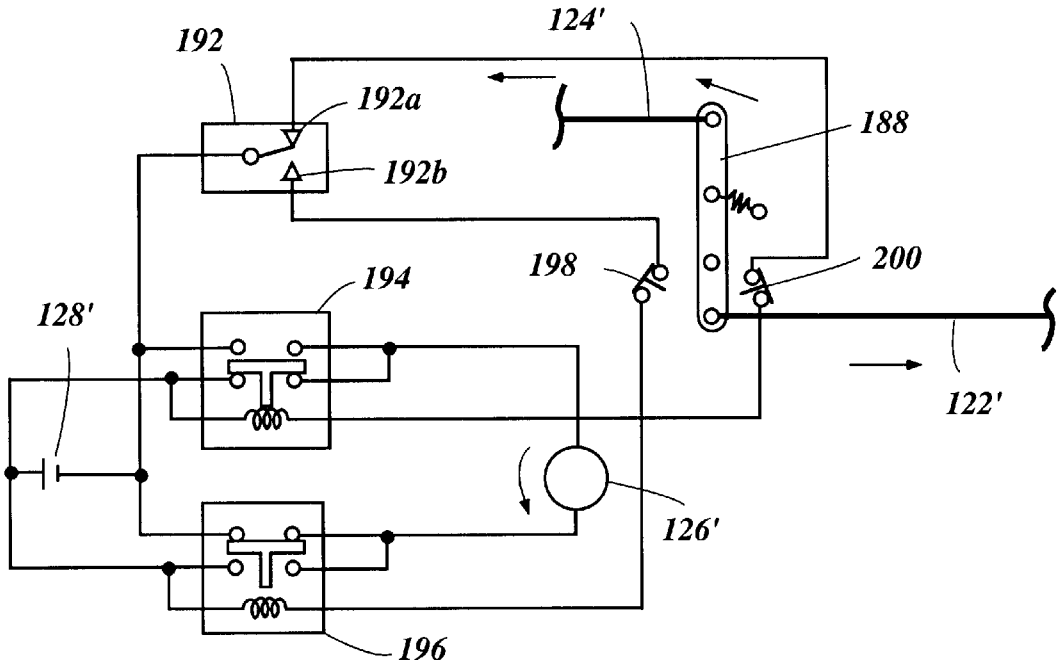
FIG. 16*b* is a schematic illustration of the control arrangement shown in FIG. 15, when the bucket assembly is moving toward a closed position.

With reference to FIGS. 16*a* and 16*b*, the reverse thrust arrangement 52' includes a switch 192 that is actuated by the secondary control lever 112'. The switch 192 has a first contact 192*a* and a second contact 192*b*. The switch 192 is configured such that the contact 192*b* is a normally closed, i.e., when the secondary control lever 112' is in its fully released position, away from the hand grip 114'. Additionally, the switch 192 is configured such that the contact 192*b* is opened when the lever 112' is moved toward the hand grip 114'.

The contact 192*a* is normally open, i.e., it is open when the secondary control lever 112' is moved away from its fully extended position, toward the hand grip 114'. Additionally, the switch 192 is configured such that the contact 192*a* is closed when the lever 112' is moved toward the hand grip 114'.

The switch 192 is connected to a pair of relays 194, 196, which are interposed between the battery 128' and the motor 126'. A pair of limit switches 198, 200 are mounted to the bracket 186 on opposing sides of the lever 188. The open limit switch 198 is contacted by the lever 188 when the reverse thrust bucket 116' is in a fully open position. Conversely, the closed limit switch 200 is contacted by the lever 188 when the reverse thrust bucket 116' is in its fully closed position. The limit switches 198, 200 are configured to interrupt the connection between the battery 128' and the motor 126'.

The operation of the reverse thrust arrangement 52' is described with reference to FIGS. 16*a*–16*d*. FIG. 16*a* illustrates the reverse thrust arrangement 52' when the reverse thrust bucket 116' is in the fully opened position and the secondary control lever 112' is in its fully released position. In this position, the limit switch 198' is open and, therefore, no power is being supplied to the motor 126'.

FIG. 16*b* illustrates the reverse thrust arrangement 52' when the operator has engaged the secondary operation lever 112'. As shown in FIG. 16*b*, when the switch lever 112' is moved toward the grip 114', the normally open contact 192*a* is closed, thereby activating the relay 194. Thus, power is supplied from the battery 128' to rotate the motor 126' which, in turn, rotates the spool 182 in the counter-clockwise direction. In addition, squeezing movement of the secondary control lever 112' tightens the input cable 122' around the spool 182, such that the distal end 122*b'* of the input cable 122' is rotated by the spool 182. Thus, the lever 188 is rotated in a counter-clockwise direction about its pivot axis 190 to push the output cable 124' and move the reverse thrust bucket 116' towards its lowered, or closed position.

Figure 16C:
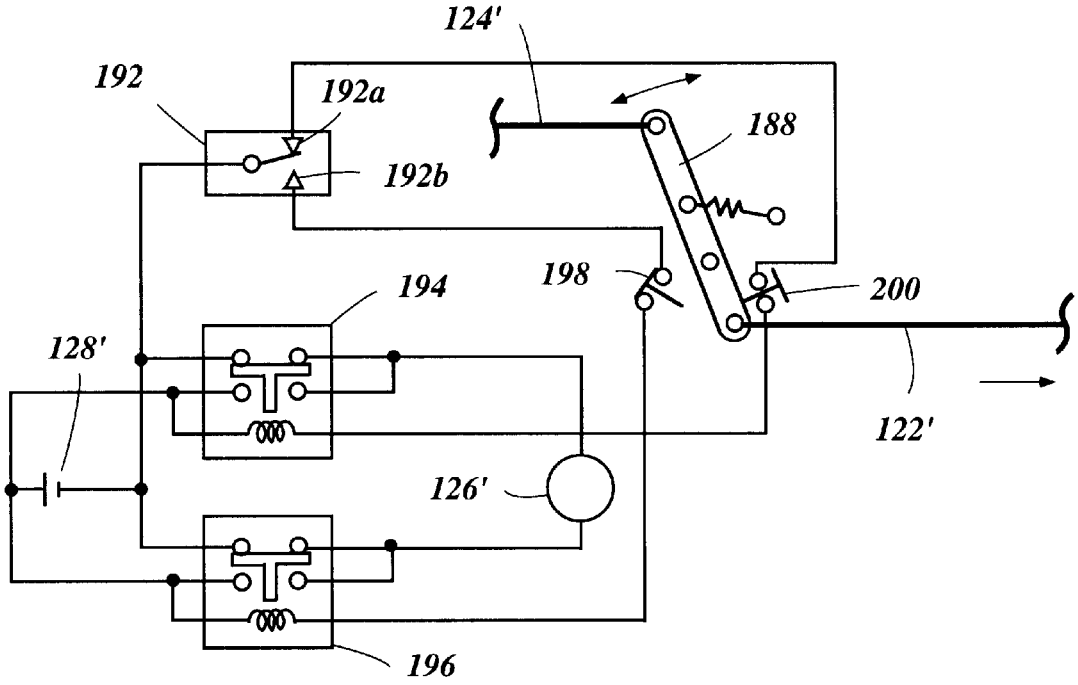
FIG. 16*c* is a schematic illustration of the control arrangement shown in FIG. 15, when the bucket assembly is in the fully closed position.

FIG. 16*c* illustrates the reverse thrust arrangement 52' when the secondary control lever 112' is in an actuated position, i.e., toward the hand grip 114', and the reverse thrust bucket 116' is in its fully closed, or lowered position. In this position, the fully closed limit switch 200' is open and no power is being supplied to the motor 126'.

Figure 16D:
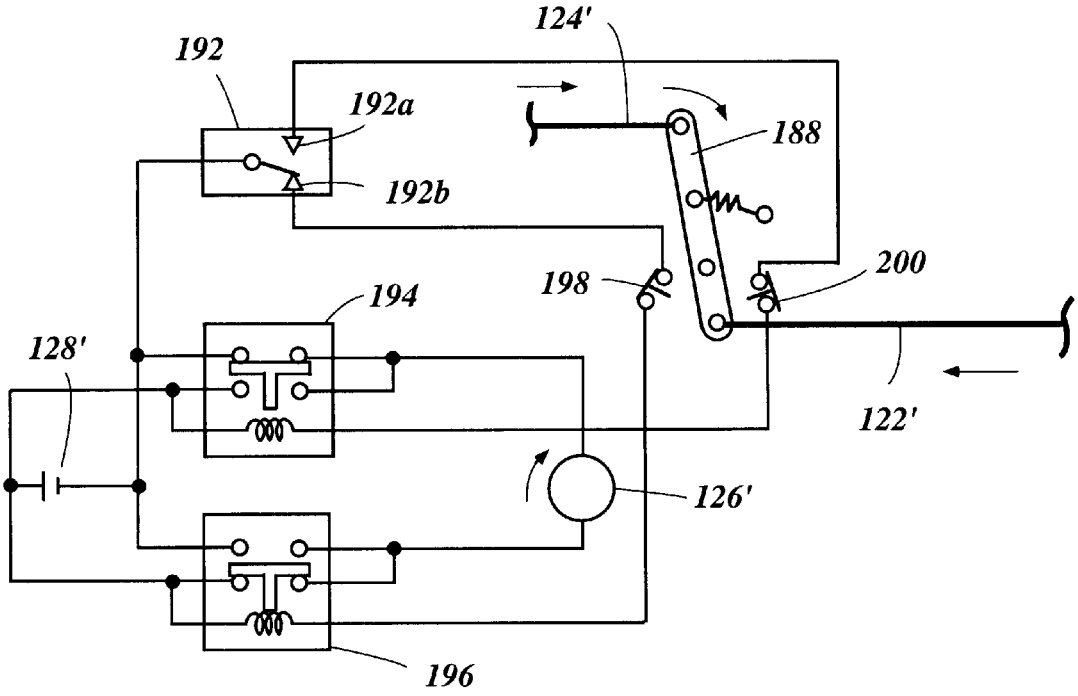
FIG. 16*d* is a schematic illustration of the control arrangement shown in FIG. 15, when the bucket assembly is moving toward the open position.

FIG. 16*d* illustrates the reverse thrust arrangement 52' when the secondary control lever 112' is released and is moving toward the fully released position. In the illustrated position of the secondary control lever 112', the normally closed contact 192*b* is closed, thus activating the relay 196. As a result, power is supplied from the battery 128' to the motor 126' and causes the motor 126' to rotate in a direction opposite to that of FIG. 16*b*. Thus, the spool 182 is rotated in a clockwise direction.

At the same time, releasing of the secondary control lever 112' creates slack in the proximal end 122*a'* of the input cable 122'. The return spring 174' biases the lever 188 in a clockwise direction about the pivot axis 190 to apply a pulling force to the distal end 122*b'* of the input cable 122' and tighten the input cable 122' around the spool 182. Frictional engagement between the input cable 122' and the spool 182 causes the input cable 122' to move with the spool 182 and apply a force tending to rotate the lever 188 in a clockwise direction. As a result, the reverse thrust bucket 116' is moved toward the open position through the output cable 124'. When the reverse thrust bucket 116' has reached its fully open position, the open limit switch 198' is opened, thereby stopping the motor 126', as illustrated in FIG. 16*a*.

Figure 17:
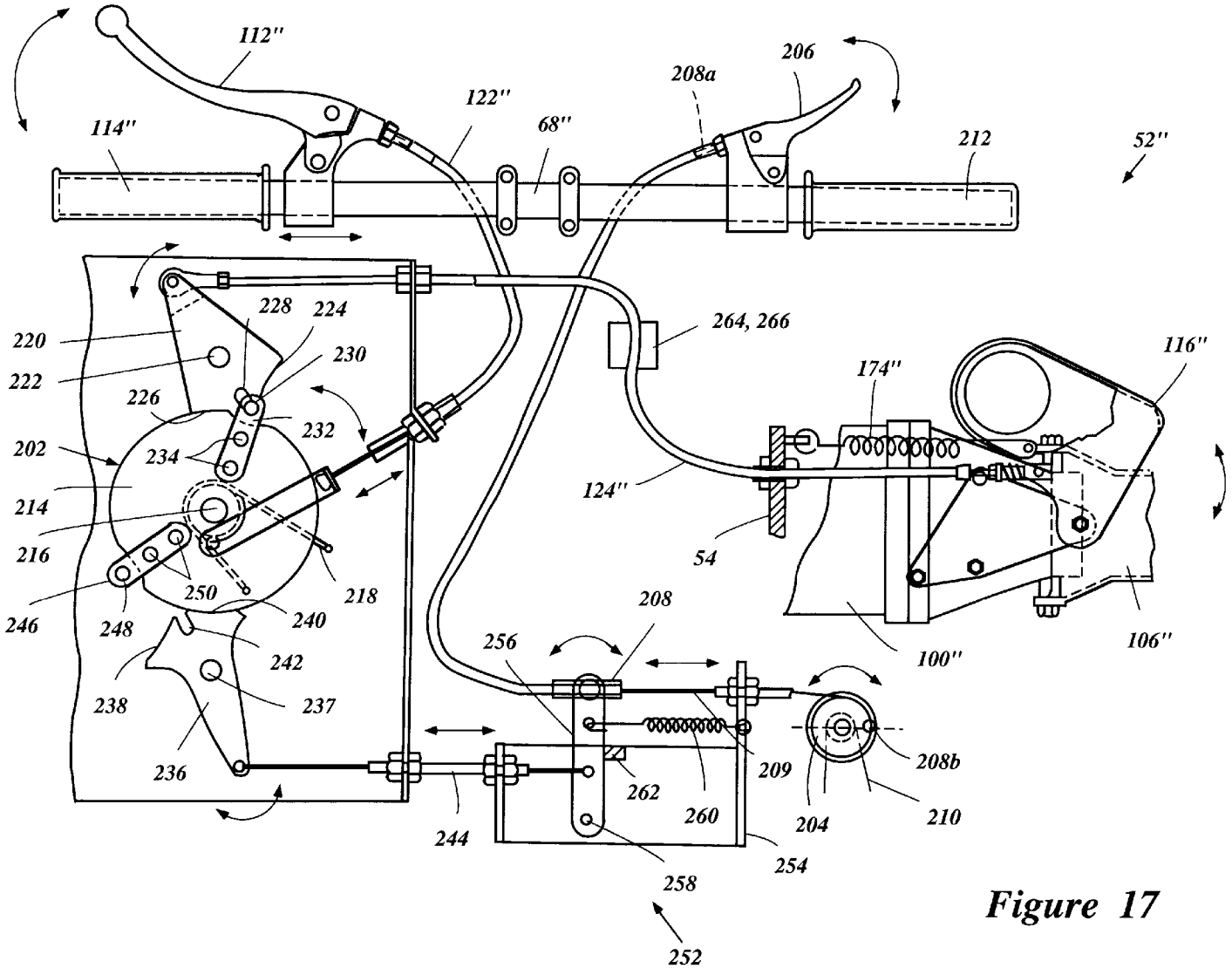
FIG. 17 is a schematic illustration of another modification of the control management shown in FIG. 2, wherein the control arrangement utilizes a geneva mechanism to permit a secondary control lever to move the bucket assembly from the open to the closed position, and permit control of an operating speed of the engine when the bucket is in the closed position.

FIGS. 17 and 18 illustrate a modification of the reverse thrust arrangement 52 of FIGS. 1–8 and is generally indicated by the reference numeral 52". The reverse thrust arrangement 52" is similar to the reverse thrust arrangement 52 and thus like reference numerals will be used to indicate like components, except that a double prime (") is added. In addition to controlling movement of the reverse thrust bucket 116", the reverse thrust arrangement 52" is additionally configured to permit control of an operating speed of the engine after the reverse thrust bucket 116" reaches its fully closed, or lowered position.

The reverse thrust arrangement 52" includes a Geneva wheel mechanism 202, or Maltese cross mechanism, disposed between the input cable 122" and the output cable 124". FIG. 17 illustrates a throttle control arrangement of the watercraft, which was present, but not shown, in the previous Figures. The throttle control arrangement comprises a throttle valve 204, a throttle control lever 206, and a throttle control cable assembly 208. The throttle valve 204 is configured to increase or decrease an amount of air made available to the engine of the watercraft, which increases or decreases the power output of the engine, as is well known in the art.

A biasing member 210 biases the throttle valve 204 toward a closed position. A first end 208*a* of the throttle cable 208 is coupled to the throttle lever 206 and a second end 208*b* is coupled to the throttle valve 204. Thus, as is well known in the art, the throttle control lever 206 is operable as a power request input to control a position of the throttle valve 204 and thereby control a power output of the engine. Desirably, the throttle control lever 206 is mounted on a right hand side of the handlebar assembly 68" near a right hand grip 212 to be operable by the right hand of an operator of the watercraft.

The Geneva mechanism 202 includes an original wheel 214 rotatably supported by a shaft 216. A biasing member, such as torsion spring 218, biases the original wheel 214 in a clockwise direction, toward a relaxed position as illustrated in FIG. 17. The input cable 122" is coupled to the original wheel 214 such that engaging movement of the secondary control lever 112" moves the original wheel 214 in a counterclockwise direction against the biasing force of the torsion spring 218.

A reverse bucket output member 220 is rotatably supported on a shaft 222 and cooperates with the original wheel 214. An outer end of the thrust bucket output member 220 is connected to the output cable 124" to move the reverse thrust bucket 116" between the open and closed positions. The inward end of the reverse bucket output member 220 includes a pair of cam surfaces 224, 226 arranged on opposing sides of a slot 228.

The cam surfaces 224, 226 are configured to slidably engage a peripheral surface of the original wheel 214 to secure the reverse bucket output member 220 in one of a clockwise or counter-clockwise position. The slot 228 is configured to be engaged by a pin 230 supported by an outwardly extending arm 232 of the original wheel 214. The arm 232 is fixed to the original wheel 214 by a pair of fasteners 234, such as bolts or rivets.

When the original wheel 214 is in its clockwise, or relaxed position, the thrust bucket output member 220 is held in its counter-clockwise position by inner action between the cam surface 226 and the peripheral surface of the original wheel 214. In this position, the thrust bucket 116" is secured in its open, or raised position.

Figure 18A:
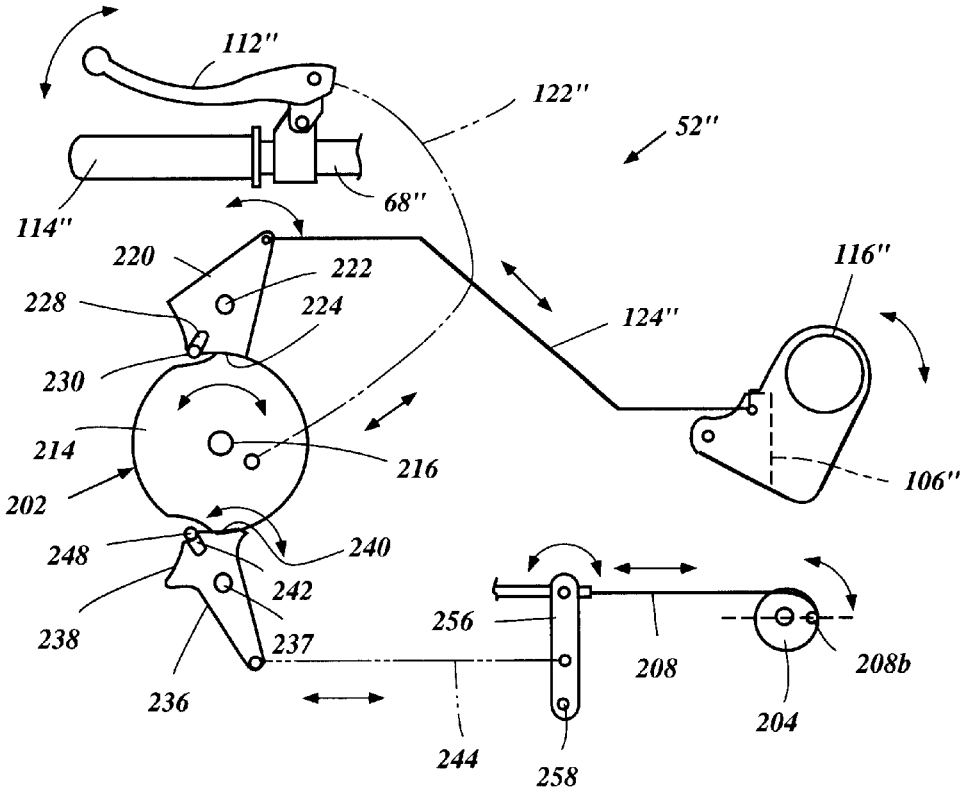
FIG. 18*a* is a schematic illustration of the control arrangement of FIG. 17 when the bucket assembly is in a closed position.
Figure 18B:
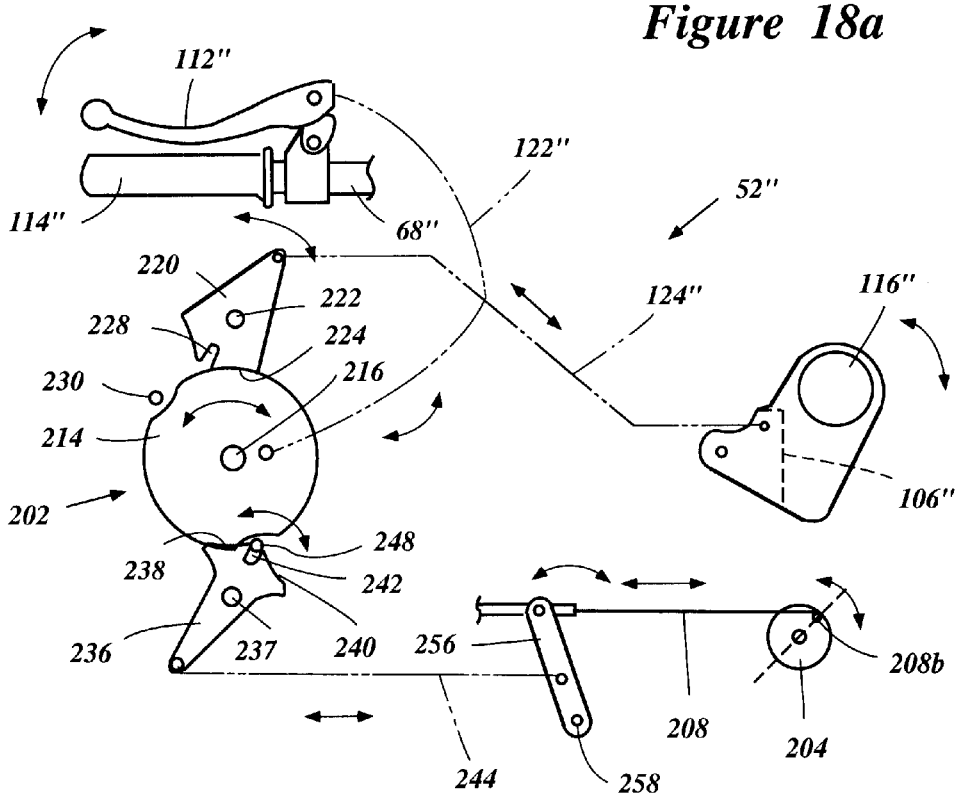
FIG. 18*b* is a schematic illustration of the control arrangement of FIG. 17 increasing an operational speed of the engine after the bucket assembly has reached the fully closed position.

When the original wheel 214 is rotated in a counter-clockwise direction, the pin 230 engages the slot 228 to rotate the reverse bucket output member 220 to its clockwise position as illustrated in FIGS. 18*a* and 18*b*. The reverse bucket output member 220 is held in the clockwise position by inner action between the cam surface 224 and the peripheral surface of the original wheel 214.

The Geneva mechanism 202 additionally includes a throttle output member 236 pivotally supported on a pin 237, which is substantially similar to the reverse bucket output member 220 described immediately above. The throttle output member 236 includes a pair of cam surfaces 238, 240 positioned on opposing sides of a slot 242. The outward end of the throttle output member 236 is coupled to an interconnecting cable 244, which is configured to affect movement of the throttle valve 204, which is described in greater detail below. The original wheel 214 includes a second outwardly extending arm 246, which supports a pin 248 configured to engage the slot 242 of the throttle output member 236. The arm 246 is secured to the original wheel 214 by a pair of fasteners 250.

The pin 248 of the outwardly extending arm 246 of the original wheel 214 interacts with the slot 242 to move the throttle output member 236 between a counterclockwise, or relaxed, position and a clockwise position, as shown in FIG. 18*b*. In the relaxed position, the throttle output member 236 does not affect an operating position of the throttle valve 204. Movement of the throttle output member 236 in a clockwise direction moves the throttle valve 204 in a valve opening direction, which increases the power output, and thus, the speed of the engine 80.

An interconnection arrangement 252 interconnects the throttle output member 236 of the Geneva wheel mechanism 202 to the throttle valve 204 to permit the Geneva wheel mechanism 202 to affect a change in position of the throttle valve 204. The interconnection mechanism includes a bracket 254 supported by a hull of the watercraft.

A pivot arm 256 is rotatably supported on a pin 258 on the bracket 254. An upper end of the arm 256 is coupled to the throttle control cable assembly 208. In particular, the distal end of the housing of the cable assembly 208 is secured to the upper end of the arm 256.

The interconnecting cable 244 is coupled to an intermediate portion of the arm 256. A biasing member, such as spring 260, biases the arm 256 in a clockwise direction toward a relaxed position defined by a stop 262 affixed to the bracket 254.

In the relaxed position of the arm 256, the Geneva mechanism 202 is not influencing the position of the throttle valve 204. When the throttle output member 236 of the Geneva mechanism 202 is rotated in a clockwise direction, as described above, the inner connecting cable 244 rotates the arm 256 in a counter-clockwise direction. As a result, the arm 256 applies a pulling force to the cable housing, thereby moving the throttle cable 209 and the throttle valve 204 toward a throttle open position and, thus, increase power output of the engine. Additionally, the position of the throttle lever 206 is not changes because the arm 256 is connected to the housing of the throttle cable assmebly 208.

In a normal, forward mode of operation of the watercraft, the Geneva mechanism 202 is in the position illustrated in FIG. 17 wherein the reverse bucket output member 220 is in the counter-clockwise position and the throttle output member 236 is also in the counter-clockwise position. As a result, the reverse bucket 116" is in the fully open, or raised position, and the Geneva mechanism 202 is not influencing a position of the throttle valve 204. Therefore, the throttle valve 204 is being controlled by the throttle control lever 206, as described above.

With reference to FIG. 18*a*, when an operator of the watercraft moves the secondary control lever 112" toward an engaged position, i.e., toward the handgrip 114", the original wheel 214 is rotated in a counter-clockwise direction. The pin 230 engages the slot 228 to move the reverse bucket output member 220 toward its clockwise position, thus moving the reverse bucket 116" toward its closed, or lowered position. When the reverse bucket 116" has reached its fully closed position, the pin 230 disengages the slot 228 and the reverse bucket output member 220 is held in the clockwise position by the interaction between the cam surface 224 and the peripheral edge of the original wheel 214.

The outwardly extending arms 232, 246 are positioned with respect to one another such that the pin 248 of the second arm 246 does not engage the slot 242 of the throttle output member 236 until the reverse bucket 116" is in its fully lowered, or closed position. Once the reverse bucket 116" is in its closed position, the pin 248 engages the slot 242 of the throttle output member 236. Thus, further movement of the lever 112" rotates the throttle output member 236 toward the clockwise position, as illustrated in FIG. 18*b*. Rotation of the throttle output member 236 toward the clockwise position applies a pulling force to the interconnection cable 244 which rotates the arm 256 in a counter-clockwise direction, thus rotating the throttle valve 204 in a throttle opening direction. Accordingly, a power output and thus the speed of the engine is increased. Thus, the Geneva mechanism 202 permits an operator of the watercraft to move the reverse bucket 116" to a closed position and increase an operational speed of the engine by controlling only the secondary control lever 112".

A stroke increasing mechanism and/or a force increasing mechanism 264, 266 can be provided along the output cable 124" to increase both a stroke and a force of the input cable 122". The force increasing mechanism 266 may comprise the cable clutch arrangement 102 or 102' of the embodiments of FIGS. 1–8 or 15–16, respectively. Other suitable alternatives may also be used, as may be determined by one of skill in the art.

FIGS. 19–24 illustrate a modification of the reverse thrust arrangement 52" of FIGS. 17 and 18, and as generally referred to by the reference numeral 52'". The reverse thrust arrangement 52'" is similar to the reverse thrust arrangement 52" of FIGS. 17 and 18, and, thus, like reference numerals will be used to denote like components, except that a triple prime ('") is added. The reverse thrust arrangement 52'" uses a swing link arrangement 270 to affect control of the throttle valve 204'" after the reverse bucket 116'" has been moved to its fully closed position, in place of the Geneva mechanism 202 of the reverse thrust arrangement 52'" of FIGS. 17 and 18.

Figure 19:
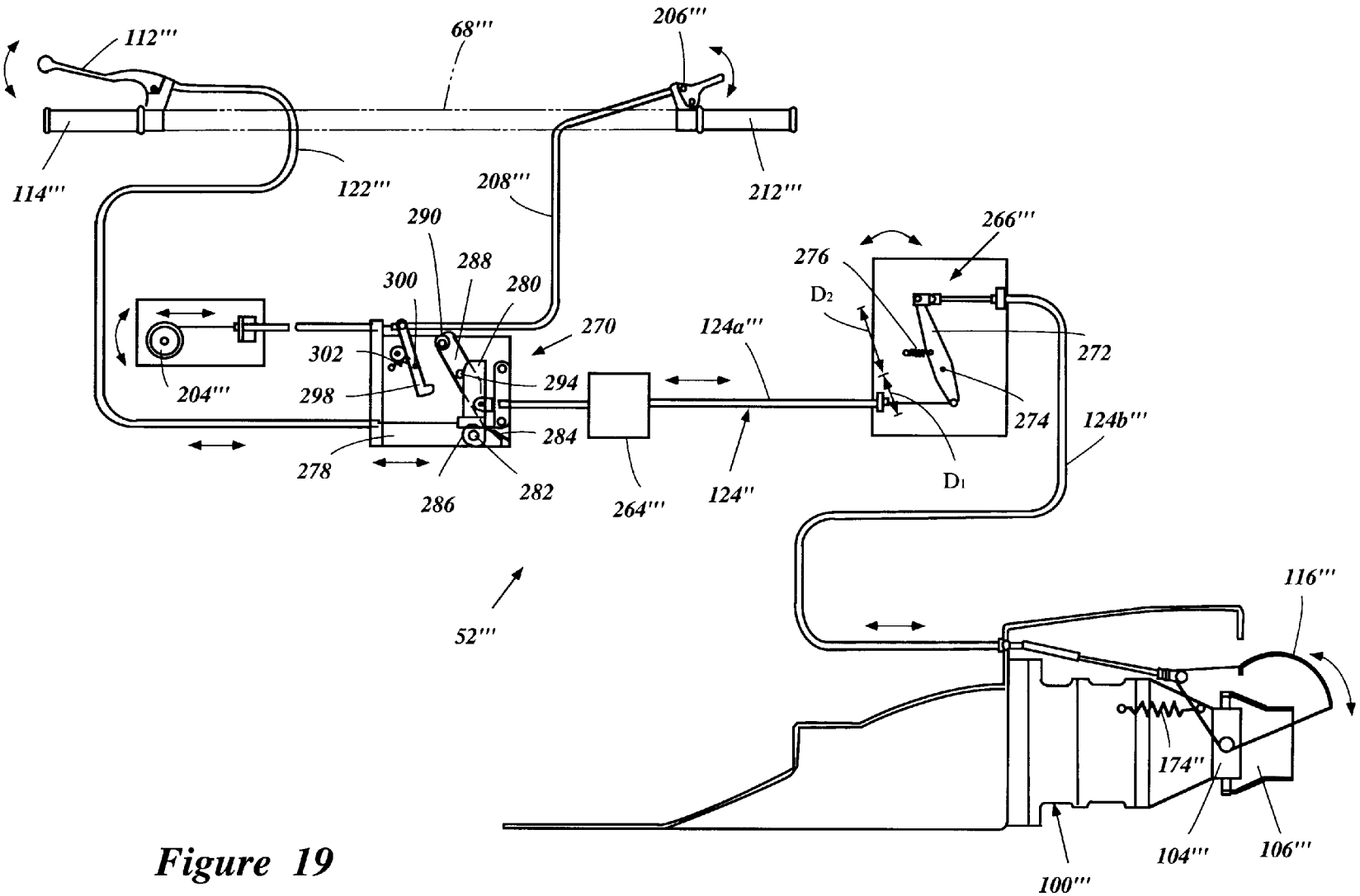
FIG. 19 is a schematic illustration of yet another modification of the control management of FIG. 2, utilizing a swing link mechanism to permit a secondary control lever to move the bucket assembly from the open to the closed position, and permit control of an operating speed of the engine when the bucket is in the closed position.

FIG. 19 illustrates a stroke increasing mechanism 266'" interposed between a proximal end 124*a*'" and a distal end 125*b*'" of the output cable 124'". The stroke increasing mechanism 266'" includes a linkage arm 272 supported for rotation about a pin 274. A return spring 276 biases the linkage arm 272 in a counter-clockwise direction, corresponding to an open, or raised, position of the reverse thrust bucket 116'". The proximal output cable 124*a*'" is coupled to the lever arm 272 at a first distance D1 from the pin 274. The distal output cable 124*b*'" is coupled to an upper end of the lever arm 272 at a distance D2 from the pin 274. Preferably, the distance D2 is greater than the distance D1 such that incremental movement of the proximal output cable 124*a*'" results in greater movement of the distal output cable 124*b*'".

The swing link arrangement 270 includes a bracket 278. A first lever member 280 is rotatably supported at a lower end on a pin 282. A biasing member, such as spring 284, biases the first lever 280 in a clockwise direction to a relaxed position. The input cable 122'" is coupled to the first lever 280 through a connection 286 such that movement of the secondary control lever 112'" toward an engaged position rotates the first lever 280 in a counter-clockwise direction against the biasing force of the spring 284. A second lever 288 is rotatably supported by a pin 290 on its upper end. The output cable 124'" is coupled to a lower end of the second lever 288 at a connection 292. The second lever 288 includes an engagement pin 294 which interacts with a cam surface 296 of the upper end of the first lever 280. The second lever 288 is biased in a clockwise direction into engagement with the first lever 280 by a pulling force exerted by the output cable 124'" as a result of the springs 276 of the stroke increasing mechanism 266'" and the return spring 174'" acting on the reverse thrust bucket 116'".

Movement of the first lever 280 in a counter-clockwise direction results in clockwise rotation of the second lever 288 through interaction between the engagement pin 294 and the cam surface 296. Thus, movement of the secondary control lever 112'" toward the engaged position results in movement of the reverse bucket 116'" toward the closed, or lowered position.

The swing link mechanism 270 additionally includes a third lever arm 298 rotatably supported on a pin 300. The third lever 298 is biased in a counter-clockwise direction by a spring 302 into a relaxed position defined by a stop 304.

The throttle control cable 208'" is coupled to an upper end of the third lever 298. The lower end of the third lever 298 defines an engagement surface 306 configured to interact with the cam surface 296 of the first lever 280. In the relaxed position, the third lever 298 does not apply a force to the throttle control cable 208'" and, thus, does not affect a position of the throttle valve 204'". Clockwise movement of the third lever 298 away from the relaxed position applies a pulling force to the throttle control cable 208'" and moves the throttle valve 204'" toward a throttle opening position. Thus, an operational speed of the engine is increased with clockwise movement of the third lever 298.

Figure 20:
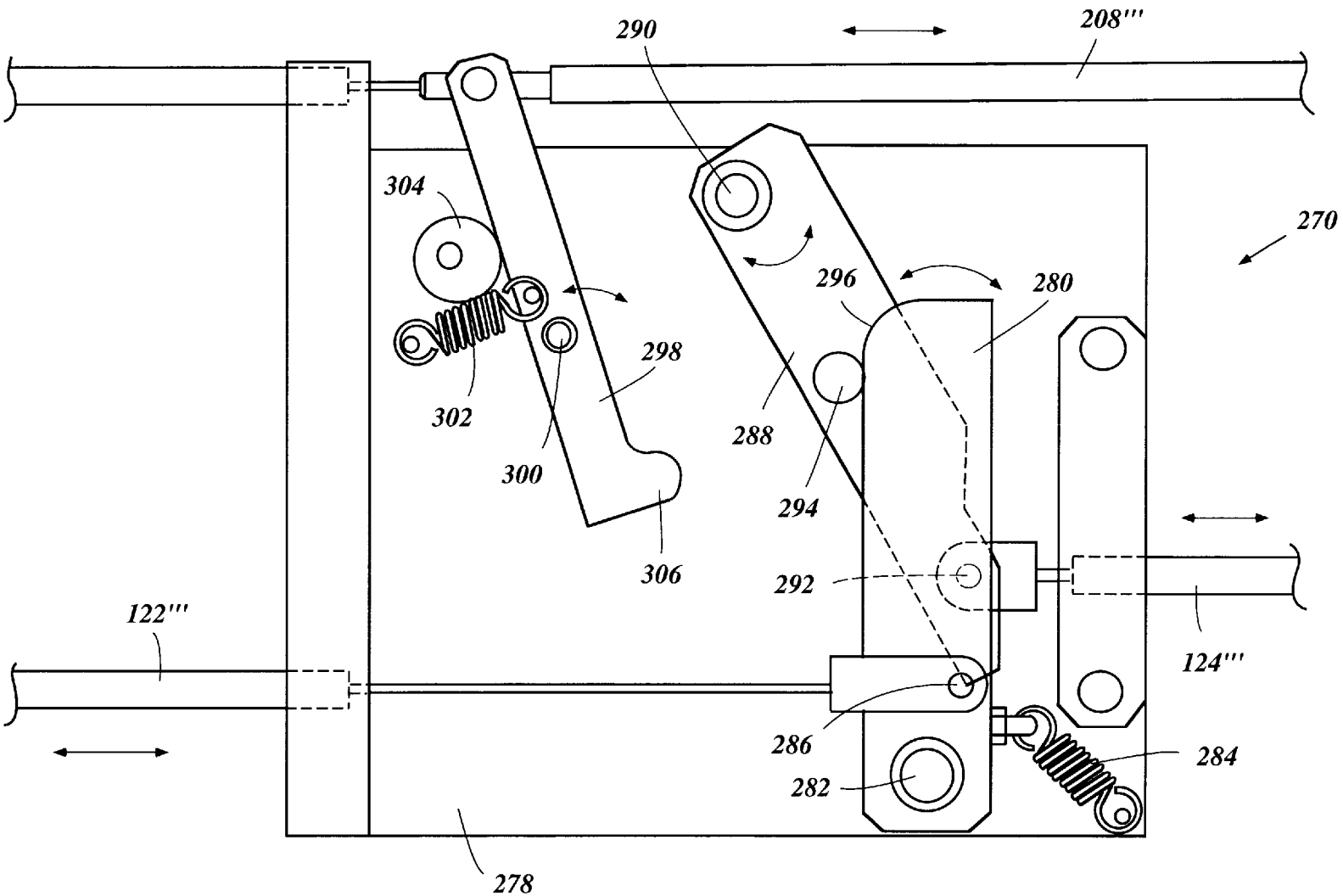
FIG. 20 is an enlarged view of the swing link mechanism of FIG. 19.
Figure 21:
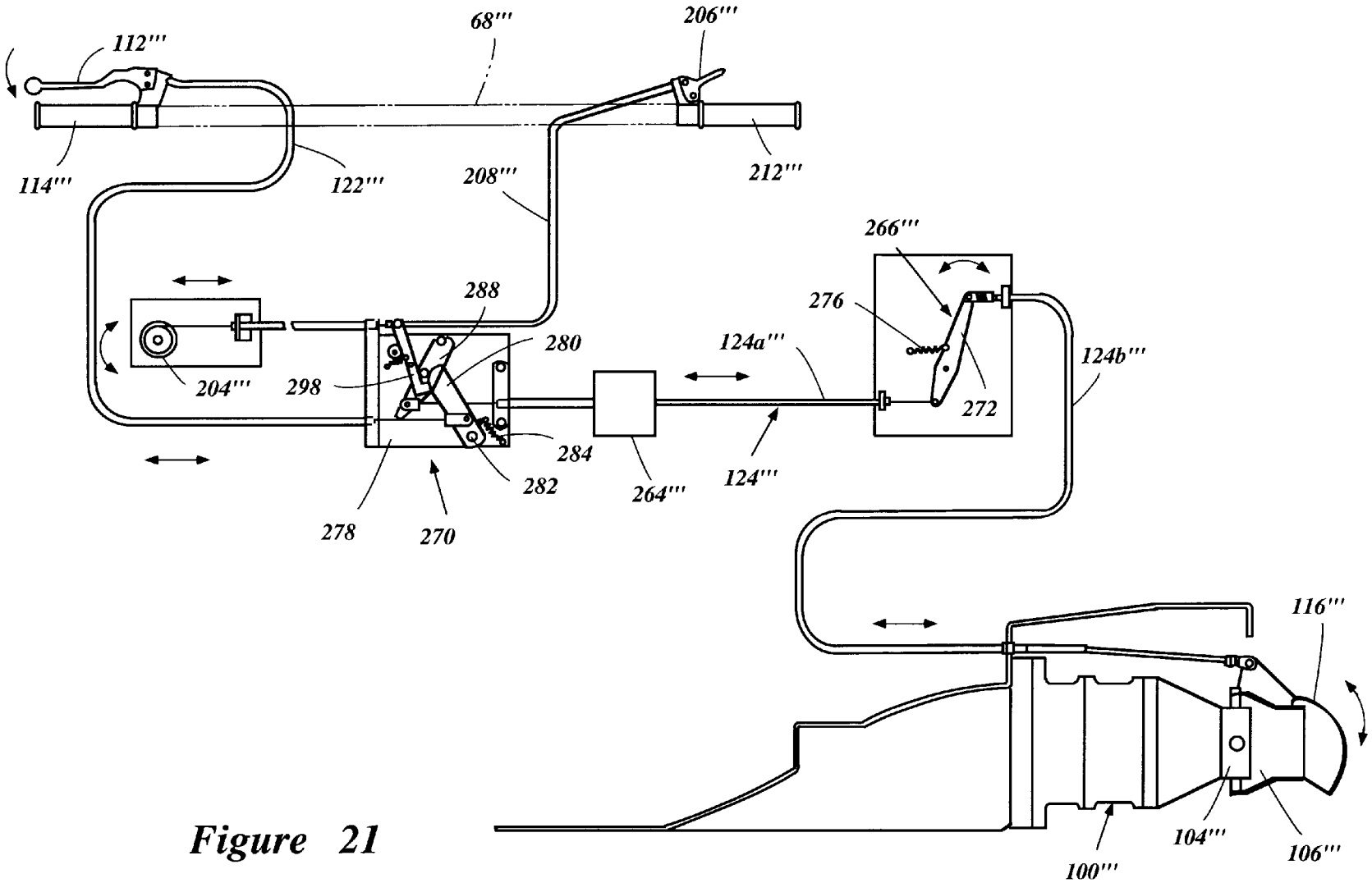
FIG. 21 is a schematic view of the control arrangement of FIG. 19 when the bucket assembly is in the fully closed position and an operational speed of the engine is not being influenced by the secondary control lever.
Figure 22:
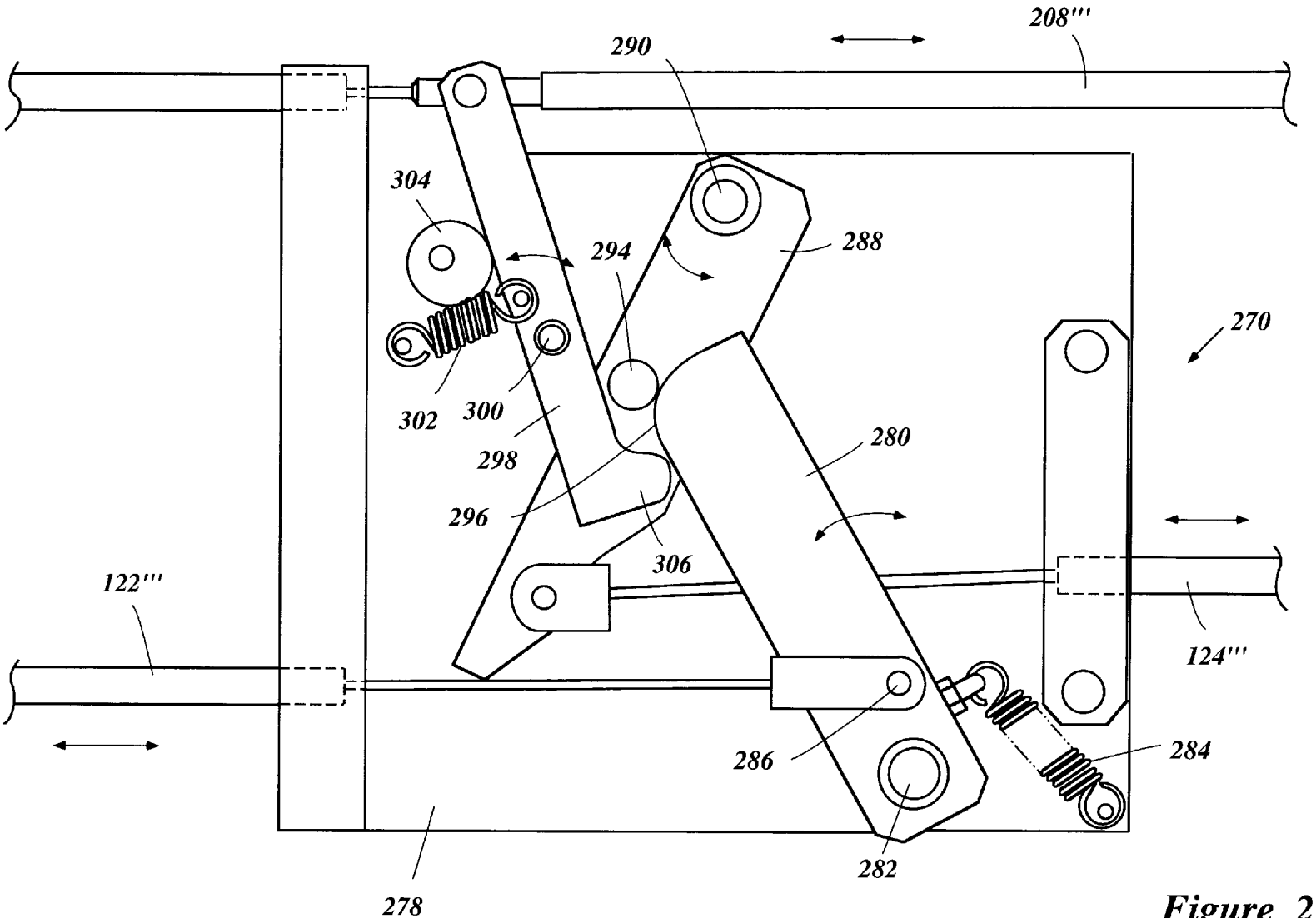
FIG. 22 is an enlarged view of the swing link mechanism in the position in FIG. 21.
Figure 23:
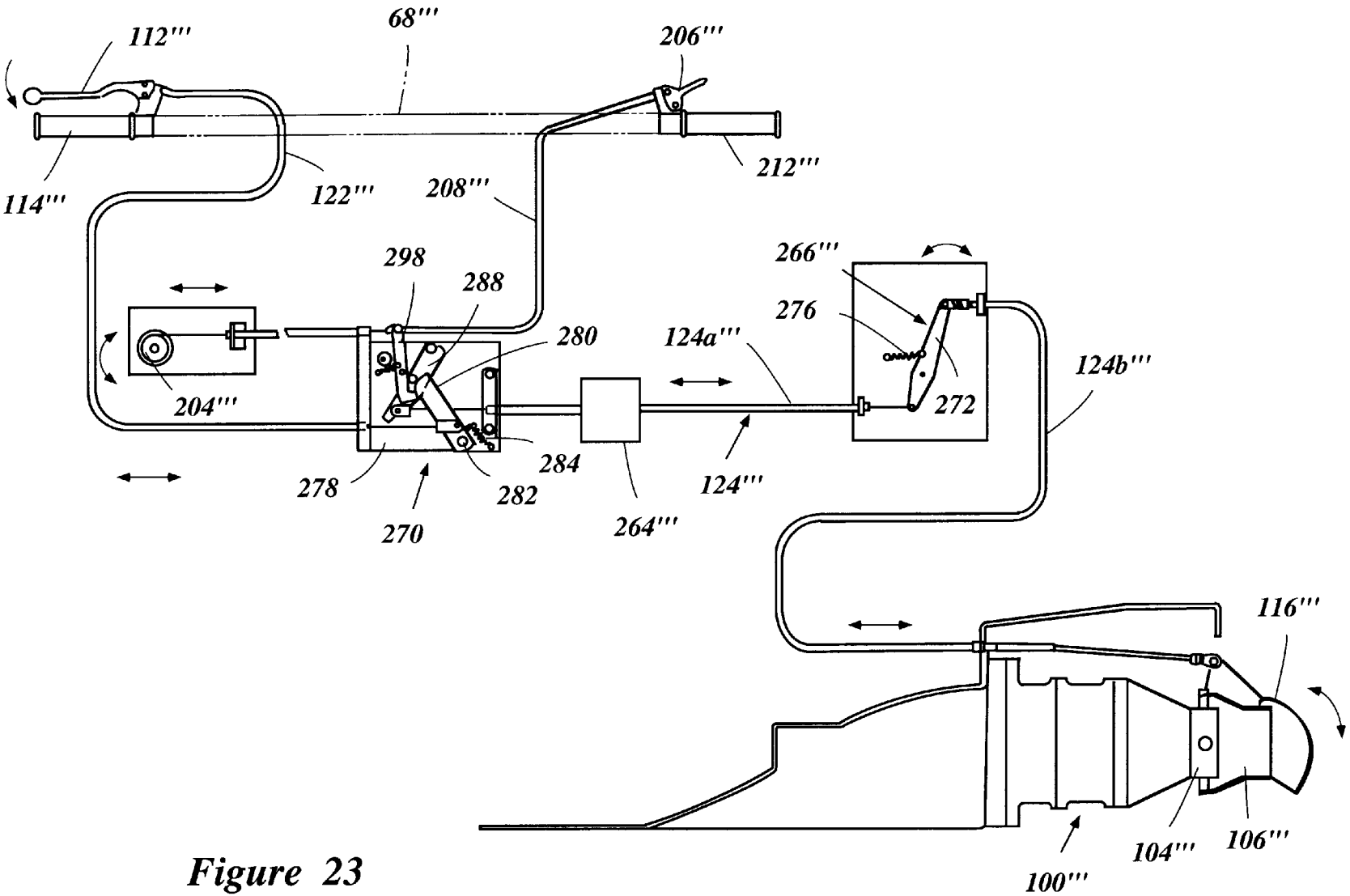
FIG. 23 is a schematic illustration of the control arrangement of FIG. 19 when the bucket assembly is in the fully closed position and the secondary control lever is influencing an operational speed of the engine.
Figure 24:
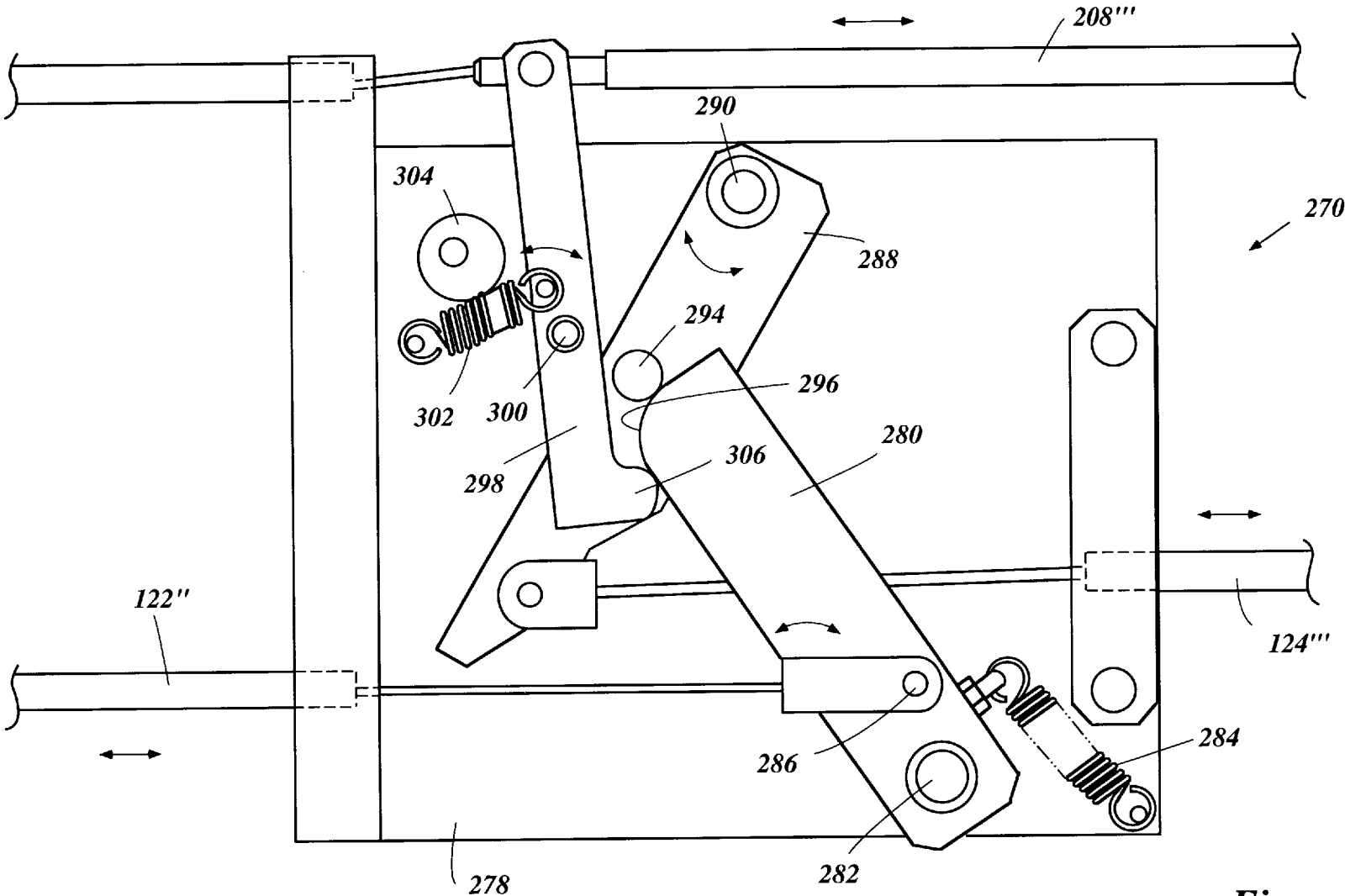
FIG. 24 is an enlarged view of the swing link mechanism in the position shown in FIG. 23.

In operation, when the secondary control lever 112'" is in its relaxed position, i.e., away from the handgrip 114'", the swing link arrangement 270 is in the mode shown in FIGS. 20 and 21. Thus, the reverse bucket 116'" is in the fully open, or raised, position, and the throttle valve 204'" is being controlled by the throttle operation lever 206'" for normal forward operation of the watercraft. When the operator moves the secondary control lever 112'" toward the engaged position, i.e., toward the handgrip 114'", the first lever 280 is moved in a counter-clockwise direction, and the cam surface 296 engages the engagement pin 294 of the second lever 288 to move the reverse bucket 116'" toward the closed, or lowered position. Once the reverse bucket 116'" has reached the fully closed position, the first lever 280 is configured to contact the engagement surface 306 of the third lever 298, as illustrated in FIGS. 23 and 24.

Continued movement of the secondary control lever 112'" toward the handgrip 114'" results in the first lever 280 biasing the third lever 298 in a clockwise direction to rotate the throttle valve 204'" toward a throttle open position, thereby increasing an operational speed of the engine. Additionally, the first lever 280 retains the second lever 288 in a clockwise position, thus retaining the reverse bucket 116'" in the fully closed position. Thus, as in the reverse thrust arrangement 52'" of FIGS. 17 and 18, an operator of the watercraft is able to move the reverse bucket 116'" into a closed position and influence an operating speed of the engine solely by operating the secondary control lever 112'".

FIGS. 25–33 illustrate an alternative water diverter arrangement configured to redirect at least a portion of the water jet issuing from the jet propulsion unit to achieve a reverse thrust and reverse motion of the watercraft. The water diverter arrangement is illustrated in the context of a small watercraft 320, which is similar to the watercraft 50 of FIG. 1. The watercraft 320 includes a hull 322 comprised of a lower hull portion 324 and an upper deck portion 326. A handlebar assembly 328 is supported by the upper deck 326 to a forward side of a straddle-type seat assembly 330. A jet propulsion unit 332 is positioned within a tunnel 334 of the watercraft 320. An internal combustion engine 336 drives the propulsion unit, which issues a water jet in a rearward direction from a steering nozzle 338.

The handlebar assembly 328 is coupled to the steering nozzle 338 through a connection 340, which is preferably a bowden wire assembly. Thus, an operator of the watercraft 320 moves the handlebar assembly 328 to affect steering of the watercraft 320. Other general details of the watercraft 320 may be considered similar to those of the watercraft 50 of FIG. 1, or may be considered conventional and, thus, a further description is not deemed necessary in order to practice the present invention.

A water diverter bucket assembly 342 is pivotally arranged relative to the steering nozzle 338 to assume at least a first, or open position, and a second, or closed position. In the illustrated embodiment, the open position corresponds to a raised position of the bucket assembly 342 and the closed position corresponds to a lowered position of the bucket assembly 342 because the bucket assembly is arranged to pivot about a horizontal axis. However, in an alternative arrangement, the bucket may comprise a pair of bucket members which pivot about a vertical axis to move to an open position on lateral sides of the steering nozzle 338 and a closed position behind the steering nozzle 338, as is described in greater detail below. In the lowered position, the bucket assembly 342 is arranged such that substantially all water issued from the steering nozzle 338 is diverted by the bucket assembly 342.

A pair of secondary discharge assemblies 344, 346 are located on starboard and port sides of a stern portion of the hull 322. Additionally, a pair of secondary inlets 348, 350 are provided on a side wall of the tunnel 334 and disposed on lateral sides of the steering nozzle 338. Each one of a pair of secondary flow passages 352, 354 connect the pair of secondary inlets 348, 350 to a respective one of the starboard and port sides discharge assemblies 344, 346.

The handlebar assembly 328 includes a throttle control lever 356 which is configured to adjust the engine speed in a known manner and a secondary control lever 358 additionally configured to adjust the engine speed. Furthermore, the secondary control lever 358 is configured to move the bucket assembly 342 between its raised and lowered position. The secondary control lever 358 may be configured to adjust the engine speed to a predetermined level, or to adjust the engine speed in accordance with the position of the secondary control lever 358. The secondary control lever 358 may be configured to adjust the engine speed through an arrangement such as that described in relation to FIGS. 17 and 18 or that described in relation to FIGS. 19–24. Alternatively, the secondary control lever 358 may be configured to adjust the engine speed through any other suitable arrangement, such as a servo motor arrangement, for example.

A pair of bowden wires 360 connect the secondary control lever 358 to a conversion device 362 and connect the conversion device 362 to the bucket assembly 342. The conversion device 362 is configured to multiply the actuation force and stroke of the secondary control lever 358 to achieve the necessary actuation force and stroke required to pivot the bucket assembly 342 between its raised and lowered positions. The conversion device 362 may comprise an arrangement such as those described in relation to FIGS. 1–25 or, alternatively, may comprise any other suitable arrangement.

Figure 28:
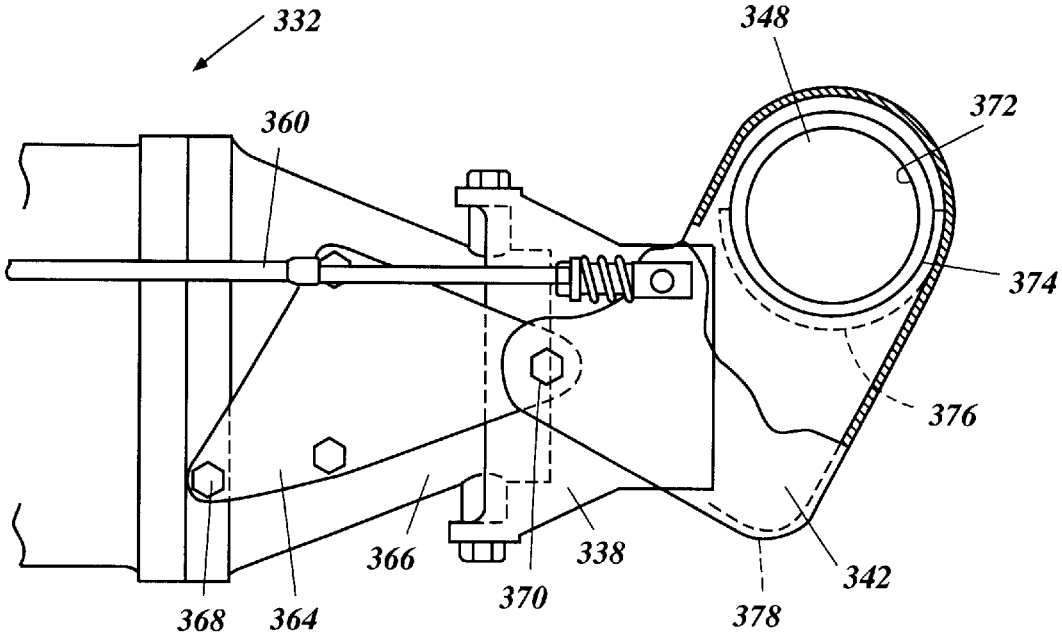
FIG. 28 is a side elevational view of the jet propulsion unit of FIG. 27 shown in a fully lowered position.
Figure 29:
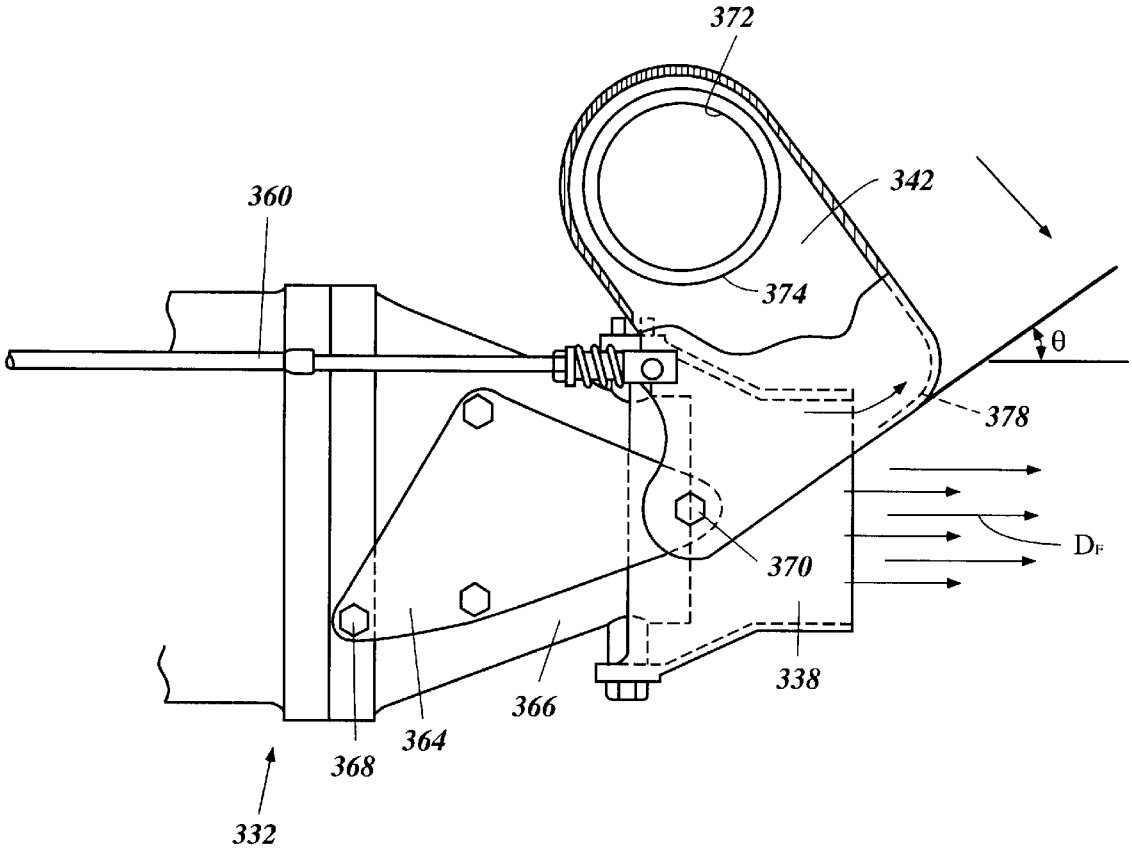
FIG. 29 is a side elevational view of the jet propulsion unit of FIG. 27 shown in a partially lowered position.
Figure 30:
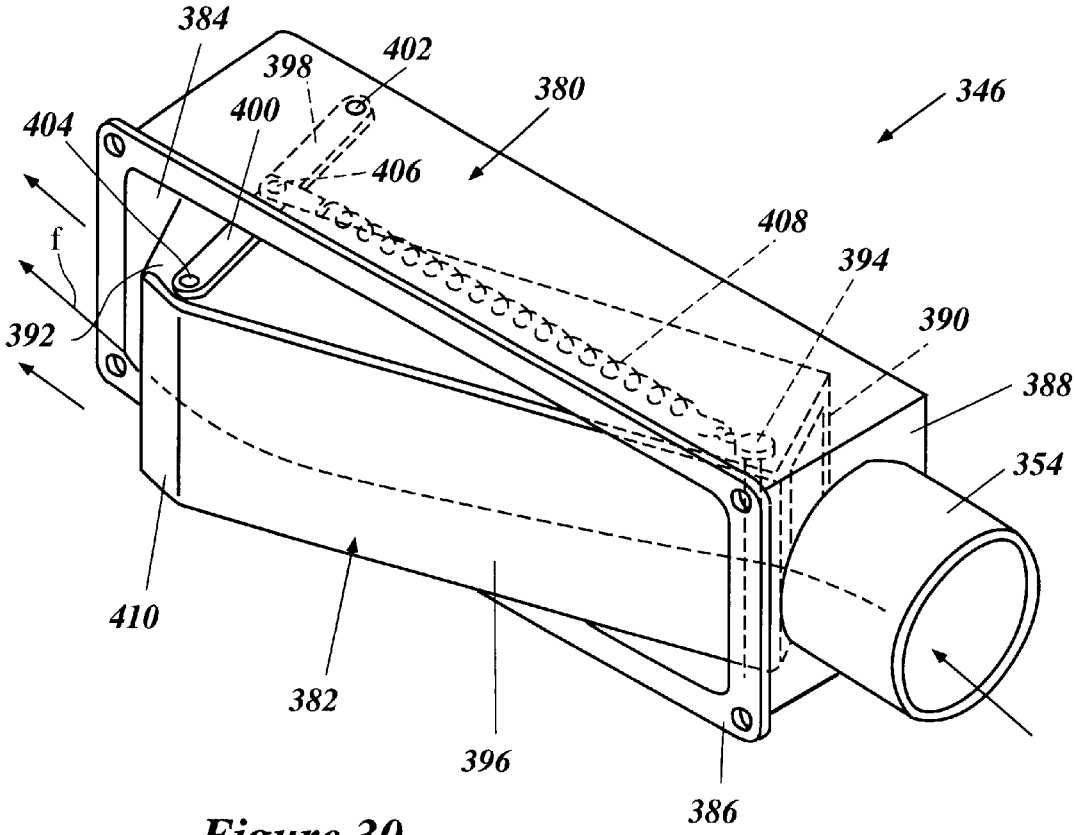
FIG. 30 is a top, rear, and port side perspective view of the port-side secondary discharge assembly of the watercraft of FIG. 25, shown in an open position.

As shown in FIGS. 28–30, the bucket assembly 342 is preferably pivotally supported on a pair of support brackets 364. The support brackets 364 are mounted on each lateral side of a discharge nozzle 366 of the jet propulsion unit 332 by a plurality of bolts 368. The bucket assembly 342 pivots between its raised and lowered position on an axis defined by a pair of support pins 370.

The water diverter bucket assembly 342 additionally comprises a pair of lateral outlet ports 372 configured to guide water diverted by the bucket assembly 342 toward the pair of secondary inlets 348, 350. The outer surfaces of the lateral outlet ports define engagement surfaces 374.

A pair of stops 376 are formed in the tunnel 334 and correspond with each secondary inlet 348, 350. The stops 376 are preferably semicircular in shape and are configured to support at least a bottom and rearward portion of the engagement surfaces 374 of the lateral output ports 372 such that the lateral outlet ports 372 are substantially aligned with the secondary inlets 348, 350. The stops 376 also provide support to the bucket assembly 342 in response to the force generated by water discharging from the steering nozzle 338.

With reference to FIG. 30, a guide surface 378 is provided on the water diverter bucket assembly 342. The guide surface 378 is arranged to contact the water issuing from the steering nozzle 338 at an angle θ that is 90 degrees, or less, relative to the flow direction $D_f$ of the water. Advantageously, with such a construction, the bucket assembly 342 is assisted in its downward movement from its raised position to its lowered position by force imparted on the guide surface 378 by water discharging from the steering nozzle 338.

In addition, the water diverter bucket assembly 342 preferably includes a partition (not shown), or a substantially vertical wall configured to bisect a jet stream of water being discharged from the steering nozzle 338, when the steering nozzle 338 is in a neutral position. However, when the steering nozzle 338 is pivoted to the right, the partition directs a greater volume of water to the secondary inlet 348 disposed on the starboard side of the hull 322. Similarly, when the steering nozzle 338 is pivoted to the left, the partition directs a greater volume of water to the secondary inlet 350 disposed on the port side of the hull 322.

Water is guided into the secondary flow passages 352, 354 through the secondary inlets 348, 350, respectively, is discharged through the discharge assemblies 344, 346. Preferably, the discharge arrangements 344, 346 are configured to issue water in a generally forward direction to produce a reverse thrust and move the watercraft 320 in a reverse direction. FIGS. 30–33 illustrate the port side discharge assembly 346 in greater detail. Although not specifically shown, the starboard side discharge assembly 344 is substantially identical to the discharge assembly 346, except for that it is a mirror image thereof.

The discharge assembly 346 is generally comprised of a housing 380 and a lid member 382. The housing 380 is a generally rectangular, box shaped member having an open outer side 384. A flange 386 encompasses the periphery of the open side 384 and permits the housing 380 to be attached to the hull 322 of the watercraft 320 such that the open side 384 is substantially in plane with an outer surface of the hull 322. Thus, the housing 380 is generally recessed within the hull 322. A rearward end 388 of the housing 380 communicates with a forward end of the secondary flow passage 354.

In the illustrated embodiment, the lid member 382 is a generally rectangular, elongated member sized and shaped to fit within the housing 380. The lid 382 is hollow to permit water to pass from a first and 390 adjacent the secondary flow passage 354 to a second and 392 adjacent a forward end of the housing 380. Thus, the lid member 182 operates as a discharge port. However, in an alternative arrangement, the lid member may be a solid member and the discharge port, or outlet, may be defined by the housing 380 or the hull 322 of the watercraft 320.

In the present arrangement, the lid member 382 is coupled to the housing 380 at an outer corner of the rearward end 390 for rotation about a pin 394. Thus, the lid member 382 is capable of pivoting from a retracted, or closed position, substantially entirely within the housing 380 to an open position wherein the forward end 392 of the lid member 382 is exposed from the housing 380. Thus, in the open position of the lid member 382, water is permitted to pass from the secondary flow passage 354 through the lid member 382 and is discharged outside the watercraft 320. In the closed position of the lid member 382, an outer surface 396 of the lid member is substantially planar with the flange 386 and inhibits water from entering the forward end 392 of the lid member 382, i.e., in a reverse direction.

Figure 32:
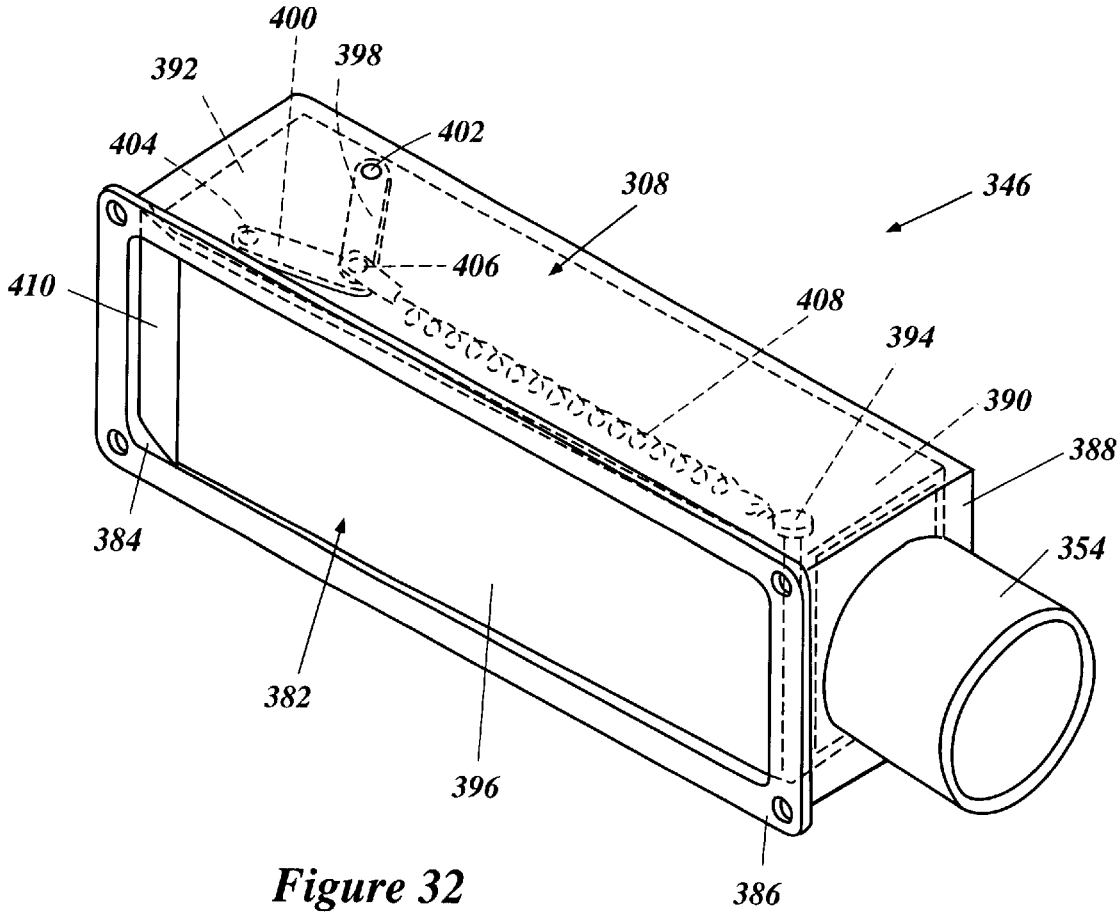
FIG. 32 is a top, rear, and port side perspective view of the secondary discharge assembly of FIG. 30 in a closed position.
Figure 33:
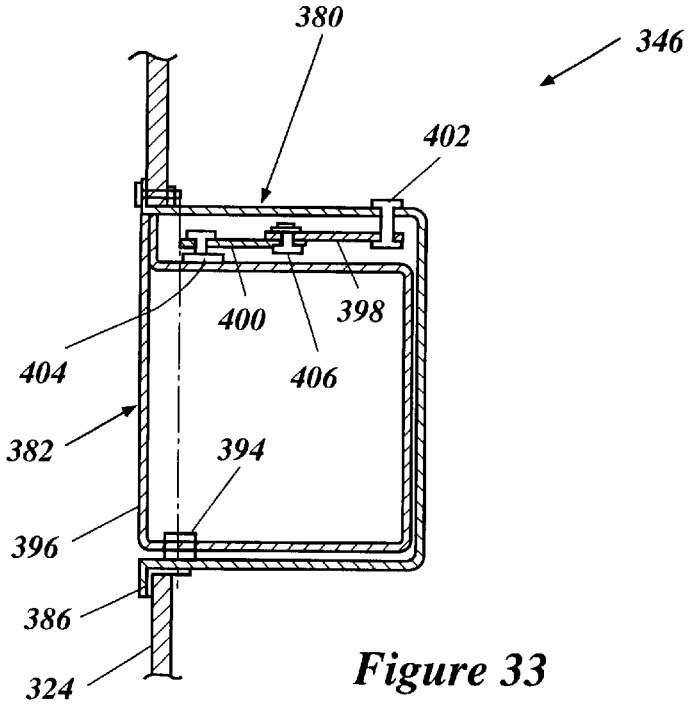
FIG. 33 is a cross-sectional view of the secondary discharge assembly of FIG. 32.
Figure 34:
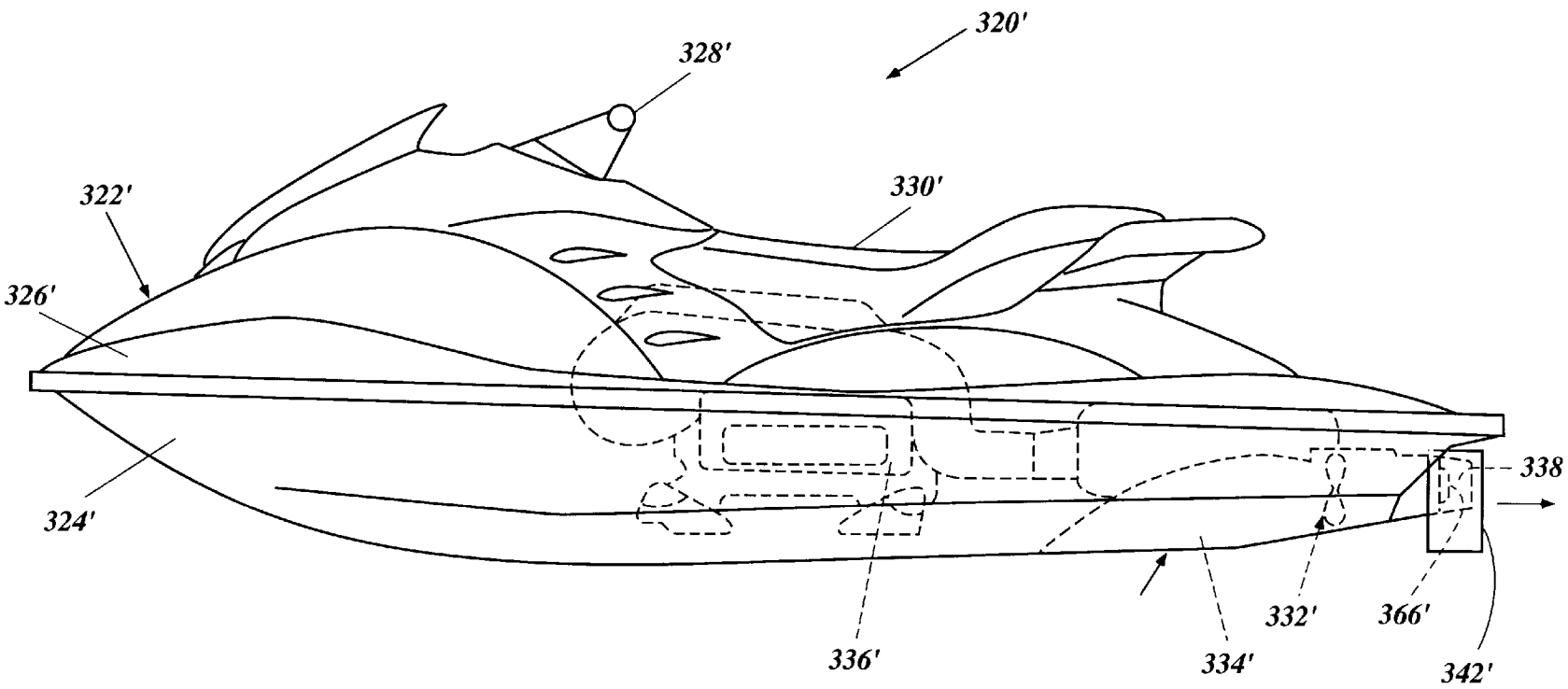
FIG. 34 is a side elevational view of a further modification of the watercraft of FIG. 1, including a jet propulsion unit having a modified water diverter bucket assembly.

The forward end 392 of the lid member 382 is coupled to the housing 380 through a linkage assembly comprising a first link member 398 and a second link member 400. The first link member 398 is pivotally attached to the housing 380 by a first pin 402. Similarly, the second link member 400 is pivotally connected to the lid member 382 by a second pin 404. The first and second link members 398, 400 are coupled to one another by a pin 406. A biasing member, such as a spring 408, extends between the linkage assembly and the rear pivot pin 394 between the lid member 382 and the housing 380. Preferably, the spring 408 is connected to the pin 406, which interconnects the first and second link members 398, 400. Accordingly, the spring 408 applies a rearward force to the pin 406, which tends to collapse the linkage assembly, i.e., move the first and second link members 398, 400 toward one another, thereby retracting the lid member 382, as shown in FIGS. 32 and 33.

Figure 31:
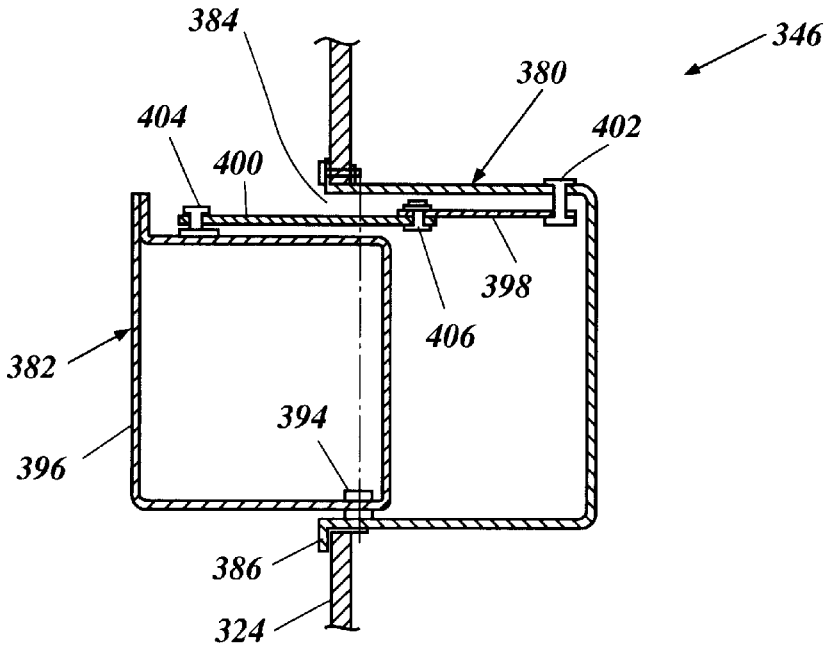
FIG. 31 is a cross-sectional view of the secondary discharge assembly of FIG. 30.

In operation, when the bucket assembly 342 is moved to its closed, or lowered position, and the steering nozzle 338 is either centered or toward the port side of the watercraft 320, water from the steering nozzle 338 enters the secondary flow passage 354 through the secondary inlet 350. As described above, desirably, when the bucket assembly 432 is in its lowered position, the operating speed of the engine is configured to increase, thereby providing ample water pressure to overcome the biasing force of the spring 408 and allow the lid member 382 to move into an open position, as illustrated in FIGS. 30 and 31. Thus, water is issued from the forward and 392 of the lid member 382 to produce a reverse thrust and rearward movement of the watercraft 320. When the bucket assembly 342 is in its raised position and, thus, water is not directed into the secondary flow passage 354, the spring 408 biases the lid member 382 into the closed position such that water is inhibited from entering the forward and 392 of the lid member 382.

In a preferred arrangement, the forward end 392 of the lid member 382 includes an inwardly curved portion 410, which is configured to be generally parallel to a longitudinal axis of the watercraft 320 when the lid member 382 is in an open position. Accordingly, water issuing from the discharge arrangement 346 is directed in a substantially forward direction F, also aligned with a longitudinal axis of the watercraft 320. Therefore, reverse thrust is efficiently achieved.

Figure 25:
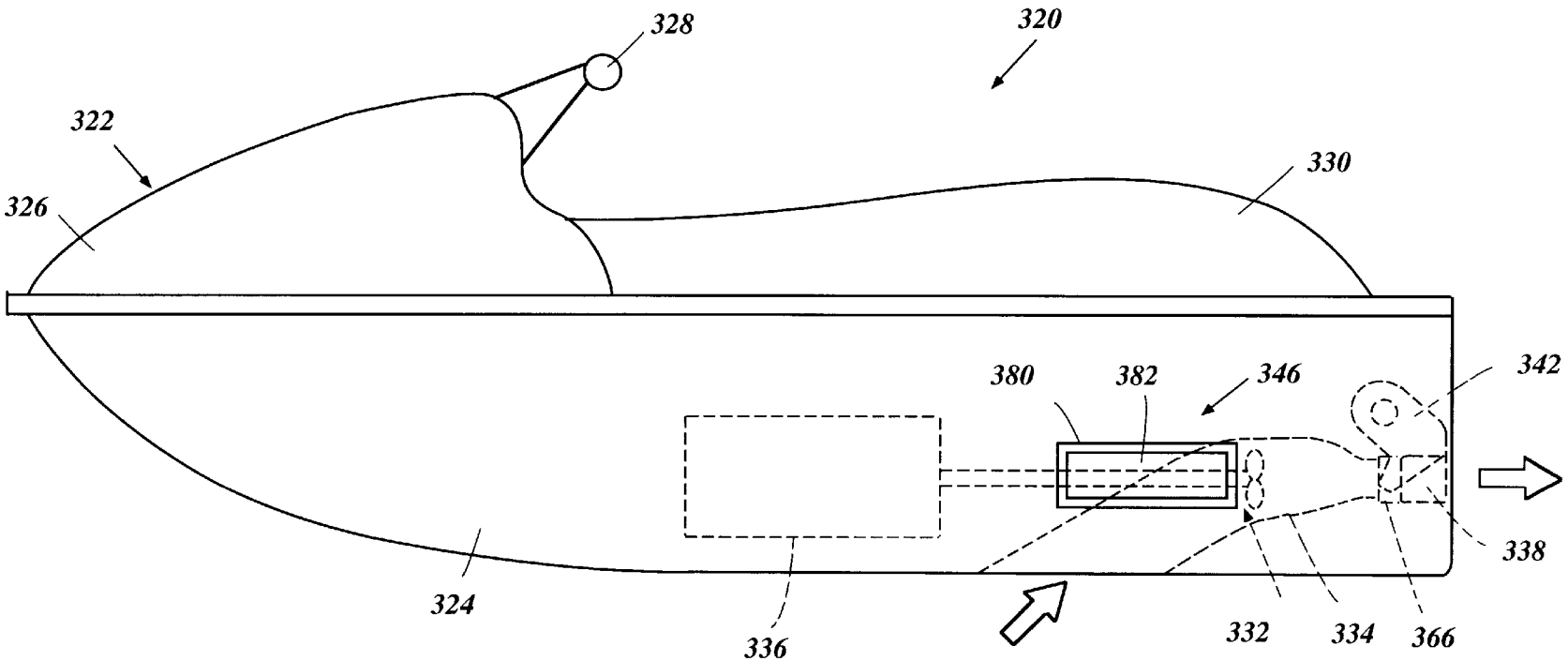
FIG. 25 is a side elevational view of a modification of the watercraft shown in FIG. 1, including a jet propulsion unit and a water diverter bucket assembly, similar to the watercraft of FIG. 1.
Figure 26:
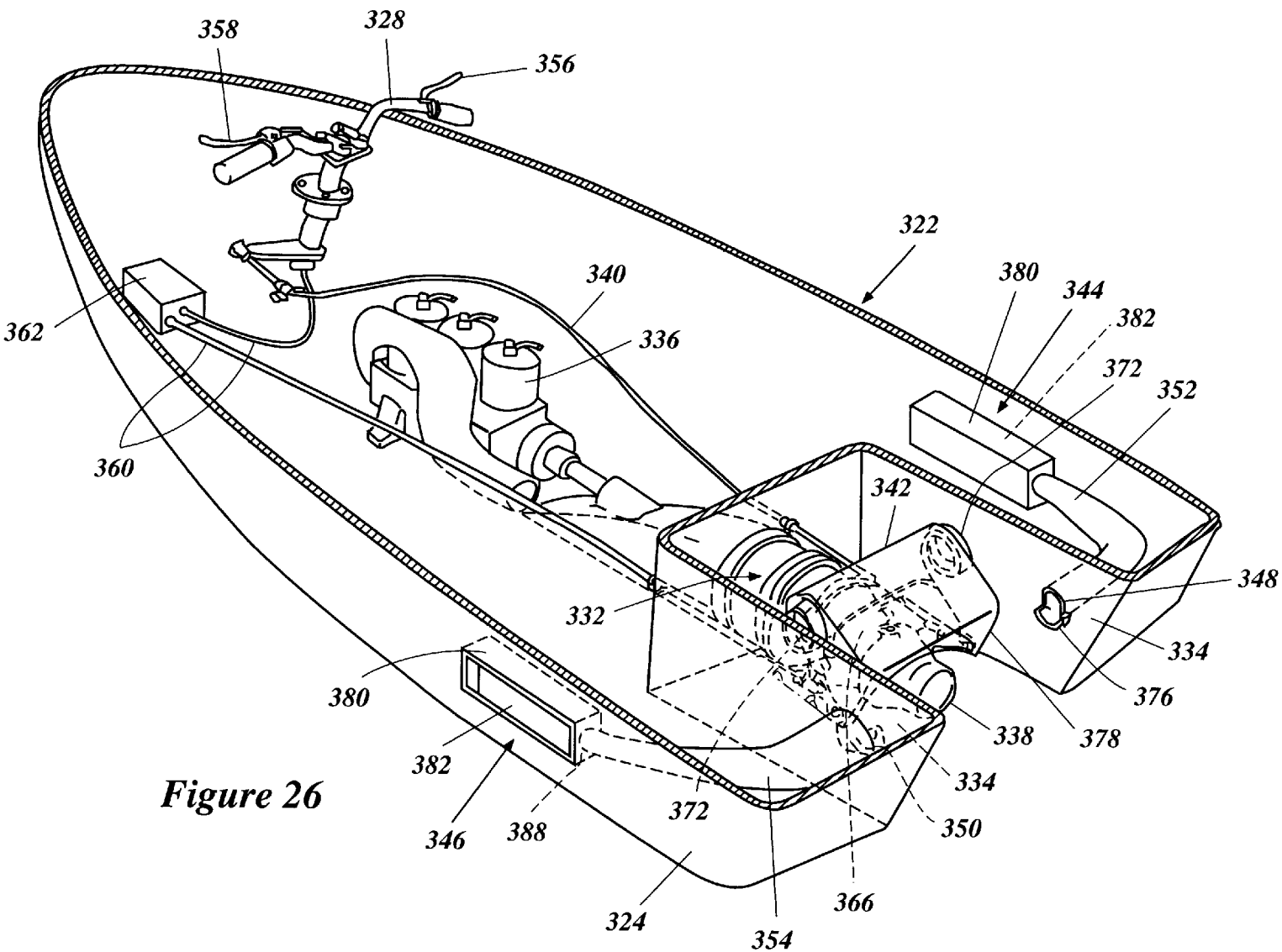
FIG. 26 is a top, rear, and port side perspective view of the lower hull of the watercraft of FIG. 25 illustrating secondary flow passages extending from the tunnel of the hull to the secondary discharge assemblies.
Figure 27:
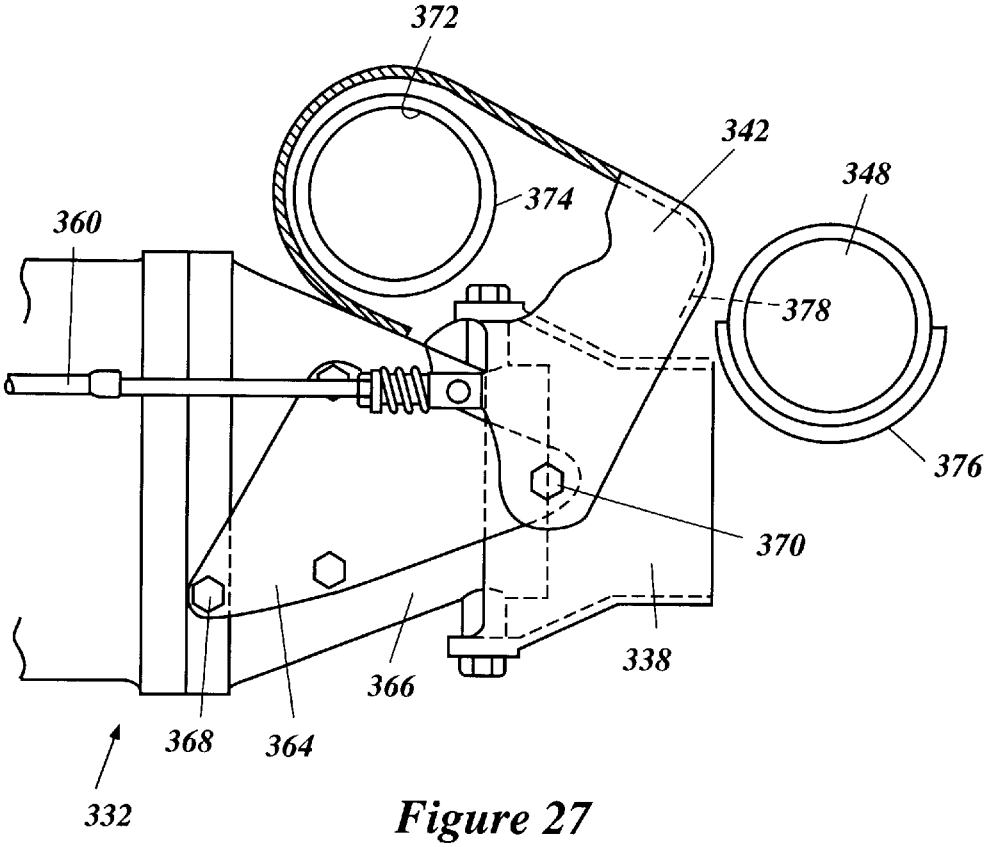
FIG. 27 is a side elevational view of the jet propulsion unit of FIG. 25 showing the bucket assembly in a raised position.

FIGS. 34–44 illustrate an alternative water diverter bucket assembly generally referred to by the reference character 342' and illustrated in the context of a small watercraft referred to by the reference numeral 320', which is similar to the watercraft 320 of FIG. 25. Accordingly, like reference numerals are used to indicate like components, except that a prime (') is added.

Figure 35:
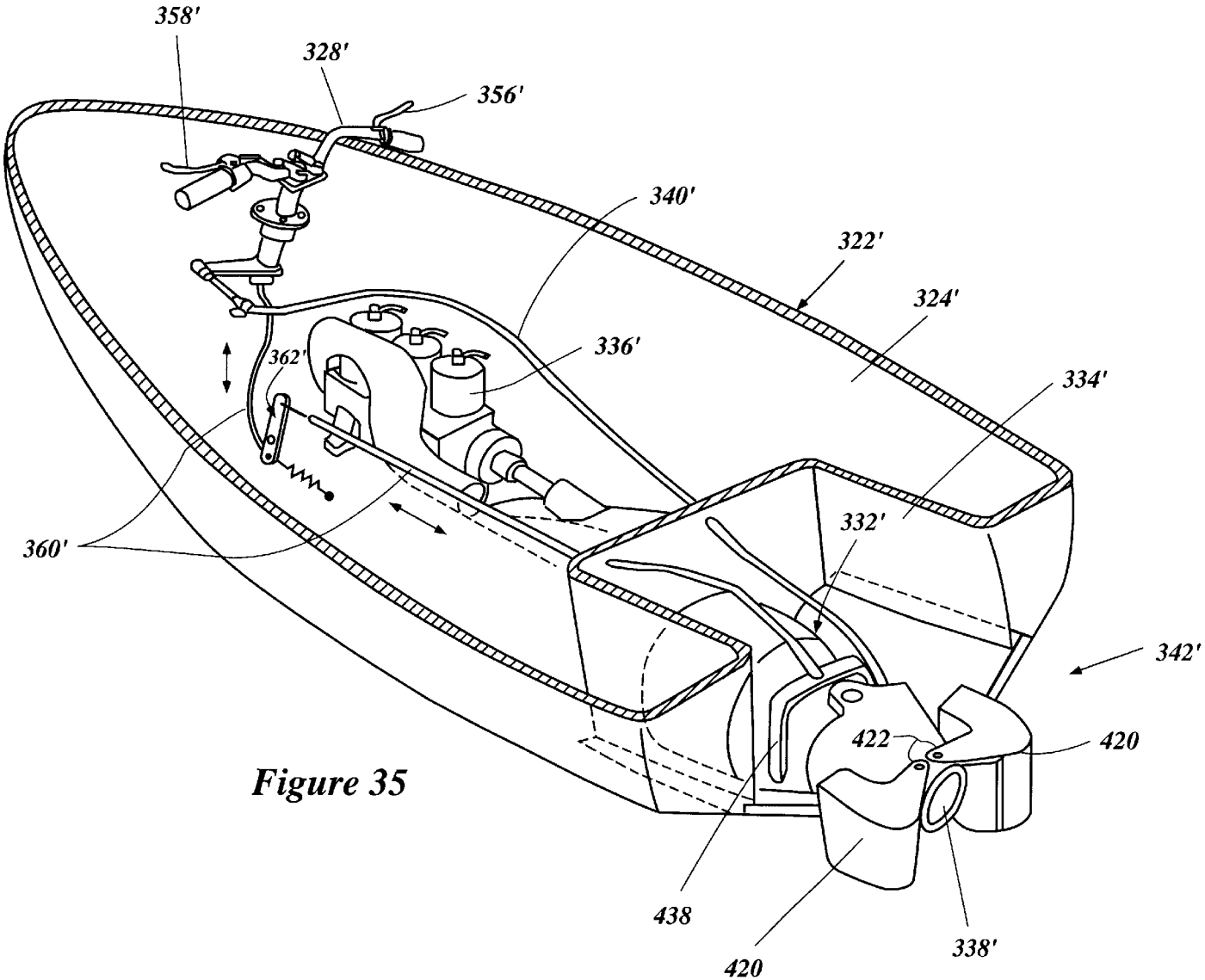
FIG. 35 is a top, rear, and port side perspective view of the lower hull of the watercraft of FIG. 34.
Figure 36:
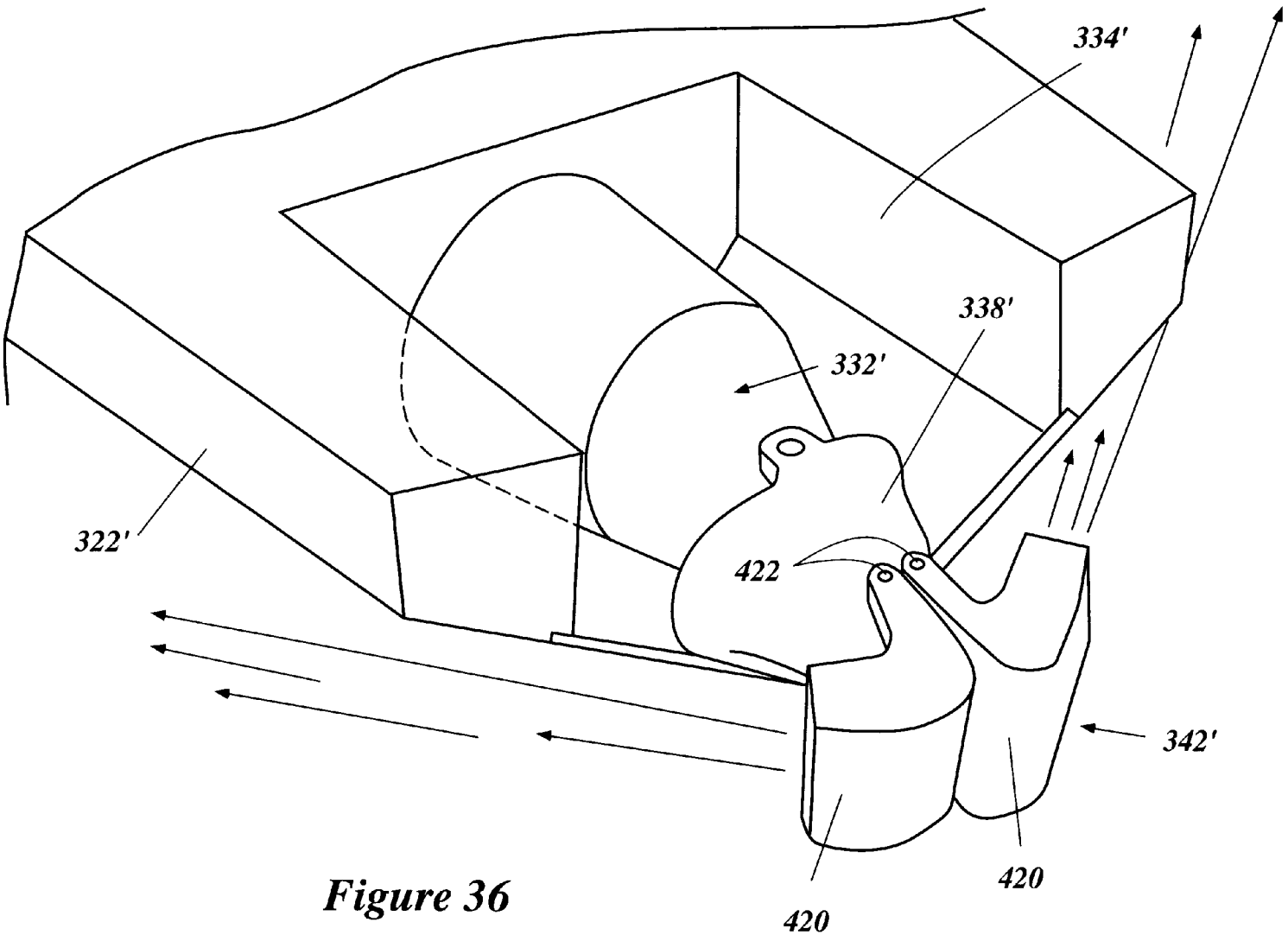
FIG. 36 is a top, rear, and port side perspective view of the jet propulsion unit of FIG. 34 showing the water diverter bucket assembly in a fully closed position and issuing diverted water in a generally forward direction and substantially below a lower surface of the hull of the watercraft.
Figure 37:
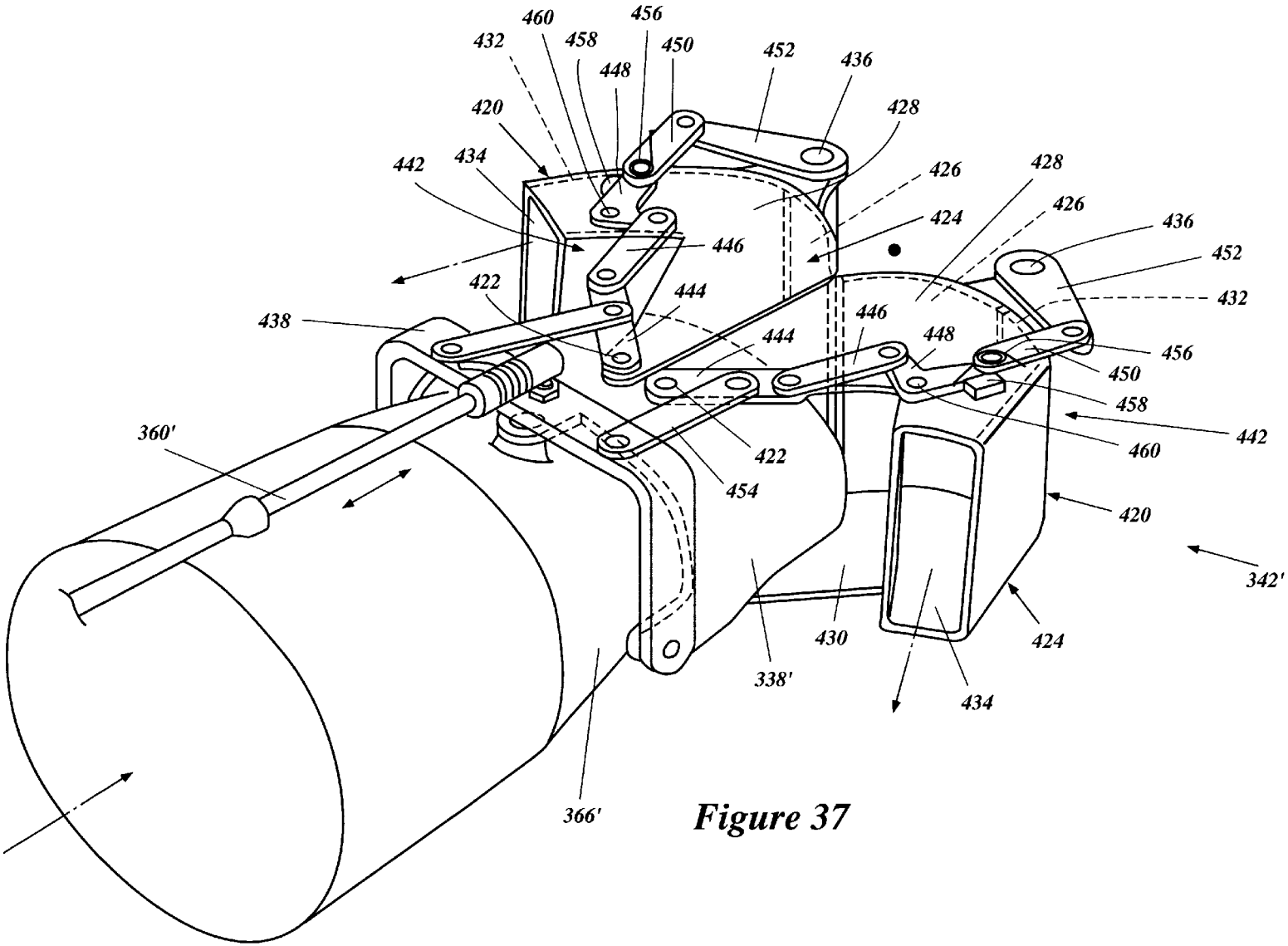
FIG. 37 is a top, front, and port side perspective view of the bucket assembly mounted to the jet pump housing which is removed from the watercraft, the bucket assembly shown in a closed position and showing a linkage arrangement configured to move the bucket assembly between an opened and closed position.
Figure 38:
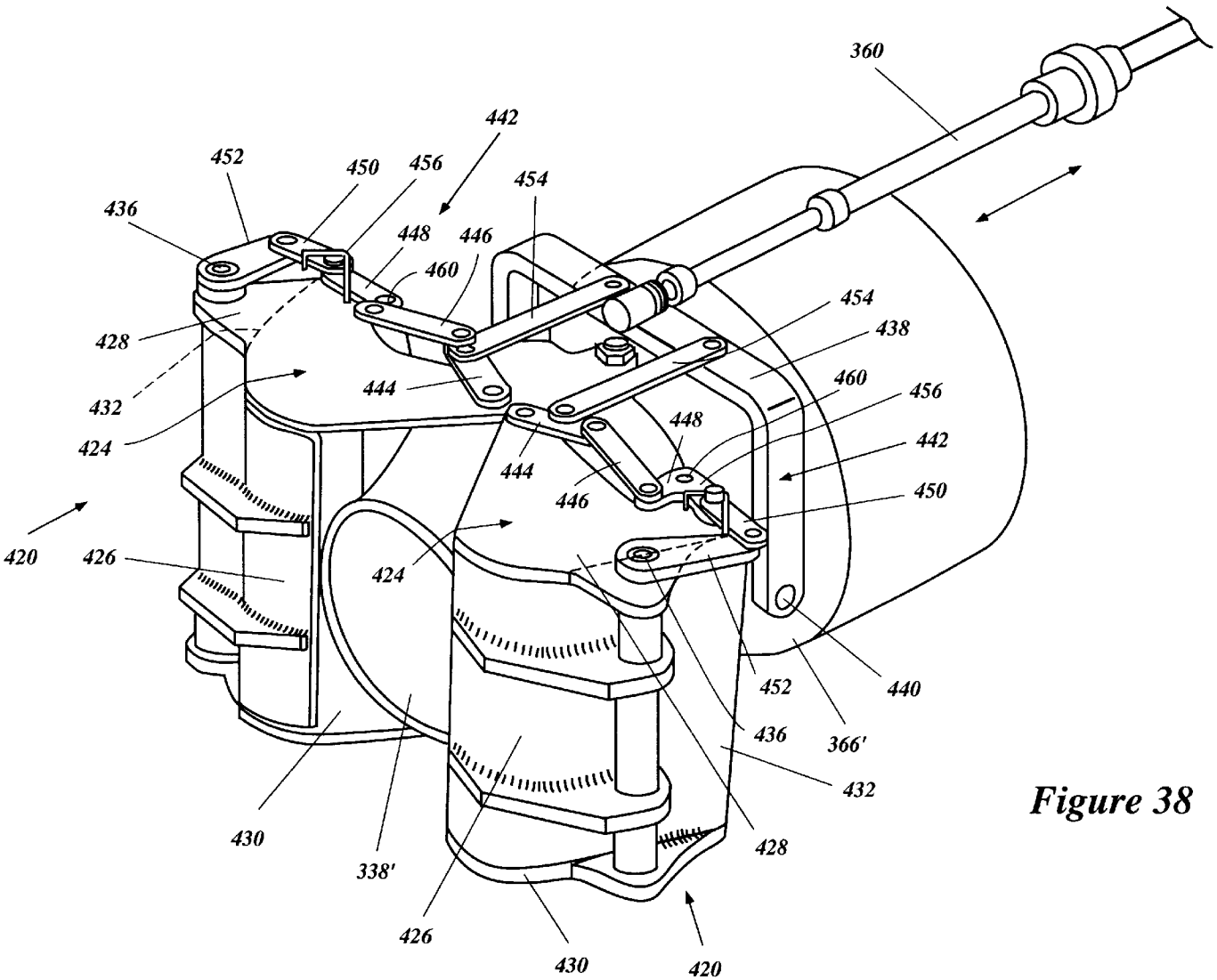
FIG. 38 is a top, rear, and starboard side perspective view of the bucket assembly shown in FIG. 37 in an open position.

With reference to FIG. 35, the water diverter bucket assembly 342' generally comprises a pair of generally arcuate bucket members 420 supported on opposing lateral sides of the steering nozzle 338'. Each bucket member 420 is supported by an upper and lower pin 422 for rotation about a substantially vertical axis. The bucket members 420 are configured for movement between an open position wherein the bucket members 420 are rotated away from the steering nozzle 338' and a closed position (FIG. 37) wherein the bucket members 420 are rotated toward one another and positioned behind the steering nozzle 338'. The bucket members 420 cooperate in their closed position to redirect a water jet issuing from the steering nozzle 338' in a forward direction and produce a reverse thrust (FIG. 36). Desirably, in the closed position, the bucket members 420 issue water in slightly downward direction, below the hull 322' of the watercraft 320'.

With reference to FIGS. 37–44, the water diverter bucket assembly 342' is described in greater detail. Each bucket member 420 includes a main body portion 424 and an arcuate flap portion 426. The main body portion 424 includes arcuate shaped upper and lower walls 428, 430. A pair of supports 432 extend vertically between a laterally outward end of the upper and lower walls 428, 430 to define a secondary discharge port 434. The flap 426 is shaped to compliment the arcuate shape of the upper and lower walls 428, 430 and is pivotally supported relative to the main body 424 on a shaft 436. That is, the flap 426 is fixed for movement with the shaft 436. The flap 426 is moveable between a closed position, substantially aligned with the upper and lower walls 428, 430 of the main body 424 and an open position, wherein the flap 426 is pivoted outward with respect to the main body 424.

A substantially U-shaped control arm 438 is supported for rotation about a substantially horizontal axis by a pair of pins 440 on each end of the arm 438. The pins 440 couple the control 438 to the steering nozzle 338'. The control arm 438 is coupled to the bowden wire 360' which is, in turn, coupled to the secondary control lever 358' for control by an operator of the watercraft 320'. The control arm 438 is also coupled to both the main body 424 and flap 426 of each of the right and left bucket members 420 through a linkage arrangement 442. To control movement of both the main body 424 and the flap 426 of each of the right and left bucket members 420.

Each linkage arrangement 442 includes, beginning from an inward location, i.e., near the center of the steering nozzle 338' and moving laterally outwardly, a first linkage member 444, a second linkage member 446, an L-shaped third linkage member 448, and a fourth linkage member 450. The first linkage member is coupled to the support pin 422 of the bucket member 420 and the fourth linkage member 450 is coupled to a lever 452 affixed to the end of the support shaft 436, which supports the flap 426. In addition, a fifth linkage member 454 extends from the control arm 438 to an intermediate position of the first linkage member 444.

A biasing member, such as torsion spring 456, is arranged to bias the third linkage member 448 and the fourth linkage member 450 apart from one another. A stop 458 (FIG. 37) affixed to the upper wall 428 of the main body 424 is arranged to support the third linkage member 448 and the fourth linkage member 450 in a substantially aligned position when the flap 426 is in a closed position relative to the main body 424. Thus, the stop 458 prevents further outward movement of the third and fourth linkage members 448, 450 which would undesirably permit the flap 426 to open in response to a water jet issuing from the steering nozzle 338'.

Figure 39:
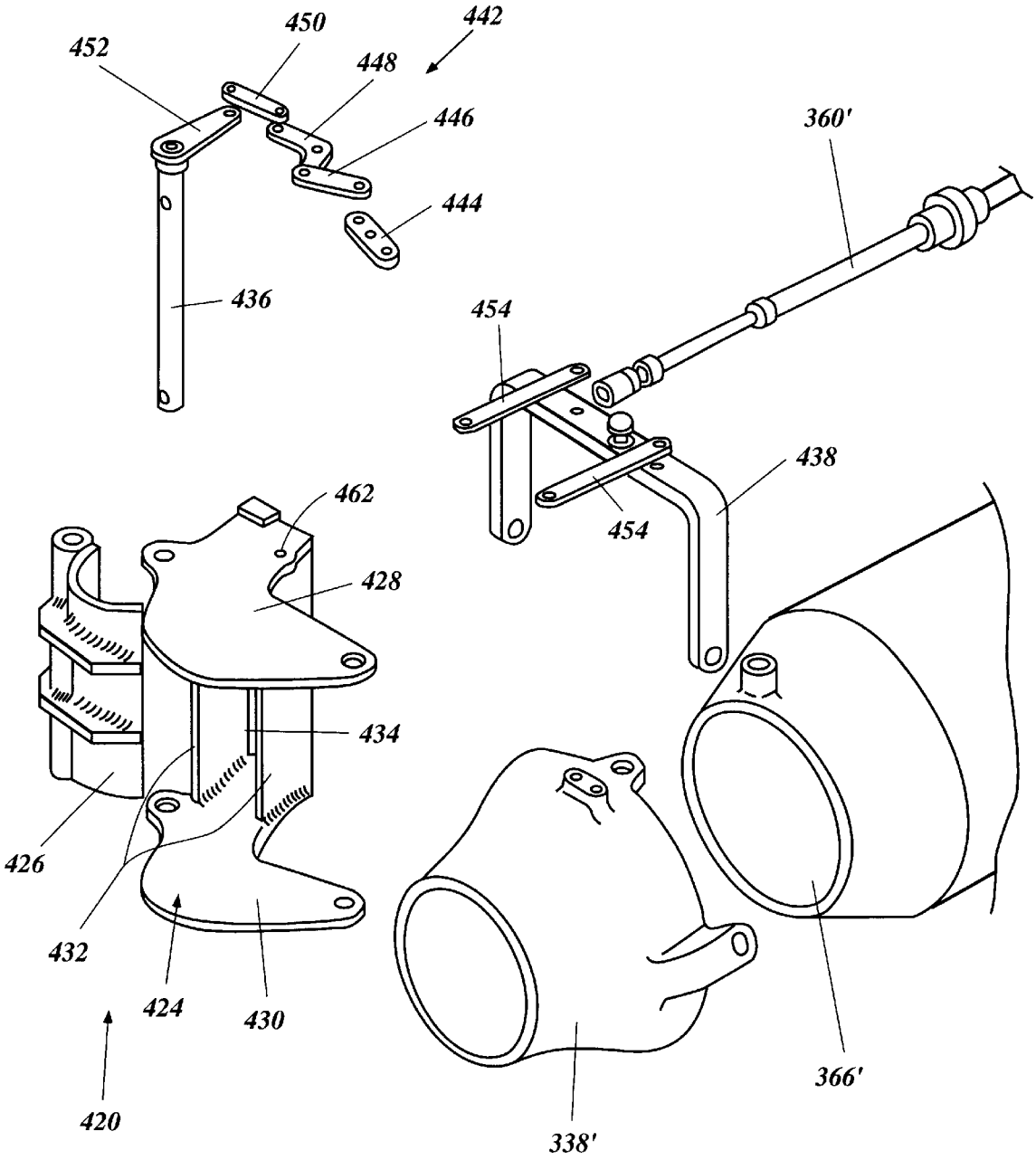
FIG. 39 is an exploded assembly view of starboard-side bucket member, which includes a main body portion and a flap. The flap is configured to pivot between an open and a closed position with respect to the main body portion of the bucket member.

Each of the first linkage member through the fourth linkage member 440, 446, 448, 450 are interconnected and, additionally, a pin 460 couples the center of the L-shaped third linkage member 448 to an outward end of the upper wall 428 of the main body 424 at an aperture 462 (FIG. 39). Thus, the control arm 438 is pivoted about the pins 440 by movement of the bowden wire 360'. The movement of the control arm 438 pivots the first linkage members 444 about the pivot pins 422 of the bucket members 420 as a result of the fifth linkage member 454 interconnecting the control arm 438 and the first linkage member 444. The individual linkage members of the linkage assembly 442 interact with one another and the lever 452 to move both the main body 424 and flap 426 of each bucket member 420 in a desired operational sequence.

Figure 40:
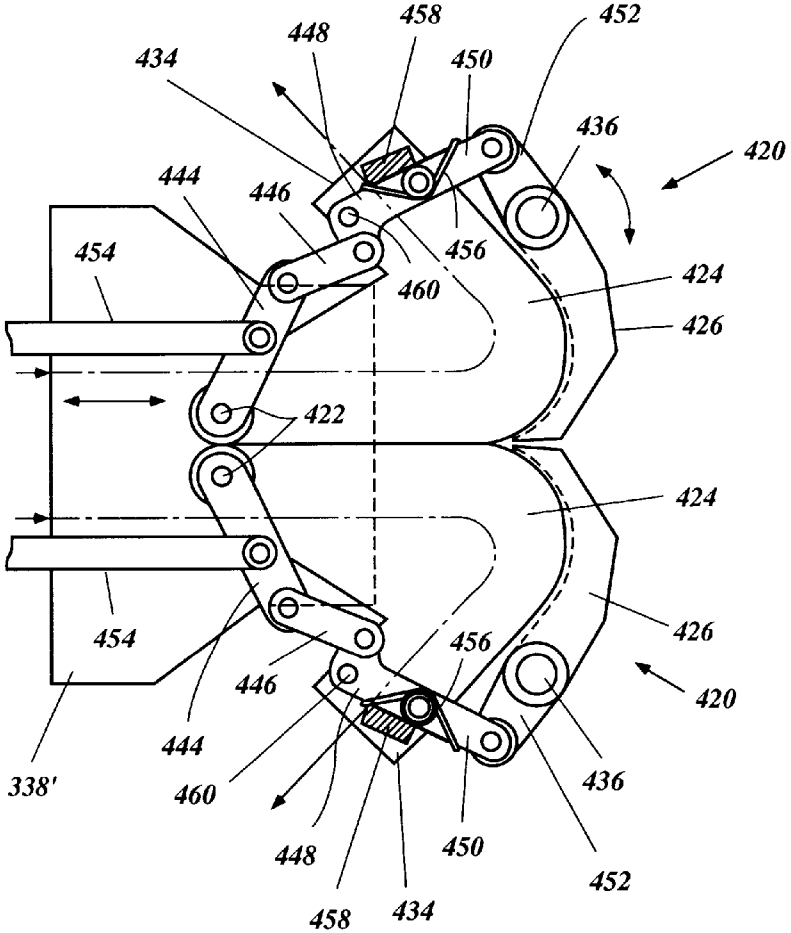
FIG. 40 is a top plan view of the bucket assembly of FIG. 35 in a fully closed position.

With reference to FIGS. 40–43, a preferred operational sequence of the diverter bucket assembly 342' in moving from the closed position to the open position is described. FIG. 40 illustrates the diverted bucket assembly 342' in a fully closed position wherein the main bodies 424 of the bucket members 420 are positioned behind a steering nozzle 338' and the flaps 426 are in a closed position relative to the main body portions 424. Thus, water issued from the steering nozzle 338' is redirected by the flaps 426 and expelled in a generally forward direction through the discharge ports 434. This produces a reverse thrust and moves the watercraft 320 in a reverse direction. Desirably, with the water diverter bucket 342' in the fully closed position, the secondary control lever 358' is in an engaged position, i.e., toward the handlebar assembly 328'.

As the operator releases the secondary control lever 358', a pulling force is applied to the bowden wire 360' connected to the control arm 438. Accordingly, the control arm 438 is pivoted in a forward direction, i.e., away from the steering nozzle 338'. As a result, the first linkage members 444 are pivoted about the support pins 422. The second linkage members 446 act on the third linkage members 448 and cause relative rotation of the third and fourth linkage members 448, 450 with respect to one another and against the biasing force of the torsion spring 456. Thus, the flaps 426 are moved into their open position relative to the main bodies 424 of the bucket members 420.

Figure 42:
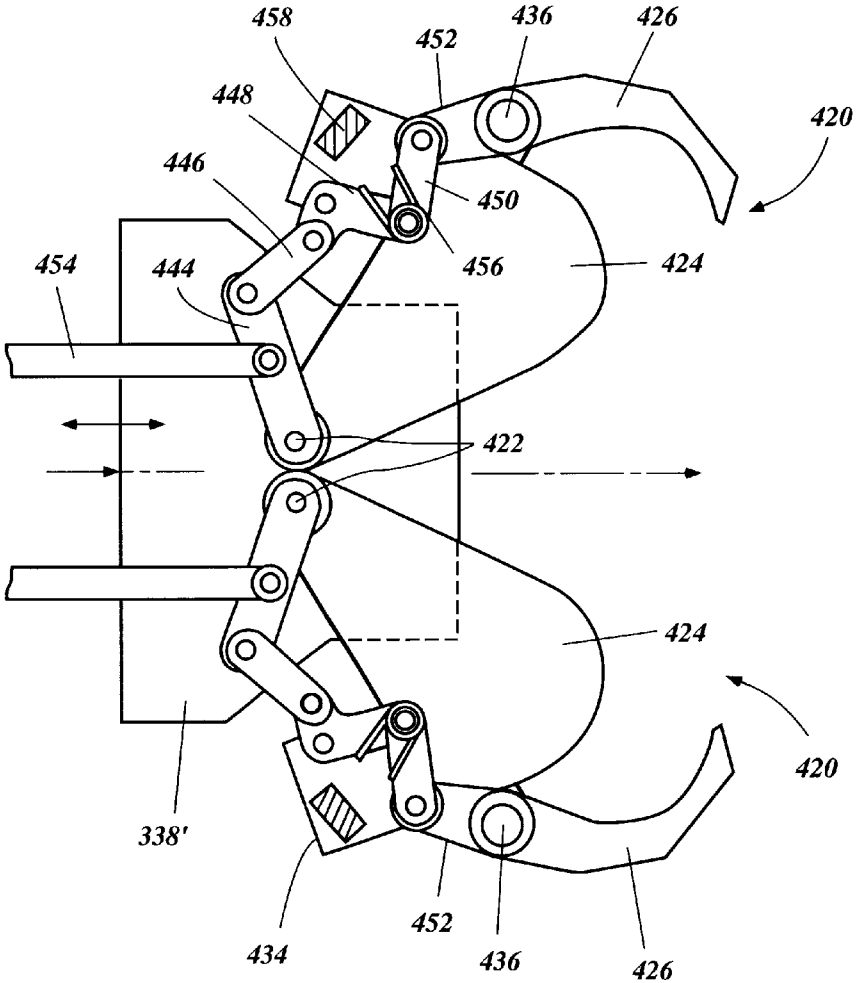
FIG. 42 is a top plan view of the bucket assembly of FIG. 40 in a fully open position, wherein the main body portions are in the open position and the flaps are in the open position.
Figure 44:
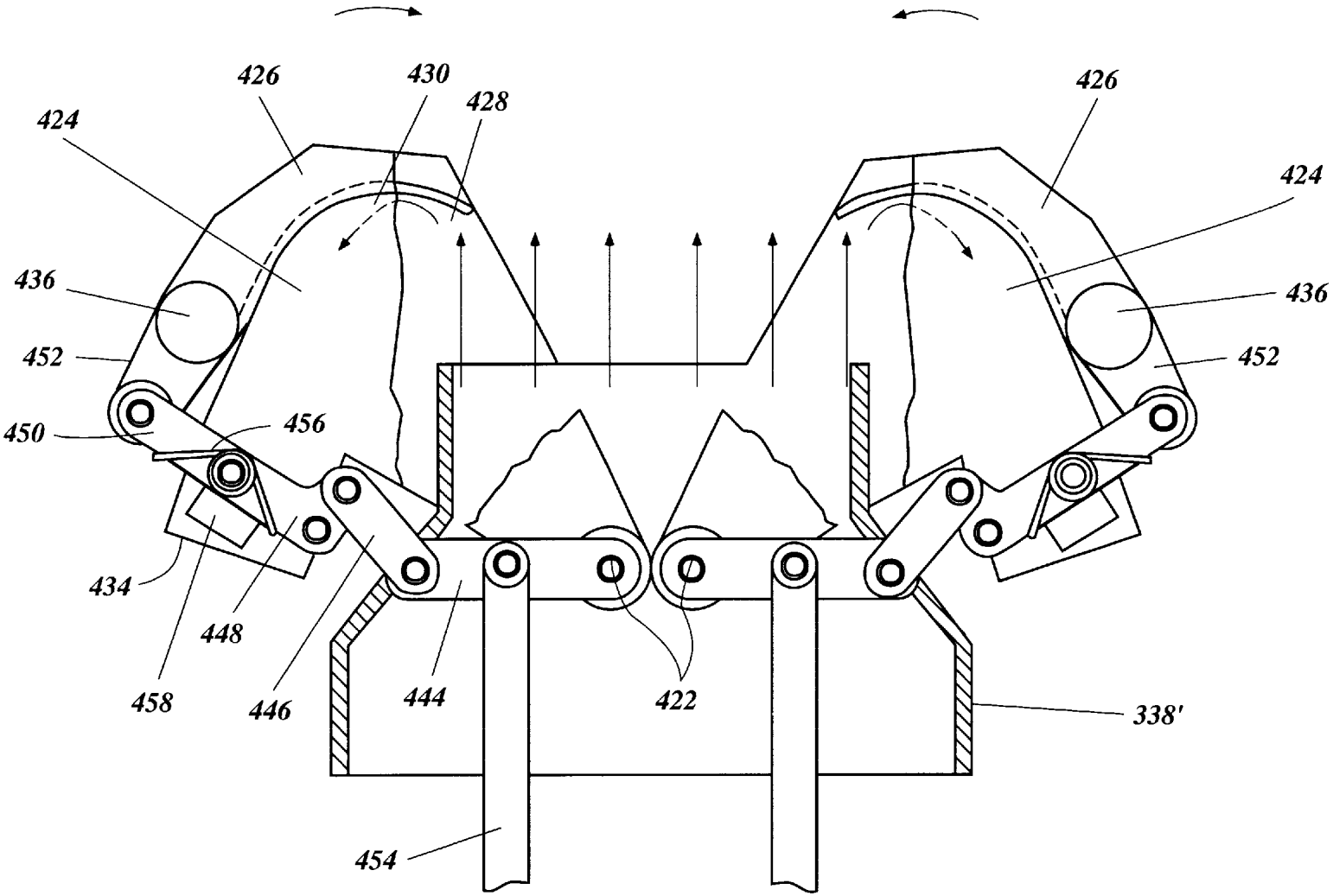
FIG. 44 is a top plan view of the bucket assembly of FIG. 35 shown in a partially open position, wherein the bucket members have moved from the fully open position toward the closed position and before the flaps have moved toward the open position with respect to the main body portions.

With reference to FIG. 42, upon continued movement of the secondary control lever 358' and thus, the control arm 438, the second linkage members 446 rotate inward with respect to the first linkage members 444 and move the main body portions 424 outward toward their open position relative to the steering nozzle 338'.

Figure 43:
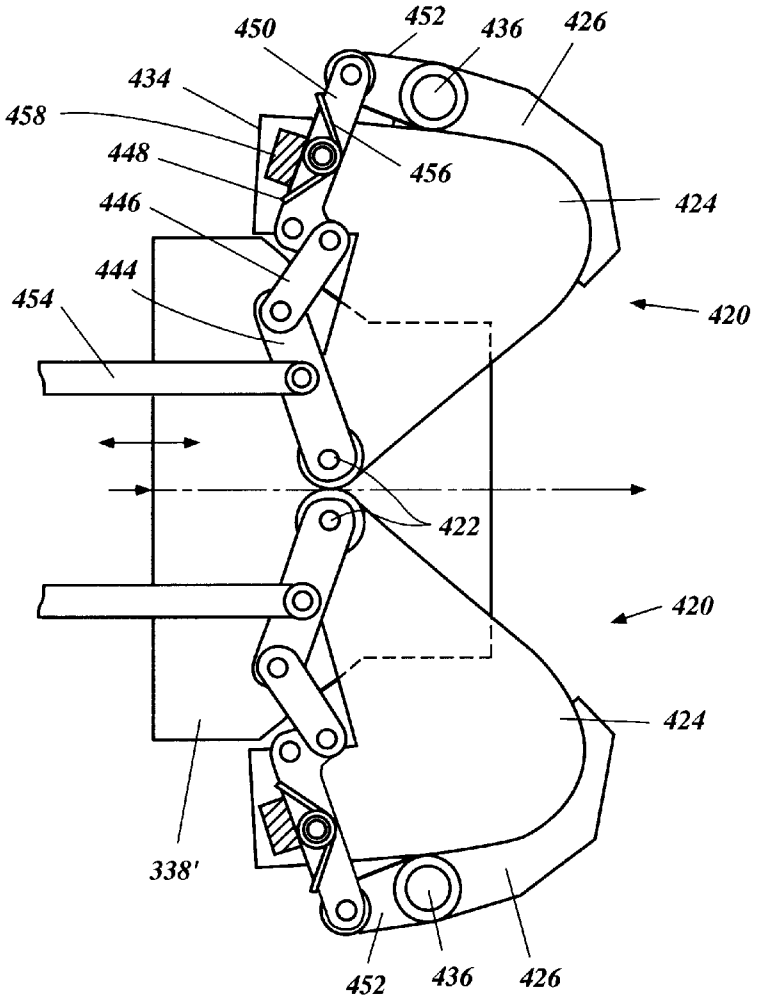
FIG. 43 is a top plan view of the bucket assembly of FIG. 40 in a partially open position, wherein the main body portions are in the open position and the flaps are in the closed position with respect to the main body portions.

With reference to FIG. 43, once the body portions 424 have reached their fully opened position, the biasing force of the torsion spring 456 rotates the third and fourth linkage members 448, 450 away from one another to move the flaps 426 toward their closed position relative to the main body portions 424. When the flaps 426 have reached their fully closed positions, the third and fourth linkage members 448, 450 contact the stops 456 and are held in a substantially aligned configuration to prevent undesired opening of the flaps 426 relative to the main body portions 424, as described above. Thus, in FIG. 43, the water diverter bucket assembly 420 is illustrated in the fully open position to permit forward movement of the watercraft 320'.

Figure 41:
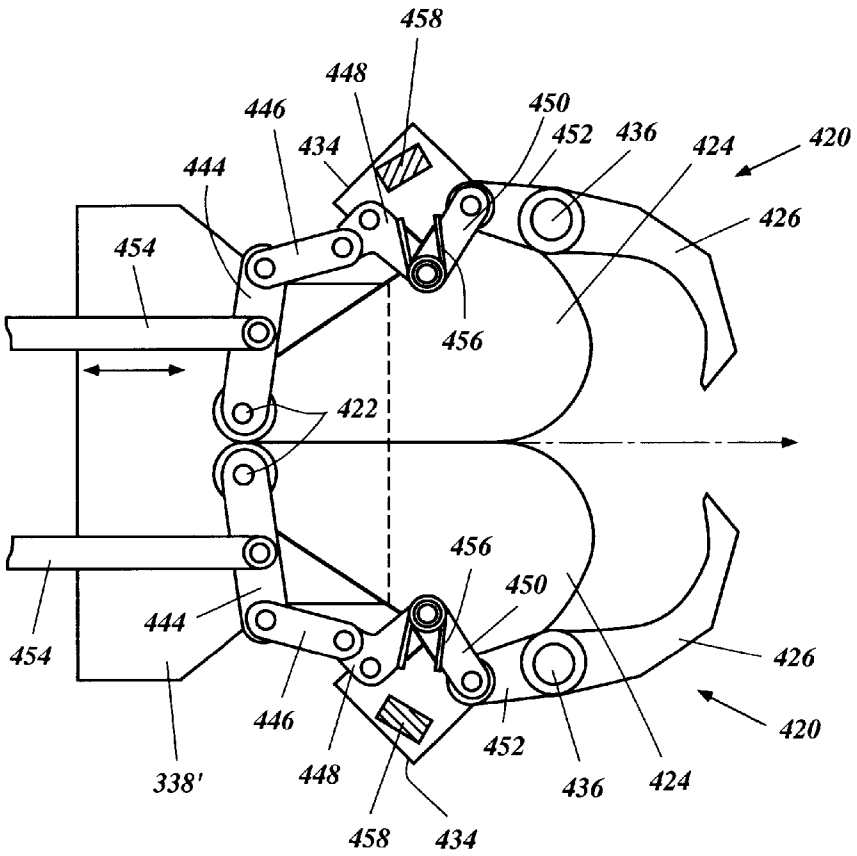
FIG. 41 is a top plan view of the bucket assembly of FIG. 40 in a partially close position, wherein the main body portions are in the closed position with respect to the steering nozzle and the flaps are open with respect to the main body positions.

Accordingly, because the flaps 426 move toward their open position relative to the main body portions 424 before the main body portions 424 are moved significantly toward their closed positions relative to the steering nozzle 338', the main body portions 424 are permitted to move to their fully closed positions relative to the steering nozzle 338' with reduced resistance from to the water jet. With the flaps 426 in the open position, the water jet issued from the steering nozzle 338' is substantially permitted to move past the open flaps 426 and through the open rearward ends of the main body portions 420, as illustrated in FIG. 41.

Preferably, when the water diverter bucket assembly 342' moves from the fully open position to the closed position, the flaps 426 are retained in the closed position. As a result, the water jet W issued from the steering nozzle 338' assists in moving the bucket assembly 420 to the closed position due to the curvature of the flaps 426. FIG. 45 illustrates the water jet W that is redirected by the flaps 426 as the bucket members 420 move toward their closed positions, which assists the closing of the bucket members 420 in a manner similar to that described above with reference to the bucket assembly 342 of FIG. 29.

Accordingly, the water diverter bucket assembly 342' is permitted to move to its closed position with reduced force. As a result, the conversion member 362' of the watercraft 320 of FIG. 34 may permit the bucket assembly 342' to function adequately as a stroke increasing member, without a force increasing member being necessary. Alternatively, however, the water diverter bucket assembly 342' described in relation to FIGS. 34–44, may also incorporate any of the reverse thrust control arrangements described above.

Although this invention has been described in terms of certain preferred embodiments, other embodiments apparent to those of ordinary skill in the art are also within the scope of this invention. Accordingly, the scope of the present invention should be defined only by the appended claims.

What is claimed is:

1. A watercraft comprising a hull, an engine supported by the hull, a jet propulsion unit driven by the engine, the jet propulsion unit comprising a discharge nozzle configured to direct a water jet in a generally rearward direction, a water diverter bucket assembly mounted near the discharge nozzle and movable between an opened position and a closed position wherein the bucket assembly at least partially redirects the water jet, a control assembly for moving the bucket assembly between the opened and closed position, the control assembly comprising an electric motor, an actuator configured to operate the electric motor, and a cable clutch mechanism, the cable clutch mechanism comprising at least one spool driven by the electric motor, at least one operation cable being wound around the at least one spool and having a first end and a second end, the first end being coupled to the actuator and the second end being coupled to the bucket assembly, wherein movement of the actuator moves the first end of the operation cable and activates the electric motor, the at least one operation cable frictionally engaging the spool to move the second end of the operation cable and thereby moving the bucket assembly toward one of the open and closed positions.

2. The small watercraft of claim 1 additionally comprising a stroke increasing mechanism between the control assembly and the bucket assembly and being configured to increase movement of the bucket assembly relative to movement of the control assembly.

3. The small watercraft of claim 1, wherein the at least one spool comprises a first spool and a second spool, wherein the electric motor drives the first spool in a first direction and the second spool in a second direction, opposite the first direction, and wherein the at least one operation cable comprises a first cable wound around the first spool and a second cable wound around the second spool, wherein movement of the actuator in a first direction causes the first spool to frictionally engage the first cable to move the second end of the first cable, thereby moving the deflector assembly toward the open position, and wherein movement of the actuator in a second direction causes the second spool to frictionally engage the second cable to move the second end of the cable, thereby moving the deflector assembly toward the closed position.

4. The small watercraft of claim 1, additionally comprising a wear resistance material interposed between the at least one operation cable and the at least one spool.

5. The small watercraft of claim 4, wherein the wear resistant material is disposed on the at least one spool.

6. The small watercraft of claim 4, wherein the wear resistant material is disposed on the at least one operation cable.

7. The small watercraft of claim 6, wherein the at least one operation cable is generally rectangular in cross section, the wide surface of the at least one operation cable facing the at least one spool and the wear resistant material being disposed only on the surface facing the spool.

8. The small watercraft of claim 1, wherein the actuator comprises a control lever mounted on a handlebar assembly of the watercraft.

9. The small watercraft of claim 1, additionally comprising a power request control device configured to receive a power request from an operator of the watercraft and to control a power output control device of the engine, a reverse cable configured to move the water diverter bucket assembly between the open position and the closed position, a secondary control actuator coupled to the reverse cable, a secondary power output control mechanism operated by the secondary control actuator and configured to adjust the power output control device to increase a power output of the engine after the water diverter bucket assembly reaches the second position.

10. The small watercraft of claim 9, wherein the reverse cable comprises a first portion and a second portion, and wherein the secondary power output control mechanism comprises a geneva wheel mechanism positioned between the first and second portions of the reverse cable, the geneva wheel mechanism comprising an original wheel, a reverse follower and a throttle follower, the first portion of the reverse cable being configured to rotate the original wheel, the reverse follower being rotatable to apply a force to the second portion of the reverse cable to move the water diverter bucket assembly between the first and second positions, the throttle follower being rotatable to apply a force to the second power output device which comprises a cable attached to a throttle valve of the engine, to move the throttle valve, wherein the original wheel is configured to rotate the reverse follower to move the thrust bucket assembly to the second position and is additionally configured to rotate the throttle follower thereby moving the throttle valve and increasing an operating speed of the engine after the water diverter assembly reaches the second position.

11. The small watercraft of claim 9, wherein the reverse cable comprises a first portion and a second portion, and wherein the secondary control mechanism comprises a linkage mechanism positioned between the first and second portions of the reverse cable, the linkage mechanism comprising a first linkage member, a second linkage member and a third linkage member, the first linkage member being pivotally supported, the first portion of the reverse cable being configured to pivot the first linkage member, the second linkage member being pivotally supported and configured to apply a force to the second portion of the reverse cable to move the water diverter bucket assembly between the first and second positions, the third linkage member being pivotally supported and configured adjust the second power output mechanism to move a throttle valve of the engine, wherein the first linkage member is configured to pivot the second linkage member to move the water diverter bucket assembly to the second position and is additionally configured to pivot the third linkage member thereby moving the throttle valve and increasing an operating speed of the engine after the water diverter bucket assembly reaches the second position.

12. The small watercraft of claim 1, wherein the hull additionally comprises at least one inlet, at least one outlet, and at least one secondary flow passage connecting the at least one inlet to the at least one outlet, the water diverter bucket assembly additionally being configured to, when in the second position, redirect at least a portion of the water jet toward the at least one inlet, at least one lid member associated with the at least one outlet and movable between an open position and a closed position, the lid member substantially preventing water from entering the at least one outlet in the closed position, and the lid member permitting water within the secondary flow passage to exit from said at least one outlet in the open position, and a biasing member configured to bias the lid member into the closed position, the at least one outlet being configured to expel the pressurized water in a generally forward direction.

13. The small watercraft of claim 1, wherein the bucket assembly comprises a pair of bucket members positioned on opposing sides of the discharge nozzle and being pivotal about a substantially vertical axis, each bucket member comprising a main body portion and a flap member, the main body portion defining a rearward opening and a forward opening, the flap member being pivotally connected to the main body portion and movable from a closed position to an open position with respect to the main body portion, wherein, in the closed position, the flap member substantially closes the rearward opening and redirects at least a portion of the water jet toward the forward opening to produce a reverse thrust and, in the open position, the flap member permits at least a portion of the water jet to pass through the reverse opening, the small watercraft additionally comprising a secondary control actuator and a linkage arrangement moveable by the secondary control actuator, the linkage arrangement being configured to move the bucket assembly between the open and closed position and further configured to move the flaps between the open and closed position with respect to the main body portions, wherein the flaps are in the closed position when the bucket assembly is moved from the open position to the closed position and the flaps are permitted to move to the open position when the bucket assembly is moved from the closed position to the open position.

14. A watercraft comprising a hull, an engine supported by the hull, a jet propulsion unit driven by the engine, the jet propulsion unit comprising a discharge nozzle configured to direct a water jet in a generally rearward direction, a water diverter bucket assembly mounted near the discharge nozzle and movable between an open position and a closed position in which the bucket assembly at least partially redirects the water jet, a control assembly configured to move the bucket assembly between the first and second positions, the control assembly comprising an electric motor, an actuator configured to operate the electric motor, and a cable clutch mechanism, the cable clutch mechanism comprising a first spool and a second spool driven by the electric motor, the first spool being driven in a first direction and the second spool being driven in a second direction opposite the first direction, a first operation cable being wound around the first spool and having a first end and a second end, a second operation cable being wound around the second spool and having a first end and a second end, an input arm coupled to the actuator, and an output arm coupled to the bucket assembly, the first ends of the first and second operation cables being connected to the input arm and the second ends of the first and second operation cables being connected to the output arm, wherein movement of the input arm in a first direction causes the first operation cable to frictionally engage the first spool and move the output arm in a first direction thereby moving the deflector assembly toward the open position and movement of the input arm in a second direction causes the second operation cable to frictionally engage the second spool and move the output arm in a second direction thereby moving the deflector assembly toward the closed position.

15. The small watercraft of claim 14, additionally comprising a wear resistance material interposed between the at least one operation cable and the at least one spool.

16. The small watercraft of claim 15, wherein the wear resistant material is disposed on the at least one spool.

17. The small watercraft of claim 15, wherein the wear resistant material is disposed on the at least one operation cable.

18. The small watercraft of claim 17, wherein the at least one operation cable is generally rectangular in cross section, the wide surface of the at least one operation cable facing the at least one spool and the wear resistant material being disposed only on the surface facing the spool.

19. The small watercraft of claim 14, wherein the actuator comprises a secondary control lever mounted on a handlebar assembly of the watercraft.

20. The small watercraft of claim 14, additionally comprising a throttle cable configured to move a throttle valve of the engine, a throttle control actuator coupled to the throttle cable, a reverse cable configured to move the water diverter bucket assembly between the open position and the closed position, a secondary control actuator coupled to the reverse cable, a secondary throttle control mechanism operated by the secondary control actuator and configured to apply a force to the throttle cable to move the throttle valve in a direction to increase the operating speed of the engine after the water diverter bucket assembly reaches the second position.

21. The small watercraft of claim 20, wherein the reverse cable comprises a first portion and a second portion, and wherein the secondary throttle control mechanism comprises a geneva wheel mechanism positioned between the first and second portions of the reverse cable, the geneva wheel mechanism comprising an original wheel, a reverse follower and a throttle follower, the first portion of the reverse cable being configured to rotate the original wheel, the reverse follower being rotatable to apply a force to the second portion of the reverse cable to move the water diverter bucket assembly between the first and second positions, the throttle follower being rotatable to apply a force to the throttle cable to move the throttle valve, wherein the original wheel is configured to rotate the reverse follower to move the thrust bucket assembly to the second position and is additionally configured to rotate the throttle follower thereby moving the throttle valve and increasing an operating speed of the engine after the water diverter assembly reaches the second position.

22. The small watercraft of claim 20, wherein the reverse cable comprises a first portion and a second portion, and wherein the secondary control mechanism comprises a linkage mechanism positioned between the first and second portions of the reverse cable, the linkage mechanism comprising a first linkage member, a second linkage member and a third linkage member, the first linkage member being pivotally supported, the first portion of the reverse cable being configured to pivot the first linkage member, the second linkage member being pivotally supported and configured to apply a force to the second portion of the reverse cable to move the water diverter bucket assembly between the first and second positions, the third linkage member being pivotally supported and configured to apply a force to the throttle cable to move the throttle valve, wherein the first linkage member is configured to pivot the second linkage member to move the water diverter bucket assembly to the second position and is additionally configured to pivot the third linkage member thereby moving the throttle valve and increasing an operating speed of the engine after the water diverter bucket assembly reaches the second position.

23. The small watercraft of claim 14, wherein the hull additionally comprises at least one inlet, at least one outlet, and at least one secondary flow passage connecting the at least one inlet to the at least one outlet, the water diverter bucket assembly additionally being configured, in the second position, to redirect at least a portion of the water jet toward the at least one inlet, at least one lid member associated with the at least one outlet and movable between an open position and a closed position, the lid member substantially preventing water from entering the at least one outlet in the closed position, and the lid member permitting water within the secondary flow passage to exit from said at least one outlet in the open position, and a biasing member configured to bias the lid member into the closed position, the at least one outlet being configured to expel the pressurized water in a generally forward direction.

24. The small watercraft of claim 14, wherein the bucket assembly comprises a pair of bucket members positioned on opposing sides of the discharge nozzle and being pivotal about a substantially vertical axis, each bucket member comprising a main body portion and a flap member, the main body portion defining a rearward opening and a forward opening, the flap member being pivotally connected to the main body portion and movable from a closed position to an open position with respect to the main body portion, wherein, in the closed position, the flap member substantially closes the rearward opening and redirects at least a portion of the water jet toward the forward opening to produce a reverse thrust and, in the open position, the flap member permits at least a portion of the water jet to pass through the reverse opening, the small watercraft additionally comprising a secondary control actuator and a linkage arrangement moveable by the secondary control actuator, the linkage arrangement being configured to move the bucket assembly between the open and closed position and further configured to move the flaps between the open and closed position with respect to the main body portions, wherein the flaps are in the closed position when the bucket assembly is moved from the open position to the closed position and the flaps are permitted to move to the open position when the bucket assembly is moved from the closed position to the open position.

25. A watercraft comprising a hull, an engine supported by the hull, the engine comprising a power output control device configured to influence a power output of the engine, a jet propulsion unit driven by the engine, the jet propulsion unit comprising a discharge nozzle configured to direct a stream of pressurized water in a generally rearward direction, a water diverter bucket assembly mounted near the discharge nozzle and movable between an open position and a closed position in which the water diverter bucket assembly at least partially redirects the stream of pressurized water, a reverse cable configured to move the deflector assembly between the open position and the closed position, a secondary control actuator coupled to the reverse cable and connected to the power output control device, the secondary control actuator being configured to adjust the power output control device to increase the power output of the engine after the water diverter bucket assembly reaches the second position.

26. The small watercraft of claim 25, wherein the reverse cable comprises a first portion and a second portion, and wherein the secondary secondary control actuator comprises a geneva wheel mechanism positioned between the first and second portions of the reverse cable, the geneva wheel mechanism comprising an original wheel, a reverse follower and a throttle follower, the first portion of the reverse cable being configured to rotate the original wheel, the reverse follower being rotatable to apply a force to the second portion of the reverse cable to move the water diverter bucket assembly between the first and second positions, the throttle follower being rotatable to apply a force to the power output control device to adjust the power output of the engine, wherein the original wheel is configured to rotate the reverse follower to move the thrust bucket assembly to the second position and is additionally configured to rotate the throttle follower and increasing an operating speed of the engine after the water diverter assembly reaches the second position.

27. The small watercraft of claim 25, wherein the reverse cable comprises a first portion and a second portion, and wherein the secondary control mechanism comprises a linkage mechanism positioned between the first and second portions of the reverse cable, the linkage mechanism comprising a first linkage member, a second linkage member and a third linkage member, the first linkage member being pivotally supported, the first portion of the reverse cable being configured to pivot the first linkage member, the second linkage member being pivotally supported and configured to apply a force to the second portion of the reverse cable to move the water diverter bucket assembly between the first and second positions, the third linkage member being pivotally supported and configured to apply a force to the power output control device, wherein the first linkage member is configured to pivot the second linkage member to move the water diverter bucket assembly to the second position and is additionally configured to pivot the third linkage member thereby moving the power output control device and increasing an operating speed of the engine after the water diverter bucket assembly reaches the second position.

28. The small watercraft of claim 27, wherein the first linkage member is configured to retain the second linkage member in a position such that the bucket assembly is retained in the second position while pivoting the third linkage member to move the throttle valve.

29. A watercraft comprises a hull, an engine supported by the hull, a jet propulsion unit driven by the engine, the jet propulsion unit comprising a discharge nozzle configured to direct a water jet in a generally rearward direction, the hull including at least one inlet, at least one outlet, and at least one secondary flow passage connecting the at least one inlet to the at least one outlet, a water diverter bucket assembly mounted near the discharge nozzle and movable between a first position and a second position in which the bucket assembly redirects at least a portion of the water jet toward the at least one inlet, at least one lid member associated with the at least one outlet and movable between an open position and a closed position.

30. The small watercraft of claim 29, wherein the lid member is configured to substantially prevent water from entering the at least one outlet in the closed position, the lid member also being configured to permit water within the secondary flow passage to exit from the at least one outlet in the open position, and a biasing member configured to bias the lid member into the closed position, wherein the water within secondary flow passage overcomes the biasing force of the biasing member to move the lid member toward the open position, the at least one outlet being configured to expel the pressurized water in a generally forward direction.

31. The small watercraft of claim 30, wherein the at least one inlet comprises a first inlet and a second inlet, the at least one outlet comprises a first outlet and a second outlet, and the at least one secondary flow passage comprises a first flow passage connecting the first inlet and the first outlet and a second flow passage connecting the second inlet and the second outlet, and wherein the first inlet and the second inlet are arranged symmetrically about a longitudinal axis of the watercraft near a stem portion of the watercraft.

32. The small watercraft of claim 30, additionally comprising a control assembly for moving the water diverter bucket assembly between the first and second position, the control assembly being configured to permit an increase in an operational speed of the engine when the bucket assembly is in the second position.

33. The small watercraft of claim 30, additionally comprising at least one housing supported by the hull and having an open side, the at least one lid member being pivotally supported near a rearward end of the at least one housing, wherein the at least one outlet is defined by the at least one lid member.

34. The small watercraft of claim 33, additionally comprising a linkage assembly connecting a forward end of the at least one lid member to the at least one housing, the linkage assembly comprising a first linkage member and a second linkage member, a first end of the first linkage member being connected to the at least one lid member, a first end of the second linkage member being connected to the at least one housing, a second end of the first linkage member being connected to a second end of the second linkage member, the first and second linkage members being substantially aligned when the at least one lid member is in the open position, the biasing member having a first end connected to the linkage assembly and a second end connected to the at least one housing.

35. The small watercraft of claim 34, wherein the second end of the first linkage member and the second end of the second linkage member are directly connected at a pivot axis.

36. The small watercraft of claim 35, wherein the first end of the biasing member is connected to the linkage assembly at the pivot axis.

37. The small watercraft of claim 33, wherein the at least one lid member is curved such that the at least one outlet discharges the stream of pressurized water in a forward direction generally aligned with a longitudinal axis of the watercraft.

38. A watercraft comprising a hull, an engine supported by the hull, a jet propulsion unit driven by the engine, the jet propulsion unit comprising a discharge nozzle configured to direct a water jet in a generally rearward direction, a steering nozzle positioned rearwardly of the discharge nozzle and pivotal about a generally vertical axis, a water diverter bucket assembly mounted near the steering nozzle and movable between an opened position and a closed position in which the bucket assembly at least partially redirects the water jet, the bucket assembly comprising a pair of bucket members positioned on opposing sides of the steering nozzle and being pivotal about a substantially vertical axis, each bucket member comprising a main body portion and a flap member.

39. The small watercraft of claim 38, wherein the main body portion defines a rearward opening and a forward opening, the flap member being pivotally connected to the main body portion and movable from a closed position to an open position with respect to the main body portion, wherein, in the closed position, the flap member substantially closes the rearward opening and redirects at least a portion of the water jet toward the forward opening to produce a reverse thrust and, in the open position, the flap member permits at least a portion of the water jet to pass through the reverse opening, the small watercraft additionally comprising a secondary control actuator and a linkage arrangement moveable by the secondary control actuator, the linkage arrangement being configured to move the bucket assembly between the open and closed position and further configured to move the flaps between the open and closed position with respect to the main body portions, wherein the flaps are in the closed position when the bucket assembly is moved from the open position to the closed position and the flaps are permitted to move to the open position when the bucket assembly is moved from the closed position to the open position.

40. The small watercraft of claim 39, wherein the linkage arrangement is configured to retain the flaps in the closed position when the water diverter bucket assembly is either of the open position and the closed position.

41. The small watercraft of claim 39, additionally comprising a control arrangement configured to permit an operating speed of the engine to increase with operation of the secondary control actuator when the water diverter bucket assembly is in the closed position.

42. The small watercraft of claim 39, wherein the secondary control actuator comprises a control lever mounted a handlebar assembly of the small watercraft.

43. The small watercraft of claim 38, wherein the water diverter bucket assembly is supported by the steering nozzle.

* * * * *